US006842598B2

(12) United States Patent
Kibune et al.

(10) Patent No.: US 6,842,598 B2
(45) Date of Patent: Jan. 11, 2005

(54) IMAGE FORMING APPARATUS HAVING A PLURALITY OF DEVELOPING MEANS AROUND AN IMAGE CARRIER

(75) Inventors: Hideaki Kibune, Kanagawa (JP); Nobuyuki Yanagawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 9 days.

(21) Appl. No.: 10/609,398

(22) Filed: Jul. 1, 2003

(65) Prior Publication Data

US 2004/0067075 A1 Apr. 8, 2004

(30) Foreign Application Priority Data

Jul. 3, 2002 (JP) ..... 2002-195201
Aug. 14, 2002 (JP) ..... 2002-236250

(51) Int. Cl.[7] ..... G03G 15/01
(52) U.S. Cl. ..... 399/223; 399/226
(58) Field of Search ..... 399/119, 222, 399/223, 226, 228

(56) References Cited

U.S. PATENT DOCUMENTS 4,266,868 A * 5/1981 Bresina et al. ..... 399/269
4,591,261 A * 5/1986 Saruwatari et al. ..... 399/167
4,792,225 A * 12/1988 Itaya ..... 399/223
5,140,572 A 8/1992 Kibune et al.
5,159,587 A 10/1992 Kibune
5,172,356 A 12/1992 Kibune
6,157,797 A 12/2000 Saito et al.
6,215,974 B1 4/2001 Katoh et al.
6,256,461 B1 7/2001 Takeyama et al.
6,292,641 B1 9/2001 Takeyama et al.
6,574,442 B2 6/2003 Kibune
6,611,672 B2 8/2003 Aoki et al.

* cited by examiner

*Primary Examiner*—Hoan Tran
(74) *Attorney, Agent, or Firm*—Oblon, Spivak, McClelland, Maier & Neustadt, P.C.

(57) ABSTRACT

An image forming apparatus of the present invention includes two developing units each including two developing rollers facing a particular photoconductive drum and rotatable about respective axis parallel to the axis of the drum. Each developing unit is supported by a respective image forming unit and angularly movable about an axis substantially parallel to the axis of the drum. When each developing unit is angularly moved by a preselected angle, a gap for development is established between one of the developing rollers and the associated drum.

66 Claims, 66 Drawing Sheets

IMAGE FORMING APPARATUS HAVING A PLURALITY OF DEVELOPING MEANS AROUND AN IMAGE CARRIER

BACKGROUND OF THE INVENTION

1. Field of the Invention

The present invention relates to a copier, facsimile apparatus, printer or similar image forming apparatus and more particularly to an image forming apparatus in which a plurality of developing means is arranged around a single image carrier for selectively developing a latent image formed on the image carrier.

2. Description of the Background Art

An image forming apparatus of the type using an image forming unit in which two developing devices are arranged around a single photoconductive element is disclosed in, e.g., Japanese Patent Laid-Open Publication Nos. 10-177286, 11-44982, 22-109708 and 2000-242058 and Japanese Patent Application No. 2000-371438. In this type of image forming apparatus, a plurality of image forming units, each including two developing devices, each develop latent images with the respective developing devices. The resulting toner images are sequentially transferred to a single intermediate image transfer body one above the other, completing a color image.

In each image forming unit, one of the two developing devices is held operative for development while the other developing device is held inoperative, so that two toner images of different colors are sequentially formed on the photoconductive element. For example, to form a full- or four-color image, an image forming apparatus including two image forming units is operated such that toner images of two different colors are formed on each of two photoconductive elements one after the other while being sequentially transferred to an intermediate image transfer belt one above the other.

However, the image forming apparatus of the type using two image forming units is likely to wear and deteriorate the photoconductive elements and developers. More specifically, to produce a color image, latent images are sequentially formed on each photoconductive element and developed by the developing devices of each image forming unit. On the other hand, when a black-and-white image is to be produced, image formation is not executed with the photoconductive element associated with one image forming unit, which does not include a black developing device, although image formation is executed with the other image forming unit including the black developing device. In a black-and-white mode, therefore, the image forming unit not including the black developing device may be caused to stop operating, i.e., two developing rollers thereof both may be caused to stop rotating. However, when the developing rollers are brought into a halt with developers deposited thereon contacting the photoconductive element, toner contained in the developers rub the surface of the photoconductive element, accelerating the wear and deterioration of a photoconductive layer formed on the surface of the element.

To solve the above problem, the developing rollers of the image forming unit not performing image formation may be continuously rotated. This, however, brings about another problem that paddle rollers, screw conveyors and other agitating members, operatively connected to the developing rollers, are also driven, accelerating the wear and deterioration of the developers.

It is therefore necessary to space, in the image forming unit not performing image formation, both of the developers deposited on two developing rollers from the photoconductive element. Various methods have heretofore been proposed for preventing the developer on the developing roller of one inoperative developing device, as distinguished from the other or operative developing device, from contacting the photoconductive element. For example, Laid-Open Publication Nos. 11-44982 and 11-109708 mentioned earlier each propose a method and a configuration for reversing the direction of rotation of the developing roller to thereby remove the developer from the developing roller when development is not under way. Laid-Open Publication No. 2000-242058 teaches a method and a configuration for, by using non-contact development, constantly spacing the developers on the developing rollers from the photoconductive element while ON/OFF controlling a bias for development. Further, Japanese Patent Laid-Open publication No. 11-338257 proposes to locate a sleeve and a magnet, which is rotatable about the axis of the sleeve, upstream of the developing position of a developing roller and causes the magnet to rotate to selectively interrupt the feed of a developer to the developing position. Such conventional schemes, however, each have a particular problem left unsolved, as will be described hereinafter.

The reverse rotation scheme taught in Laid-Open Publication Nos. 11-44982 and 11-109708 is not practicable unless the developing roller is rotated for some period of time in order to remove the developer present thereon. During such a period of time, no toner images can be formed on the photoconductive element.

As for the non-contact development scheme disclosed in Laid-Open Publication No. 2000-242058, while the developer and photoconductive element perform non-contact development, the distance between the photoconductive element and the developing roller, i.e., a gap for development should preferably be small enough to enhance image quality. For this reason, a sufficient distance is not available between the developer and the photoconductive element. If development is effected in such a condition without using means for removing the developer from the developing roller, then toner deposits on the photoconductive element at the boundary between the exposed portion and the non-exposed portion of a latent image. As a result, color mixture occurs in the developing device or on the photoconductive element, lowering image quality. This kind of toner deposition is derived from a so-called edge effect ascribable to the enhancement of an electric field around the boundary between the image and non-image portions.

The selective feed scheme proposed in Laid-Open Publication No. 11-338257 requires the developing roller to rotate for some period of time in order to remove the developer on the developing roller. This not only obstructs high-speed operation, but also makes the apparatus sophisticated and bulky because a mechanism for implementing selective feed is essential.

In the circumstances described above, the surest way to prevent the developers on the developing rollers from contacting the photoconductive element may be retracting the developing devices from the respective developing positions when not effecting development. However, because one of the two developing devices is sometimes is used, the above scheme is not practicable unless each developing device is provided with a respective member supporting it in a retractable manner and a respective drive mechanism and a respective space for movement, which make the apparatus sophisticated, bulky and high cost.

A black-and-white mode is not the only case that requires both of two developing devices assigned to a single photoconductive element to be moved to their non-developing positions. For example, even when the apparatus is performing operation other than image formation, it is sometimes necessary to drive a member for cleaning an intermediate image transfer belt and members for cleaning the photoconductive drums. In this case, too, if the developers on the developing rollers are held in contact with the photoconductive element, then toner reduces the life of the photoconductive element, as stated earlier. Therefore, the above requirement should be met not only by the apparatus of the type including a plurality of image forming units each including two developing devices for a single photoconductive element, but also by an apparatus of the type including two developing devices for a single photoconductive element.

Japanese Patent Application No. 2001-371438 proposes an image forming apparatus in which two developing devices, included in an image forming unit, are constructed into a single developing unit angularly movable to switch the developing devices as to development/non-development. Although the developing devices of this kind of apparatus can share a support member, a drive mechanism and a space for movement, the developing devices cannot be moved to their non-developing positions at the same time.

Further, Japanese Patent Laid-Open Publication No. 11-125968 discloses an apparatus and a method for image formation configured to provide a period of time necessary for the switching of developing devices with a certain width for thereby providing switching means with a width of selection. This apparatus also has a problem that a sophisticated, bulky mechanism is required for switching the developing devices, resulting in an increase in size and cost.

SUMMARY OF THE INVENTION

It is an object of the present invention to protect, in an image forming apparatus of the type using an image forming apparatus including two developing devices, image carriers and developers from wear and deterioration while freeing the apparatus from a sophisticated, bulky, high cost configuration.

It is another object of the present invention to maintain, in a simple, small size, reliable image forming apparatus using an image forming unit including two developing devices, a gap for development highly accurate for thereby enhancing image quality.

An image forming apparatus of the present invention includes an image carrier configured to carry a latent image thereon, two developing devices facing the image carrier and each developing a particular latent image formed on the image carrier with a respective developer carrier. The two developing devices are constructed into a single developing unit. A rotating mechanism causes the developing unit to angularly move about a preselected axis. The rotating mechanism selectively moves the developing unit to one of three different positions:

a position where one of the two developing devices is located at a developing position close to the image carrier while the other developing device is located at a non-developing position spaced from the image carrier;

a position where the one developing device is located at a non-developing position spaced from the image carrier while the other developing device is located at a developing position close to the image carrier; and a position where the two developing devices both are located at the non-developing positions.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the image forming apparatus in accordance with the present invention will be described hereinafter.

First Embodiment

Figure 1:
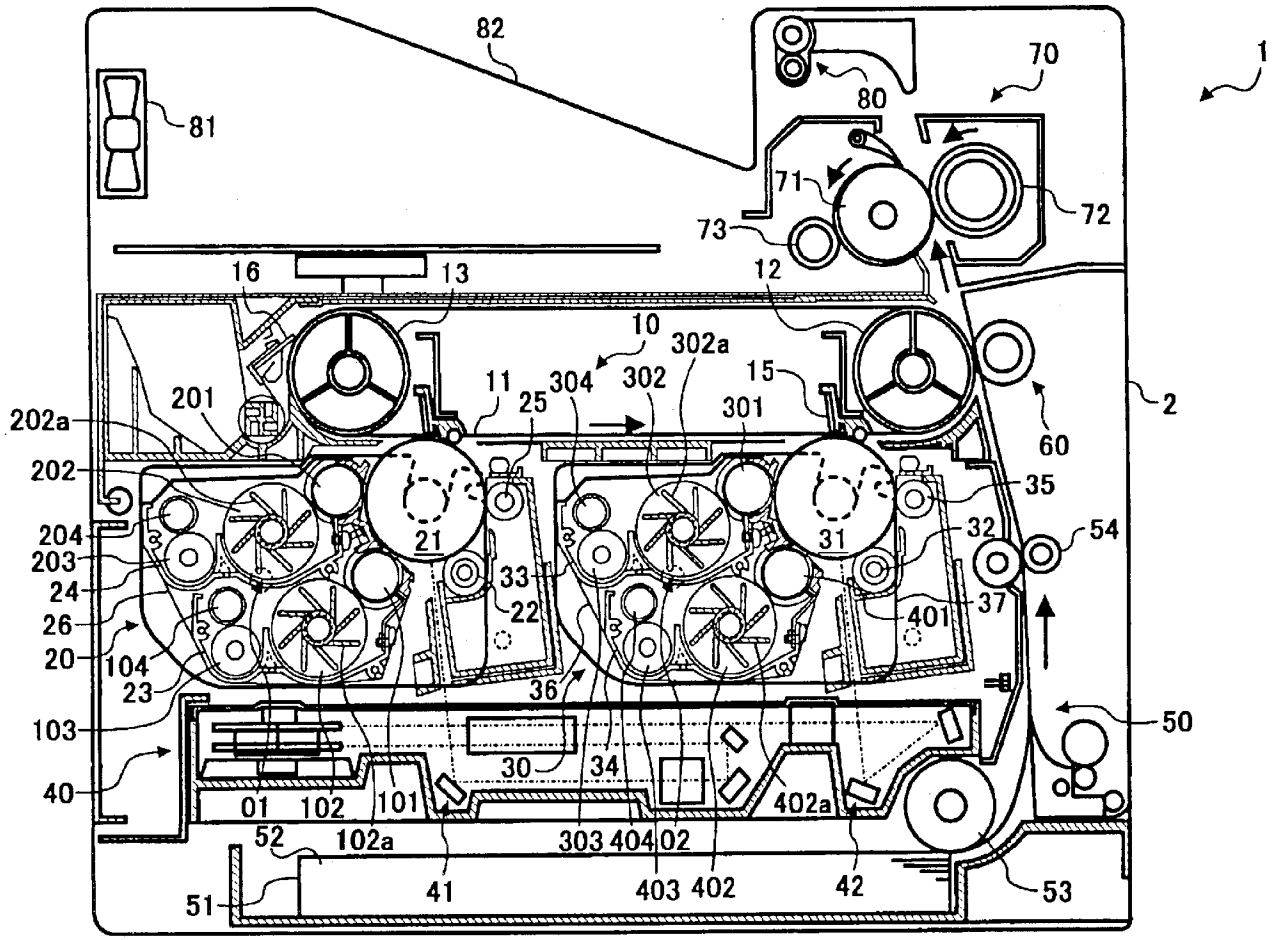
FIG. 1 is a view showing an image forming apparatus to which a first embodiment of the present invention is applied.

Referring to FIG. 1 of the drawings, an image forming apparatus embodying the present invention is shown and generally designated by the reference numeral 1. As shown, the image forming apparatus 1 includes an apparatus body 2 accommodating an intermediate image transferring section 10, a first and a second image forming unit 20 and 30, a writing unit 40, a sheet feeding unit 50, an image transferring section 60, a fixing section 70, an outlet roller pair 80, and an exhaust fan 81. A print tray 82 is positioned on the top of the apparatus body 2.

The intermediate image transferring section 10 includes a drive and a driven roller 12 and 13 over which a belt 11 is passed, a first and a second brush 14 and 15, and a cleaning portion 16. The drive roller 12 causes the belt, or intermediate image transfer body, 11 to move in a direction indicated by an arrow in FIG. 1. The length of the belt 11 between the drive roller 12 and the driven roller 13 is greater than the length of a sheet of the maximum size applicable to the apparatus 1, as measured in the direction of conveyance, by the length of a non-image region.

The brush 14, applied with a bias voltage for image transfer, transfers a toner image from the first image transferring unit 20 to the belt 11 being moved in the direction mentioned above. Subsequently, the brush 15, also applied with a bias voltage for image transfer, transfers a toner image from the second image forming unit 30 to the belt 11 above the toner image transferred from the first image forming unit 20. The belt 11 conveys the resulting composite toner image to the image transferring section 60. The first and second brushes 14 and 15, playing the role of image transferring means, may be replaced with corona dischargers or charge rollers, if desired.

The cleaning section 16 is movable into contact with part of the belt 11 passed over the driven roller 13 in order to remove toner left on the belt 11 after image transfer.

The first and second image forming units 20 and 30 are positioned below the belt 11 and spaced from each other by a preselected distance in the direction in which the belt 11 runs.

The first image transferring unit 20 includes a photoconductive drum or image carrier 21, a charger 22, an A-color developing device or developing means 23, a C-color developing device or developing means 24, and a cleaning section 25. While the drum 21 is rotated clockwise, as viewed in FIG. 1, the charger 22, implemented as a roller, uniformly charges the surface of the drum 21. A first writing section 41, included in the writing unit 40, scans the charged surface of the drum 21 with a beam modulated in accordance with an image signal, thereby forming a latent image on the drum 21. The A-color developing device 23 deposits an A-color developer on the latent image, and then the C-color developing device 24 deposits a C-color developer on the latent image over the A-color developer. The resulting composite toner image formed on the drum 21 is transferred to the belt 11 by the first brush 14.

More specifically, the A-color developing device 23 includes a developing roller 101, a paddle roller 102, a screw conveyor 103, and a developer replenishing port 104. The paddle roller 102 includes a screw-like fin 102*a* and rotates in one direction to convey the A-color developer present in the developing device 23 in the axial direction while agitating it, feeding the developer to the developing roller 101. The screw conveyor 103 conveys the A developer in the developing device 23 in the opposite direction to the paddle roller 102. As a result, the developer in the developing device 23 is sufficiently agitated by the paddle roller 102 and screw conveyor 103 before reaching the developing roller 101.

A toner container, not shown, is removably attached to the developer replenishing port 104 and replenishes fresh A-color toner to one end of the screw conveyor 103 at adequate timing, so that the toner content of the A developer is maintained constant.

The C-color developing device 24 is substantially identical in configuration with the A-color developing device 23 and includes a developing roller 201, a paddle roller 202, a screw conveyor 203, and a developer replenishing port 204. The configuration of the C-color developing device 24 will not be described specifically in order to avoid redundancy.

Figure 2:
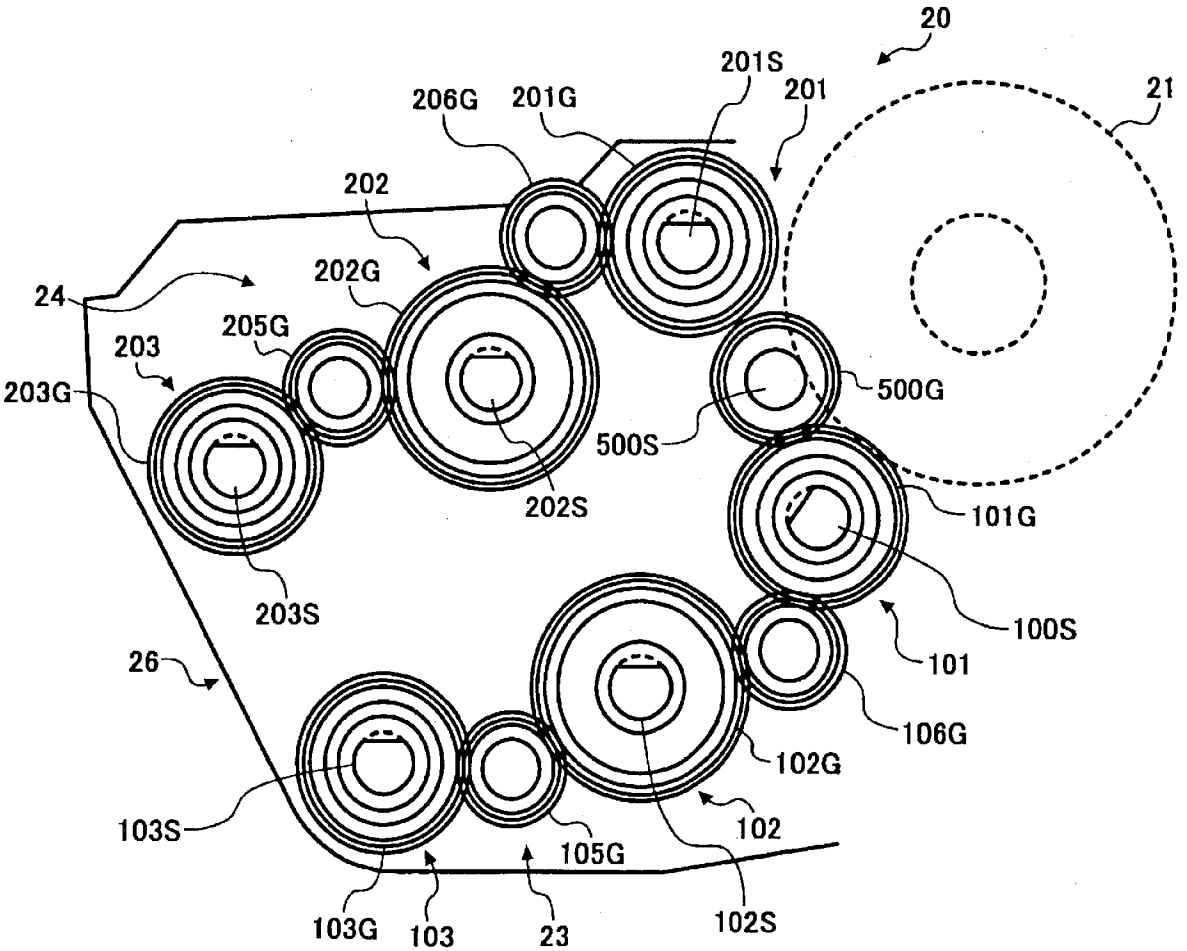
FIG. 2 is an enlarged view showing a condition, as seen from one side, wherein one developing roller of a first developing unit contacts a photoconductive drum.

As shown in FIG. 2, at the outside of one of opposite end walls of the A-color developing device 23, gears 102G and 103G are mounted on shafts 102S and 103S that support the paddle roller 102 and screw conveyor 103. The gears 102G and 103G are held in mesh with an intermediate idle gear 105G, so that the paddle roller 102 and screw conveyor 103 are operatively connected to each other. Likewise, the paddle roller 102 and developing roller 101 are operatively connected to each other via gears 102G and 101G mounted on their shafts 102S and 101S, respectively, and an intermediate idle gear 106G.

Also, in the C-developing device 24, gears 202G and 203G are mounted on shafts 202S and 203S that support the paddle roller 202 and screw conveyor 203. The gears 202G and 203G are held in mesh with an intermediate idle gear 205G, so that the paddle roller 202 and screw conveyor 203 are operatively connected to each other. Likewise, the paddle roller 202 and developing roller 201 are operatively connected to each other via gears 202G and 201G mounted on their shafts 202S and 201S, respectively, and an intermediate idle gear 206G.

The developing rollers 101 and 201 rotate when their gears 101G and 201G are driven by a drive source. More specifically, in FIG. 2, a drive shaft 500S is connected to a motor or drive source, not shown, mounted on the apparatus body 2 while a drive gear 500G is mounted on the drive shaft 500S. The drive gear 500G selectively meshes with either one of the gears 101G and 201G for thereby rotating the developing roller 101 or 201. In the specific condition shown in FIG. 2, the drive gear SOOG is held in mesh with the gear 101G, causing the developing roller 101 to rotate.

Referring again to FIG. 1, the second image transferring unit 30, like the first image forming unit 20, includes a photoconductive drum or image carrier 31, a charger 32, a B-color developing device or developing means 33, a D-color developing device or developing means 34, and a cleaning section 35. While the drum 31 is rotated clockwise, as viewed in FIG. 1, the charger, implemented as a roller, 32 uniformly charges the surface of the drum 31. A second writing section 42, included in the writing unit 40, scans the charged surface of the drum 31 with a beam modulated in accordance with an image signal, thereby forming a latent image on the drum 31. The B-color developing device 33 deposits a B-color developer on the latent image, and then the D-color developing device 34 deposits a D-color developer on the latent image over the B-color developer. The resulting composite toner image formed on the drum 31 is transferred to the belt 11 by the second brush 15.

More specifically, the B-color developing device 33 includes a developing roller 301, a paddle roller 302, a screw conveyor 303, and a developer replenishing port 304. The paddle roller 302 includes a screw-like fin 302*a* and rotates in one direction to convey the B-color developer present in the developing device 33 in the axial direction while agitating it, feeding the developer to the developing roller 301. The screw conveyor 303 conveys the B developer in the developing device 33 in the opposite direction to the paddle roller 302. As a result, the developer in the developing device 33 is sufficiently agitated by the paddle roller 302 and screw conveyor 303 before reaching the developing roller 301.

A toner container, not shown, is removably attached to the developer replenishing port 304 and replenishes fresh B-color toner to one end of the screw conveyor 303 at adequate timing, so that the toner content of the B developer is maintained constant.

The D-color developing device 34 is substantially identical in configuration with the B-color developing device 23 and includes a developing roller 401, a paddle roller 402, a screw conveyor 403, and a developer replenishing port 404. The configuration of the D-color developing device 34 will not be described specifically in order to avoid redundancy.

The paddle roller 302 and screw conveyor 303 of the B-color developing device 33 and the paddle roller 402 and screw conveyor 403 of the D-color developing device 34 are configured at the outside of one of opposite end walls included in the developing devices 33 and 34 in the same manner as in the first image forming unit 20.

The first and second image forming units 20 and 30 each are removably mounted to the apparatus body 2. The drums 21 and 31 are rotated in synchronism with the movement of the belt 11, i.e., at a peripheral speed precisely coincident with the running speed of the belt 11.

In the first image forming unit 20, the A-color and C-color developing devices 23 and 24 store, e.g., magenta toner and cyan toner, respectively. Also, the B-color and D-color developing devices 33 and 34 store yellow toner and black toner, respectively. Because black toner is used not only in a color mode but also in a black-and-white mode, the D developing device 34 is included in the second image forming unit 30 closer to the image transferring section 60 than the first image forming unit 20, thereby increasing copying speed in a black-and-white mode.

As stated above, in the first and second image forming units 20 and 30, the chargers 22 and 32 uniformly charge the surfaces of the drums 21 and 31, respectively. The first and second writing sections 41 and 42 form latent images on the charged surfaces of the drums 21 and 31, respectively. Subsequently, the developing rollers 101, 201, 301 and 401 develop the latent images formed on the drums 21 and 31. The four developing devices 23, 24, 33 and 34 identical in configuration may constitute conventional color developing devices.

In the first image forming unit 20, when one of the developing rollers 101 and 201 is rotating for developing the latent image formed on the drum 31, the other developing roller remains in a halt, as stated earlier. This is also true with the developing rollers 301 and 401 of the second image forming unit 30. In light of this, in the illustrative embodiment, the developing rollers 101, 201, 301 and 401 each are implemented as a non-conductive sleeve rotatable during development and accommodating a stationary magnet roller as conventional.

The prerequisite with the configuration described above is that the developer deposited on stationary one of the developing rollers 101 or 201 (301 or 401) be spaced from the associated drum 21 (31). Otherwise, when one of the developing rollers 101 and 201 (301 or 401) is rotating for development, the developer on the stationary developing roller is apt to deposit on the drum 21 (31) or the developer on the drum 21 (31) is apt to deposit on the stationary developing roller, resulting in undesirable color mixture.

To meet the above prerequisite, in the illustrative embodiment, switching means angularly moves the first image forming unit 20 including the developing rollers 101 and 201 or the second image forming unit 30 including the developing rollers 301 and 401 away from the drum 21 or 31, thereby shifting the developing rollers 101, 201, 301 and 401 relative to the drums 21 and 31. This successfully releases magnet brushes formed on the developing rollers 101, 201, 301 and 401 from the drums 21 and 31.

Figure 3:
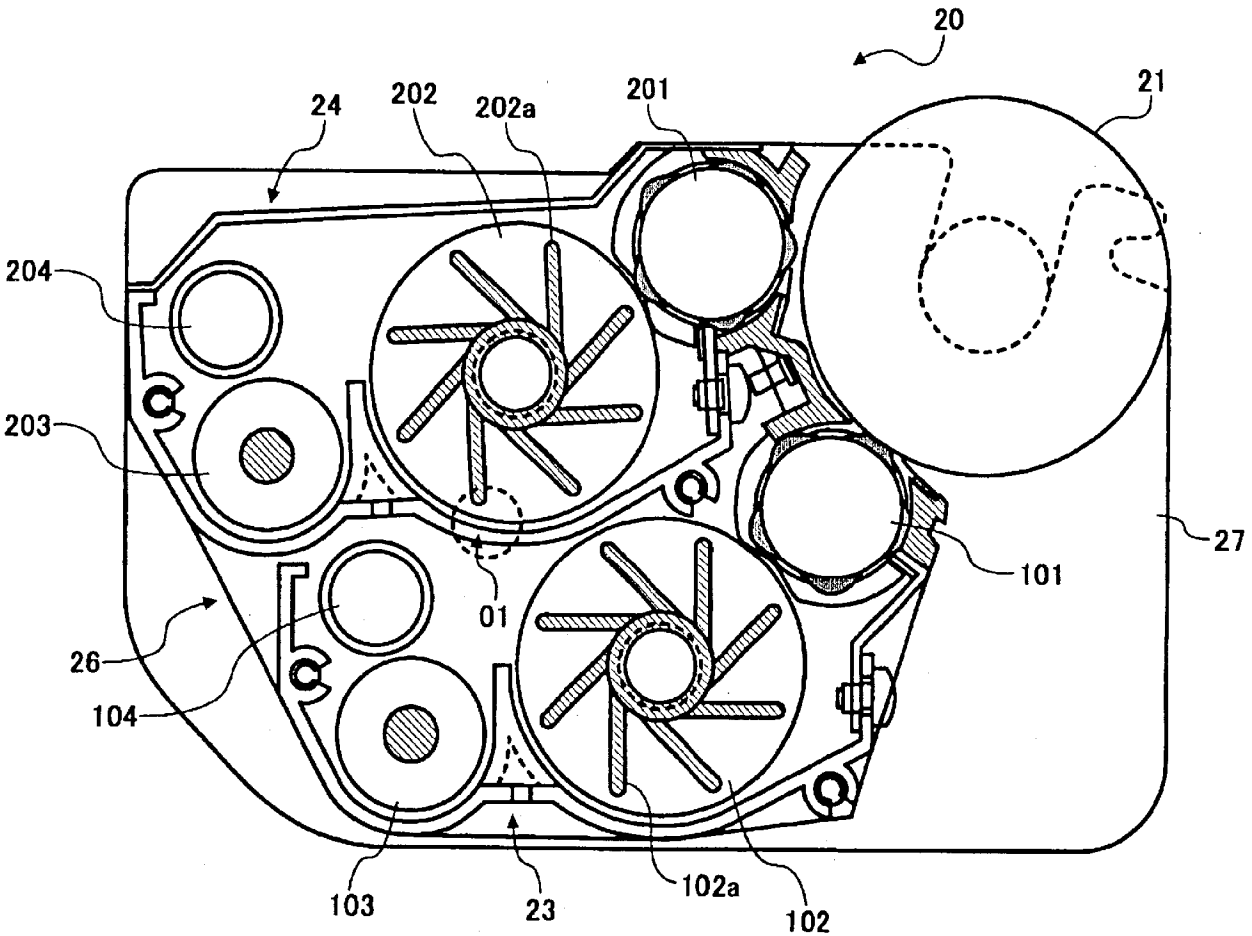
FIG. 3 is a view corresponding to FIG. 2, but as seen from the other side.
Figure 4:
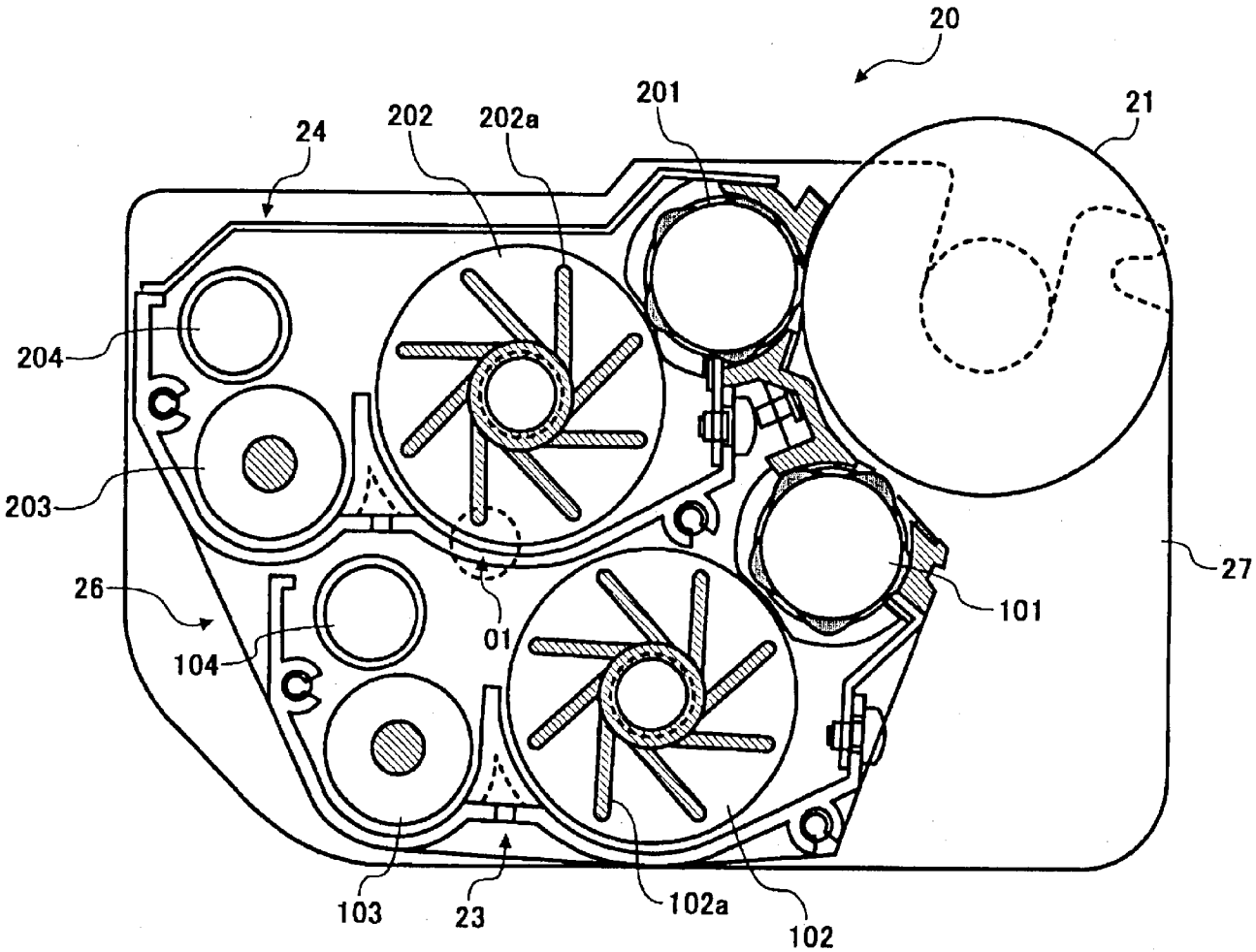
FIG. 4 is an enlarged view showing a condition, as seen from the other side, wherein the other developing roller of the first developing unit contacts the drum.

More specifically, as shown in FIGS. 3 and 4, a first developing unit 26, including the A- and C-color developing devices 23 and 24, is supported by opposite side walls 27 (only one is visible) included in the first image forming unit 20 in such a manner as to be bodily, angularly movable about an axis O1. The developing rollers 202 and 201 are shown as contacting the drum 21 in FIGS. 3 and 4, respectively. The drum 21 is supported by the side walls 27 of the first image forming unit 20 in such a manner as to be rotatable about its own axis.

Likewise, a second developing unit 36, including the D- and B-color developing devices 34 and 33, is supported by opposite side walls 37 (only one is visible) included in the second image forming unit 30 in such a manner as to be bodily, angularly movable about an axis O2, although not shown specifically. The drum 31 is supported by the side walls 37 of the second image forming unit 30 in such a manner as to be rotatable about its own axis.

Figure 5:
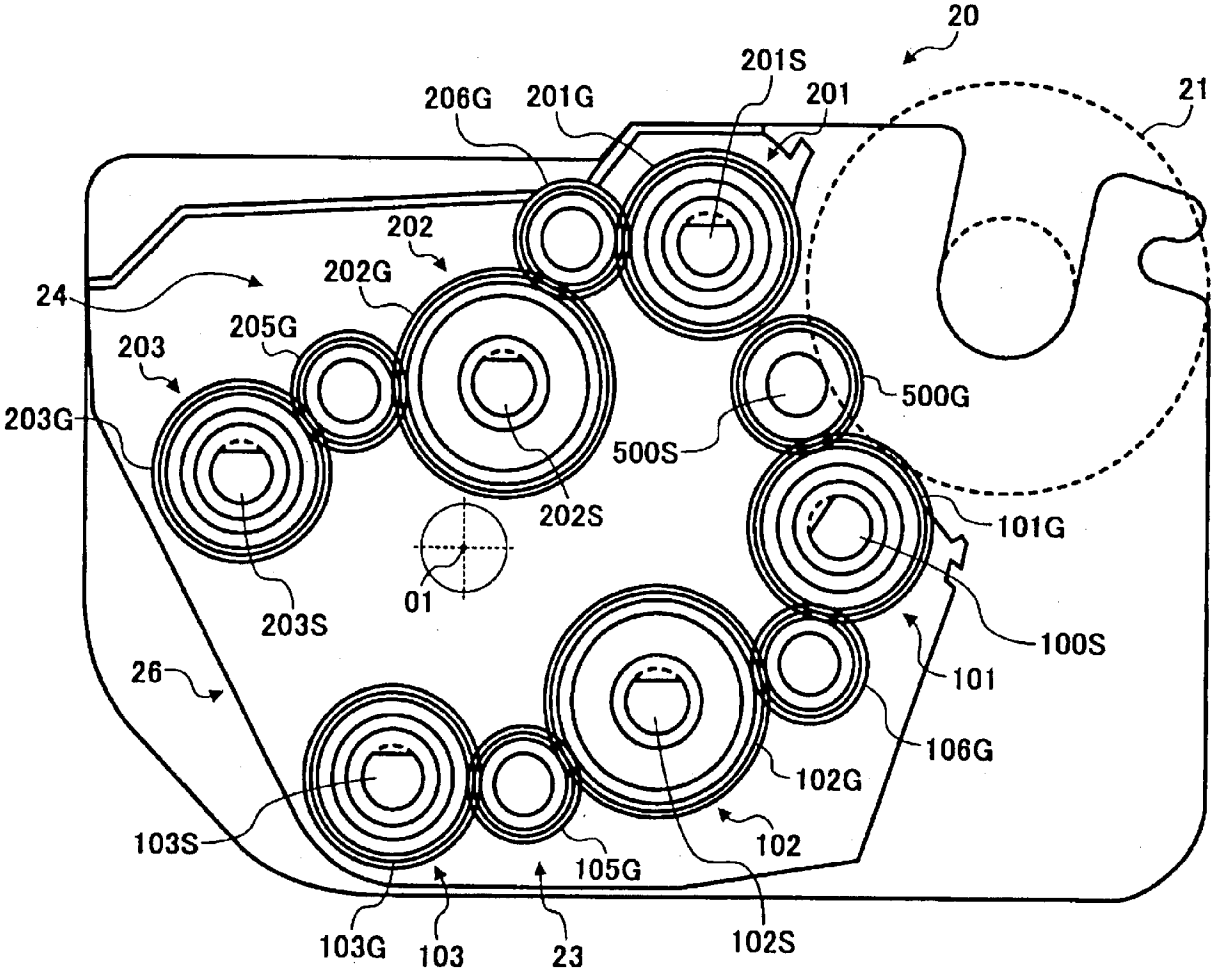
FIG. 5 is an enlarged view showing the condition, as seen from one side, wherein one developing roller of the first developing unit contacts the drum.

In the condition shown in FIG. 3, the developing roller 101, positioned at the upstream side in the direction of rotation of the drum 21, is rotating with a preselected gap formed between it and the drum 21 such that the developer deposited on the roller 101 contacts the drum 21. The other developing roller 201, positioned at the downstream side, is held stationary without the developer deposited thereon contacting the drum 21. At this instant, as shown in FIG. 5, the gear 101G of the A-color developing device 23, contacting the drum 21, is held in mesh with the drive gear 500G and rotated thereby. The developing roller 101, paddle roller 102 and screw conveyor 103 are therefore also rotated. The gear 201G of the B-color developing 23, not contacting the drum 21, is spaced from the drive gear 500G, maintaining the developing roller 201, paddle roller 202 and screw conveyor 203 in a halt.

Figure 6:
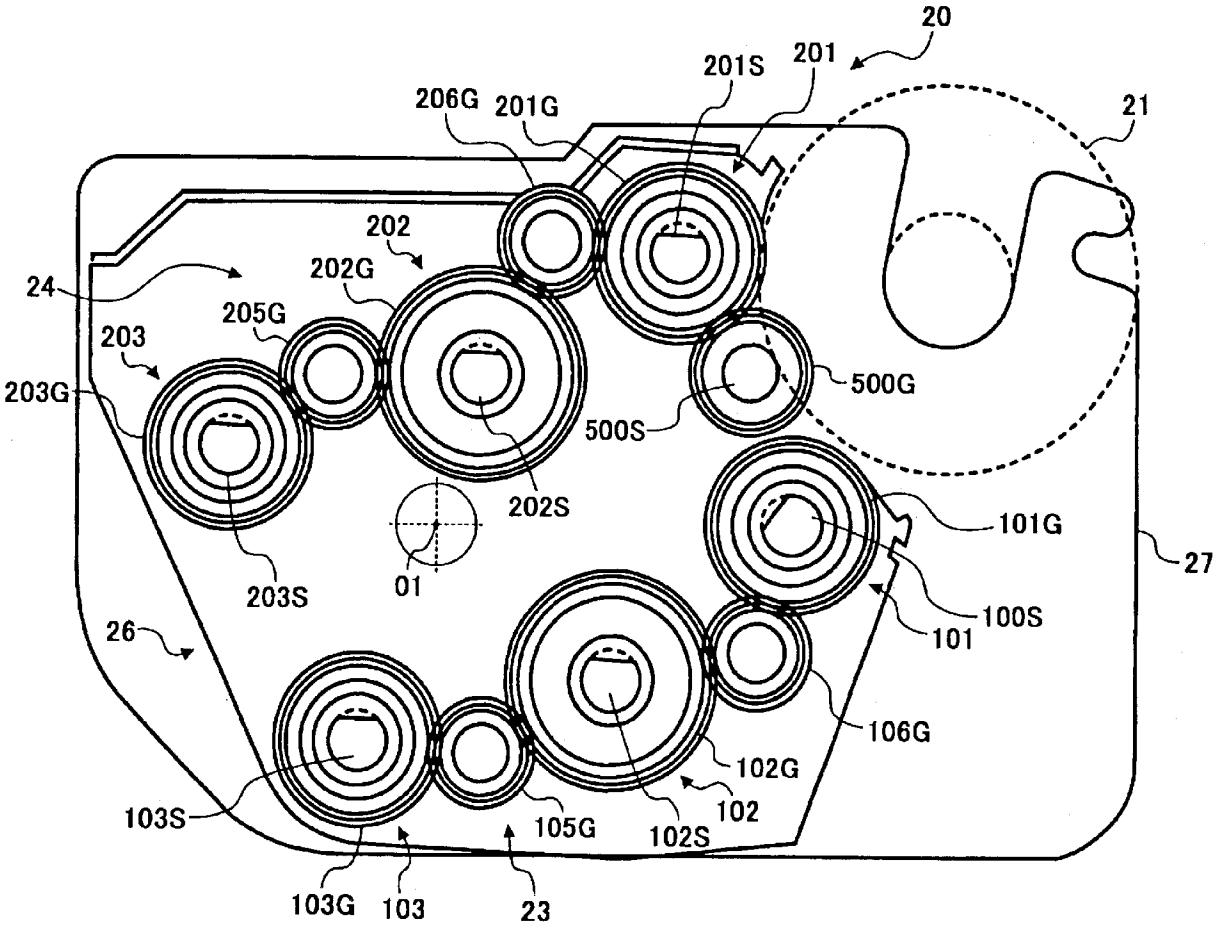
FIG. 6 is an enlarged view showing a condition, as seen from the one side, wherein the other developing roller of the first developing unit contacts the drum.
Figure 7:
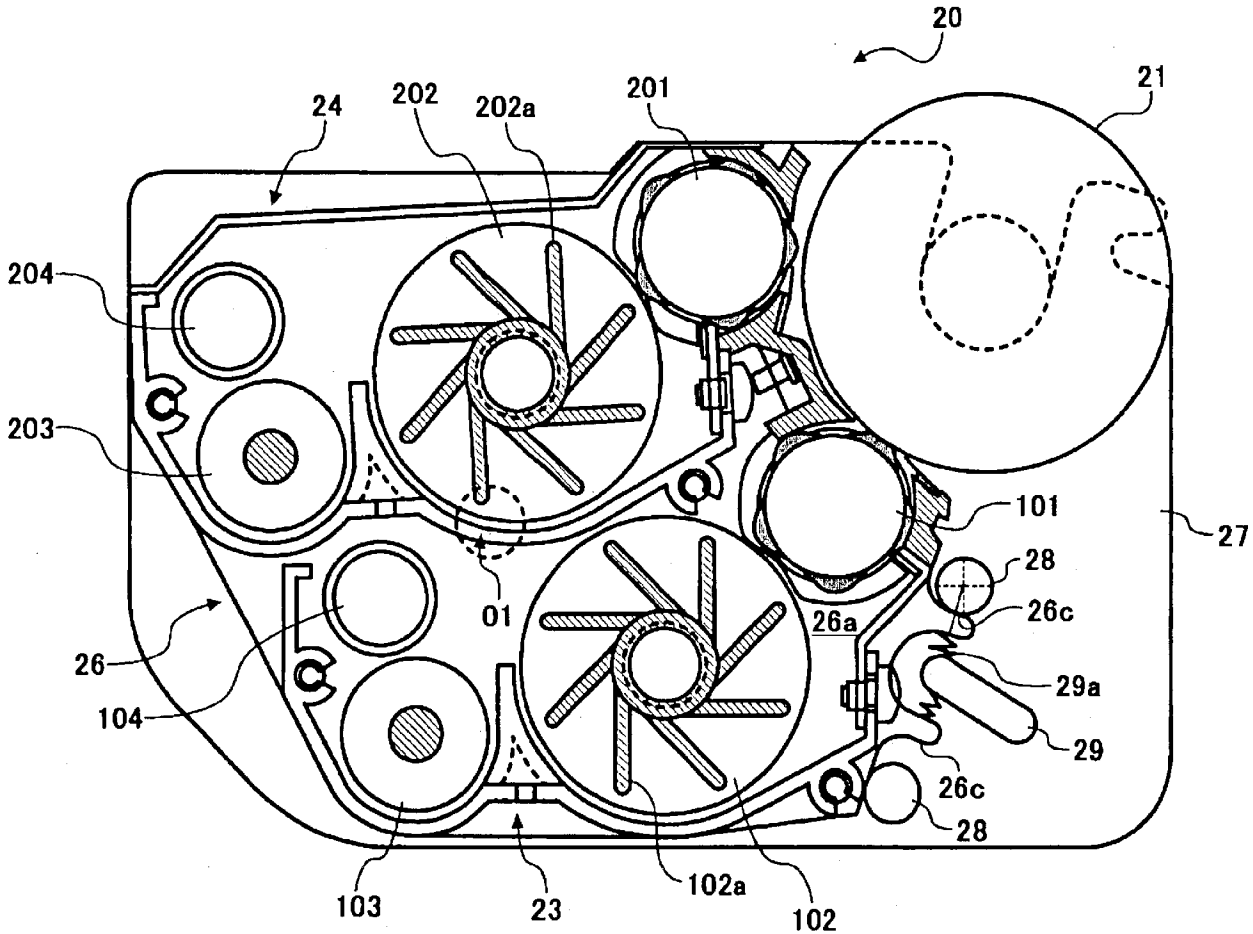
FIG. 7 is an enlarged view, as seen from the other side, showing the condition wherein one developing roller of the first developing unit contacts the drum.
Figure 8:
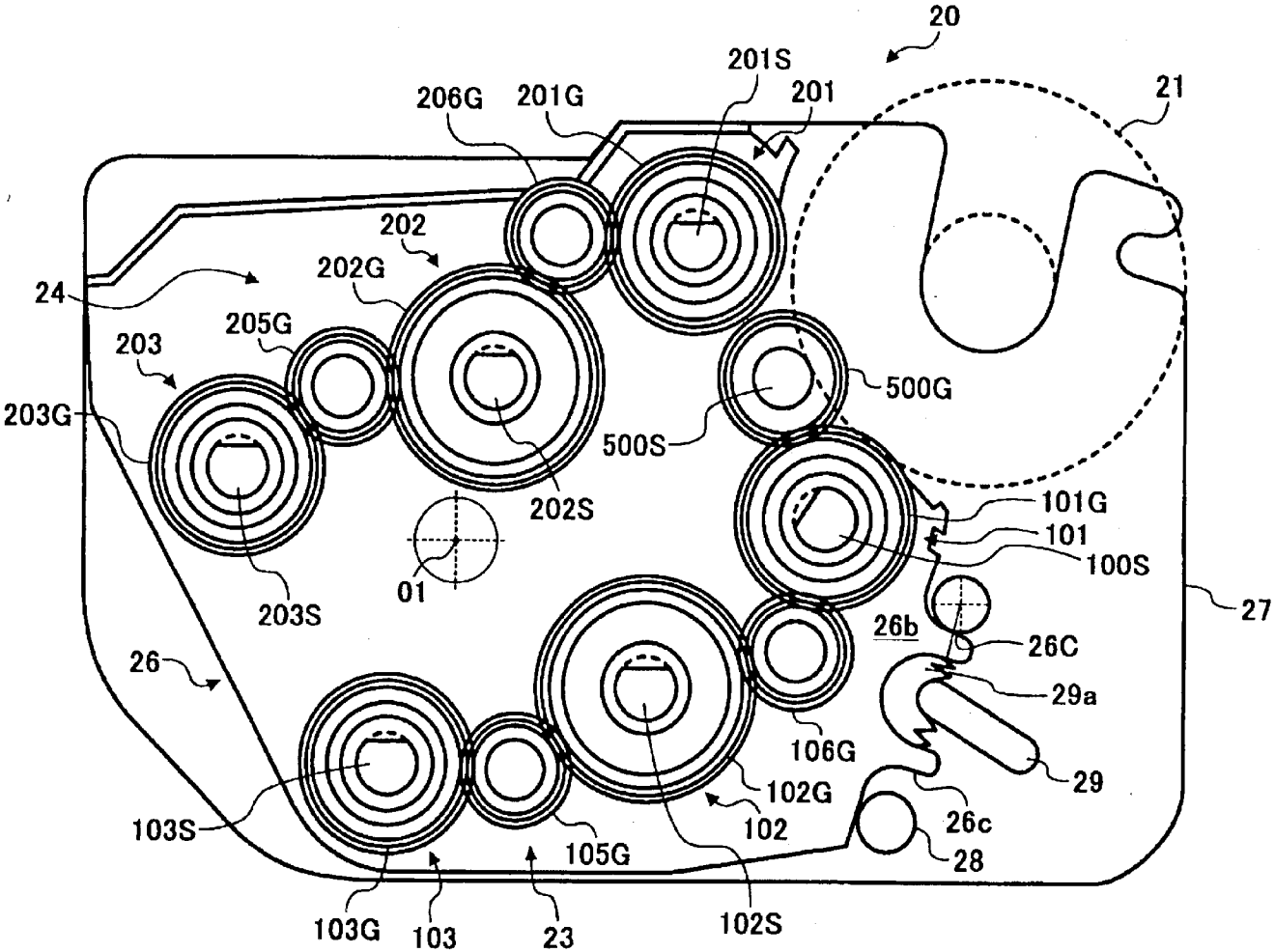
FIG. 8 is an enlarged view, as seen from the one side, showing the condition wherein one developing roller of the first developing unit contacts the drum.
Figure 9:
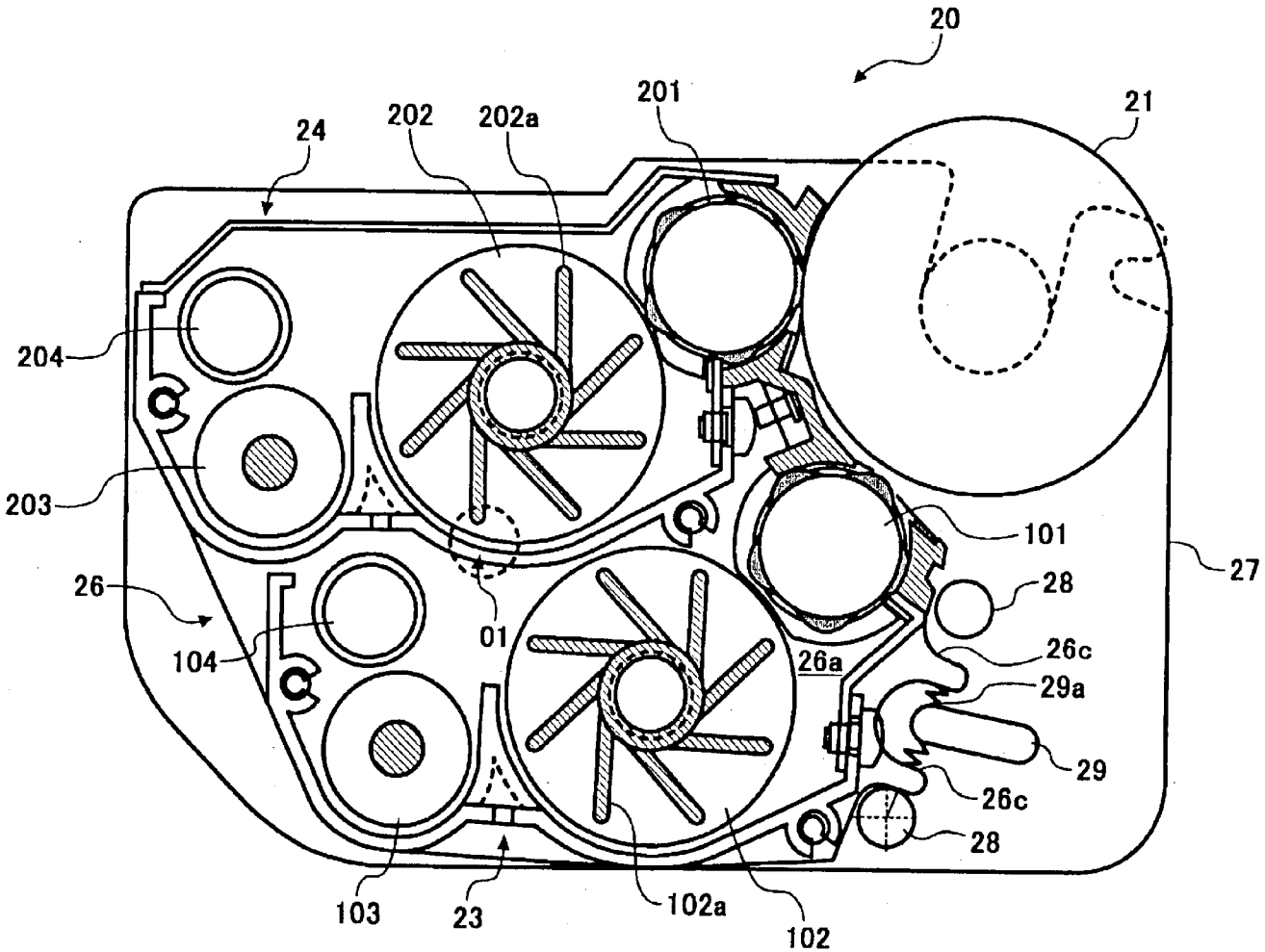
FIG. 9 is an enlarged view, as seen from the other side, showing the condition wherein the other developing roller of the first developing unit contacts the drum.
Figure 10:
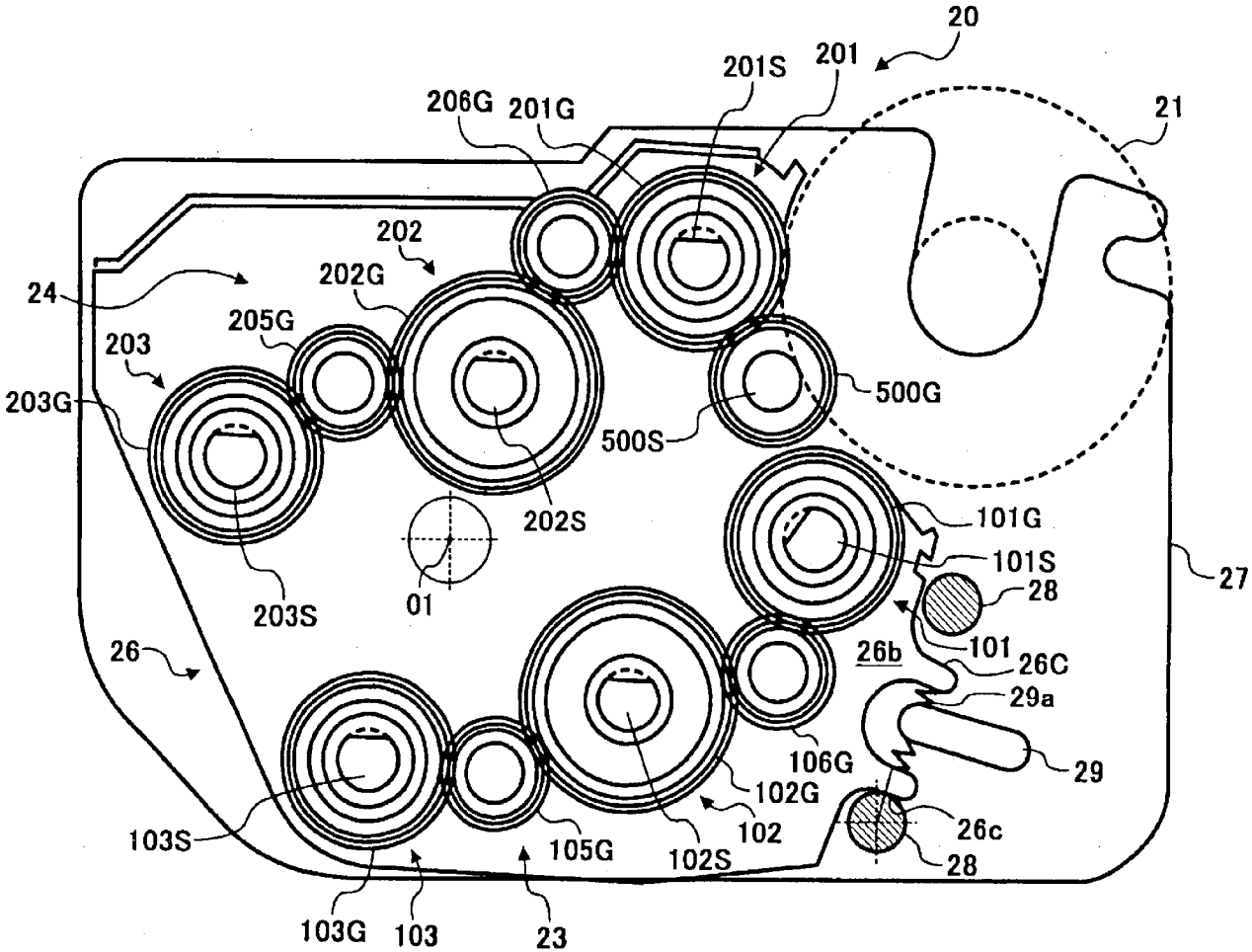
FIG. 10 is an enlarged view, as seen from the one side, showing the condition wherein the other developing roller of the first developing unit contacts the drum.

Assume that the first developing unit 26 is angularly moved clockwise about the axis O1 from the position shown in FIG. 5 in order to replace the developing roller 101 with the developing roller 201. Then, the developing roller 102, positioned at the downstream side, is caused to rotate with a preselected gap formed between it and the drum 21 such that the developer deposited on the roller 201 contacts the drum 21. The other developing roller 101, positioned at the upstream side, is held stationary without the developer deposited thereon contacting the drum 21. At this instant, as shown in FIG. 6, the gear 201G of the C-color developing device 24, contacting the drum 21, is held in mesh with the drive gear 500G and rotated thereby. The developing roller 201, paddle roller 202 and screw conveyor 203 are therefore also rotated. The gear 101G of the A-color developing 23, not contacting the drum 21, is spaced from the drive gear 500G, maintaining the developing roller 101, paddle roller 102 and screw conveyor 103 in a halt.

The second image forming unit 30 is constructed in the same manner as the first image forming unit although not shown or described specifically.

Referring again to FIG. 1, the sheet feeding unit 50 includes a sheet cassette 51 loaded with a stack of sheets or recording media 52. A pickup roller 53 pays out the top sheet 52 from the sheet cassette 51 toward the registration roller pair 54. The registration roller pair 54 once stops the sheet 52 and then conveys it to the image transferring section 60 at preselected timing.

The image transferring section 60, implemented by a corona discharger or a charge roller by way of example, transfers a color toner image formed on the belt 11 to the sheet 52 conveyed from the registration roller pair 54. The sheet, carrying the color toner image thereon, is then conveyed to the fixing section 70.

The fixing section 70 includes a rotatable heat roller 71, a press roller 72 rotatable in pressing contact with the heat roller 71, and a coating roller 73 held in contact with the heat roller 71 for coating an anti-offset liquid on the heat roller 71. The fixing section 70 fixes the color toner image formed on the sheet 52 with heat and pressure while conveying the sheet 52 toward the outlet roller pair 80. The sheet or print 52 is then driven out of the apparatus body 2 onto the print tray 82 face down.

The exhaust fan 81 discharges air inside the apparatus body 2 in order to protect electric parts positioned below the print tray 82 from the heat of the fixing section 70.

The operation of the illustrative embodiment will be described hereinafter. The sheet 52 paid out from the sheet cassette 51 by the pickup roller 53 is conveyed to the image transferring section 60 via the registration roller pair 54, as stated earlier.

In the first image forming unit 20, the charger 22 and first writing section 41 form a latent image to be developed by the A-color developing device 23 on the drum 21. The A-color developing device 23 develops the latent image with magenta toner to thereby form a magenta toner image (M toner image hereinafter) The M toner image thus formed on the drum 21 is transferred to the belt 11 by the first brush 14.

The belt 11, moving in the direction indicated by the arrow, conveys the M toner image toward the second image forming unit 30. At this instant, the charger 32 and second writing section 42 form a latent image to be developed by the B-color developing device 33 on the drum 31. The B-color developing device 33 develops the latent image with yellow toner to thereby produce a yellow toner image (Y toner image hereinafter). The Y toner image thus formed on the drum 31 is transferred from the drum 31 to the belt 11 in register with the M toner image present on the belt 11. The resulting composite toner image will be referred to as a YM toner image.

Before the belt 11 in movement conveys the YM toner image to the first image forming unit 20, the charger 22 and first writing section 41 form a latent image to be developed by the C-color developing device 24 on the drum 21. The C-developing device 24 develops the latent image with cyan toner to thereby produce a cyan toner image (C toner image hereinafter). The C toner image thus formed on the drum 21 is transferred to the belt 11 by the first brush 14 in register with the MY toner image. Let the resulting composite toner image be referred to as a YMC toner image hereinafter.

Before the belt 11 in movement conveys the YMC toner image to the second image forming unit 30, the charger 32 and second writing section 42 form a latent image to be developed by the D-color developing device 34 on the drum 31. The D-color developing device 34 develops the latent image with black toner to thereby produce a black toner image (BK toner image hereinafter). The BK toner image thus formed on the drum 31 is transferred to the belt 11 by the second brush 15 in register with the MYC toner image, completing a full-color toner image.

At the image transferring section, the full-color toner image is transferred from the belt 11 to the sheet 52. The sheet 52 has the full-color toner image fixed by the fixing section 70 and then driven out to the print tray 82 by the outlet roller pair 80, as stated earlier. After the transfer of the full-color toner image, the cleaning section 16 removes toner left on the belt 11.

In a repeat print mode, when the Y toner image is transferred from the second image forming unit 30 to the belt 11 over the M toner image, the first image forming unit 20 transfers the next M toner image to the belt 11. This is followed by the procedure described above.

During the operation described above, the first and second developing units 26 and 36 are selectively angularly moved about the axes O1 and O2, respectively, as described with reference to FIGS. 3 through 6.

To further enhance image quality, it is necessary to maintain the gaps for development between the developing rollers 101, 201, 301 and 401 and the drums 21 and 31 highly accurate. Assume that the first and second developing units 26 and 36, respectively including the developing rollers 101 and 201 and the developing rollers 301 and 401, are rigid bodies. Then, the developing rollers 101 and 201 and drum 21 and the developing rollers 301 and 401 and drum 31 are expected to remain parallel to each other at any point in the direction of the axes O1 and O2 without regard to the angular position of the developing units 26 and 36.

In practice, however, because the developing units 26 and 36 have some elasticity each, forces, tending to enlarge the gaps between the developing rollers 101, 201, 301 and 401 and the drums 21 and 31, act on the rollers during development due to the resistance of the developers present at the above gaps. As a result, torque acts around the axes O1 and O2. Further, the drive force of the drive gear, acting on the gears of the developing rollers, include torque around the axes O1 and O2 due to the influence of pressure angle. It follows that if the angular positions of the developing units 26 and 36 each are determined at one point in the direction of the axis O1 or O2, then it is difficult to maintain parallelism between the developing rollers 101 and 201 and the drum 21 or between the developing rollers 301 and 401 and the drum 31.

In light of the above, the illustrative embodiment further includes unique arrangements to be described with reference to FIGS. 7 through 10 hereinafter. FIGS. 7 through 10 show arrangements relating to the first developing unit 26 byway of example. As shown, side walls 26*a* and 26*b*, included in the first developing unit 26 and positioned at opposite ends in the direction of the axis O1, each are formed with two contact surfaces 26*c* for determining the angular position of the first developing unit 26. Also, limiting members or angular position determining means 28 protrude from the opposite side walls 27 of the first image forming unit 27, which support the drum 21. The stop members 28 limit the rotation of the first developing unit 26 when contacting the contact surfaces 26*c*. In this configuration, when the first developing unit 26 is angularly biased, the rotation limiting forces of the limiting members 28 act on the side walls 26*a* and 26*b* facing each other in the direction of the axis O1.

The side walls 26*a* and 26*b* support two developing rollers 101 and 201 and include the contact surfaces 26*c* as well as roller support portions supporting the rollers 101 and 201. An actuator 29 is connected to the first developing unit 26 via a spring or similar elastic member 29*a*. The actuator 29, playing the role of drive means included in the switching means, changes the direction of the biasing force acting on the side walls 26*a* and 26*b*.

With the arrangements stated above, it is possible to maintain the developing rollers 101 and 201 and drum 21 parallel to each other despite the resistance of the developer and the drive forces of the developing rollers 101 and 201. This is also true with the developing rollers 301 and 401 and drum 31 included in the second image forming unit 30, although not shown or described specifically in order to avoid redundancy.

The torque around the axes O1 and O2 make it difficult to maintain the gaps for development accurate, as stated earlier. Further, if the axes O1 and O2 each are remote from the center of gravity of the first or the second image forming unit 26 or 36, then torque constantly acts around the axes O1 or O2 due to gravity. This torque tends to enlarge the gap as to the upstream developing roller 101 or 401 or to decrease it as to the downstream developing roller 201 or 301, also making it difficult to maintain the gap accurate during development.

In light of the above, in the illustrative embodiment, the axes O1 and O2 each are coincident with the center of gravity of the first or the second image forming unit 26 or 36, respectively. It is therefore possible to maintain the gaps for development accurate during development and therefore to insure high image quality. Further, because the drive force for causing the first or the second developing unit 26 or 36 to angularly move can be reduced, the drive mechanism for moving the developing unit 26 or 36 can be reduced in size and cost while saving power.

Second Embodiment

Figure 11:
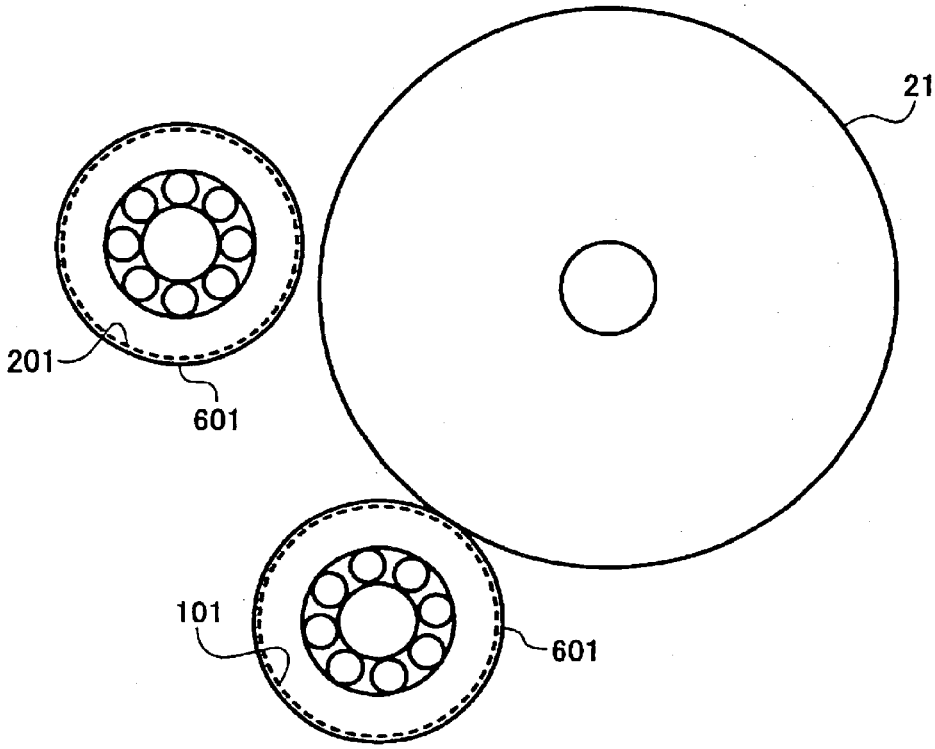
FIG. 11 is an enlarged view showing a second embodiment of the present invention in which a roller member is mounted on each developing roller of the first developing unit coaxially with the developing roller.
Figure 12:
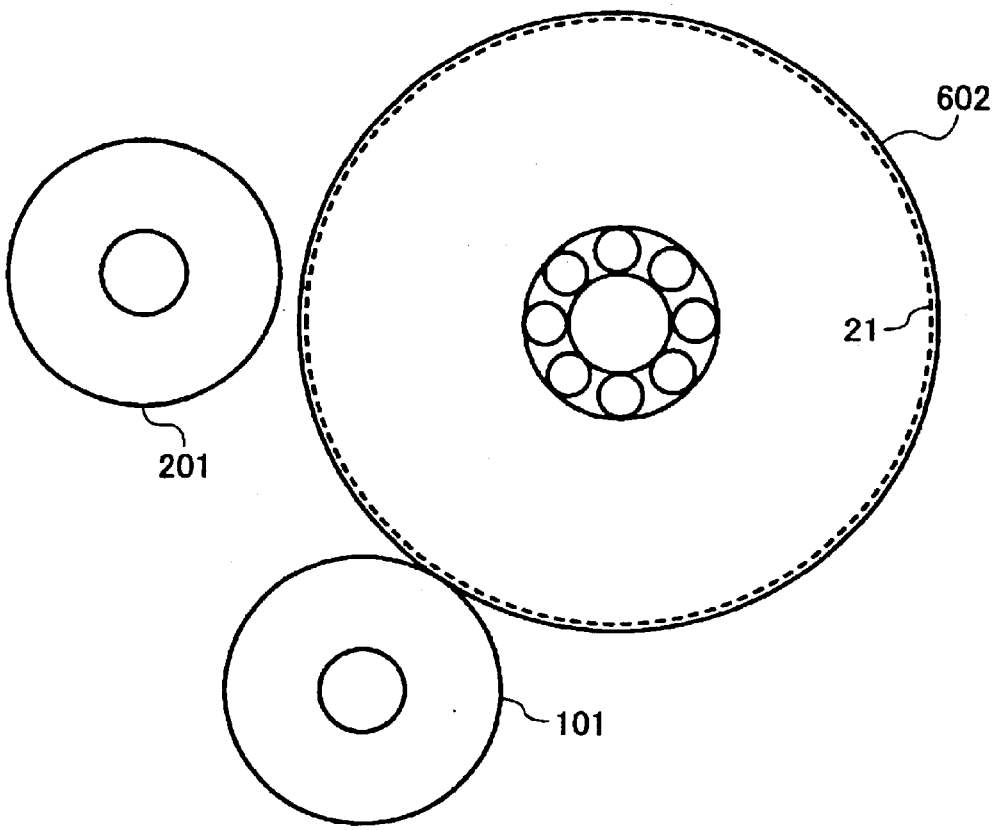
FIG. 12 is an enlarged view showing a roller member mounted on the drum coaxially therewith.
Figure 13:
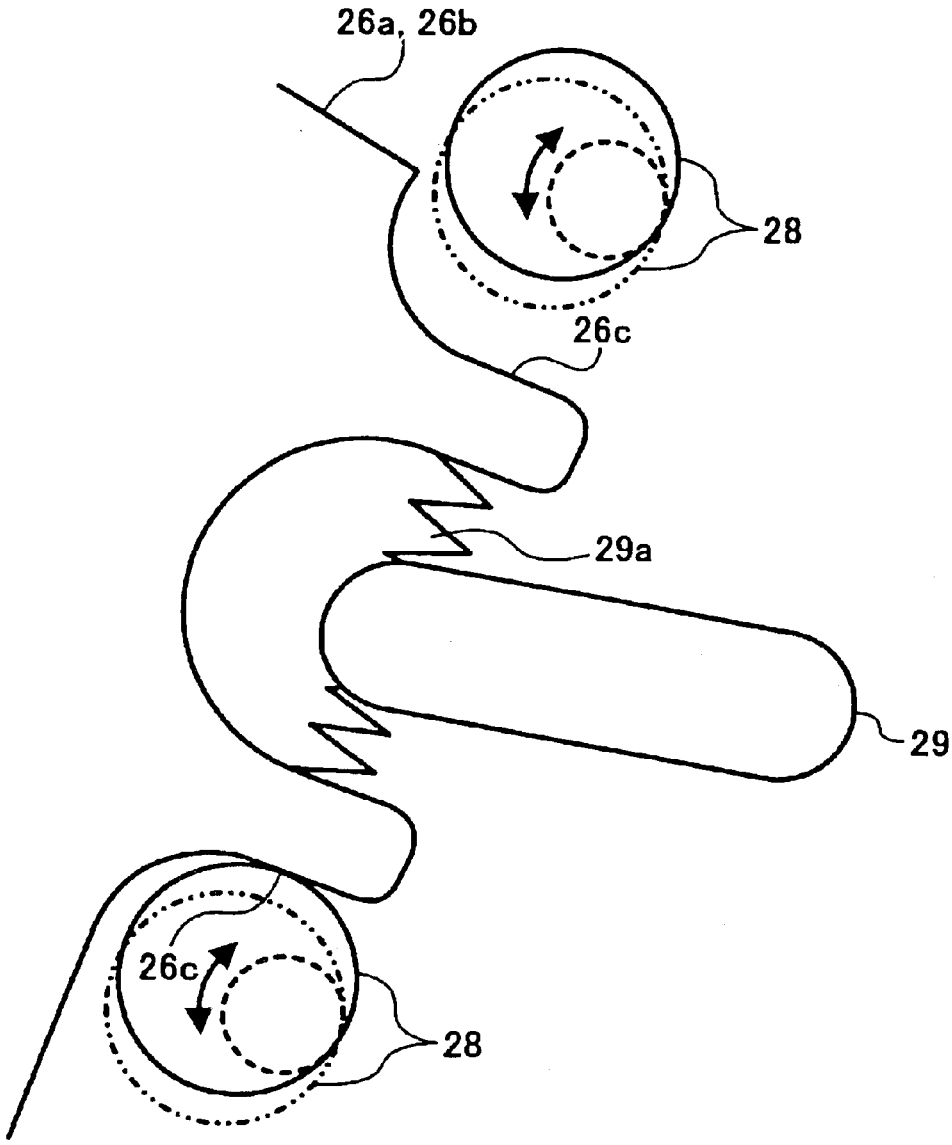
FIG. 13 is a fragmentary enlarged view showing part of the side wall of the first developing unit provided with an adjusting mechanism for varying the angular position of the developing unit.

Reference will be made to FIGS. 11 through 13 for describing a second embodiment of the present invention also applied to the image forming apparatus 1 shown in FIG. 1. In the second embodiment, parts and elements identical with those of the first embodiment are designated by identical reference numerals and will not be described specifically in order to avoid redundancy. This embodiment differs from the previous embodiment in that the limiting members or angular position determining means for limiting the angular positions of the developing units 26 and 36 are positioned coaxially with the developing rollers 101, 201, 301 and 401 or coaxially with the drums 21 and 31.

In the previous embodiment, the limiting member 28 is formed on each of opposite side walls 27 of the image forming unit while the contact surfaces are included in each of the side walls 26*a* and 26*b* of the developing unit. This, however, increases the number of parts intervening between the developing rollers 101 and 201 and the drum 21 or between the developing rollers 301 and 401 and the drum 31. Consequently, when initial parallelism between the developing rollers 101 and 201 and the drum 21 or between the developing rollers 301 and 401 and the drum 31 relies only on the precision of parts during assembly, the individual parts must be extremely accurately machined, resulting in an increase in cost.

As shown in FIG. 11 pertaining to the first developing unit 26, i.e., the first image forming unit 20 by way of example, the contact surfaces are implemented by roller members or angular position determining means 601 rotatably supported coaxially with the developing rollers 101 and 201, respectively. The circumference of the drum 21, selectively contacting the circumferences of the roller members 601, plays the role of the limiting member. In this configuration, the angular position of the first developing unit 26 is determined.

The configuration shown in FIG. 11 is applied to the second developing unit 36 as well.

The illustrative embodiment described above successfully reduces the number of parts intervening between the developing rollers 101 and 201 and the drum 21 while insuring accurate parallelism between the rollers 101 and 201 and the drum 21 for thereby enhancing image quality.

Alternatively, as shown in FIG. 12 also pertaining to the first developing unit 26, the limiting member may be implemented as a roller member 602 coaxially, rotatably mounted on the drum 21. In this case, the circumferences of the developing rollers 101 and 201 or contact members are selectively caused to contact the roller member 602. This configuration is applied to the second developing unit 36 as well. This alternative configuration also reduces the number of parts intervening between the developing rollers 101 and 201 and the drum 21 while insuring parallelism between the rollers 101 and 201 and the drum 21. Further, while the roller members 601 and 602, FIG. 11, need high accuracy and high durability and are therefore high cost, the configuration of FIG. 12 can omit the roller members 602 for thereby saving cost.

Moreover, as shown in FIG. 13 also pertaining to the first image forming unit 20, an adjusting mechanism may be used for adjusting the limiting members 28 such that the angular position determined by the contact of each limiting member 28 with the associated contact surface 26*c* is variable. Such an adjusting mechanism realizes accurate parallelism between the developing rollers 101 and 201 and the drum 21 or between the developing rollers 301 and 401 and the drum 31 without resorting to expensive roller members. The arrangement shown in FIG. 13 is similarly applicable to the previous embodiment.

Third Embodiment

Referring to FIGS. 14 through 25, a third embodiment of the present invention and also applied to the image forming apparatus 1, FIG. 1, will be described. In the third embodiment, parts and elements identical with those of the first embodiment are designated by identical reference numerals and will not be described specifically in order to avoid redundancy. As shown in FIGS. 14 through 17 pertaining to the first developing unit 26 by way of example, the side walls 26*a* and 26*b* of the developing unit 26 each are formed with two cam contact surfaces 611*a* and 611*b*. An eccentric cam 612 is affixed to a cam shaft 614 rotatable about an axis parallel to the axis O1 of the developing unit 26.

When the developing unit 26 is angularly moved to the position where one of the developing rollers 101 and 201 performs development, the eccentric cam 612 contacts one cam contact surface 611*a* of the side wall 26 or 26*b*. When the developing unit 26 is angularly moved to the position where the other of the developing rollers 101 and 102 performs development, the cam 612 contacts the other cam surface 611*b* of the sidewall 26*a* or 26*b*. In this manner, the eccentric cam 612 determines the angular position of the developing unit 26. The rotation of the cam shaft 613 is transferred to the side wall 26*a* or 26*b* via the cam contact surface 611*a* or 611*b*. Such an eccentric cam 612, cam shafts 613 and cam contact surfaces 611*a* and 611*b* constitute the switching means in combination.

Figure 14:
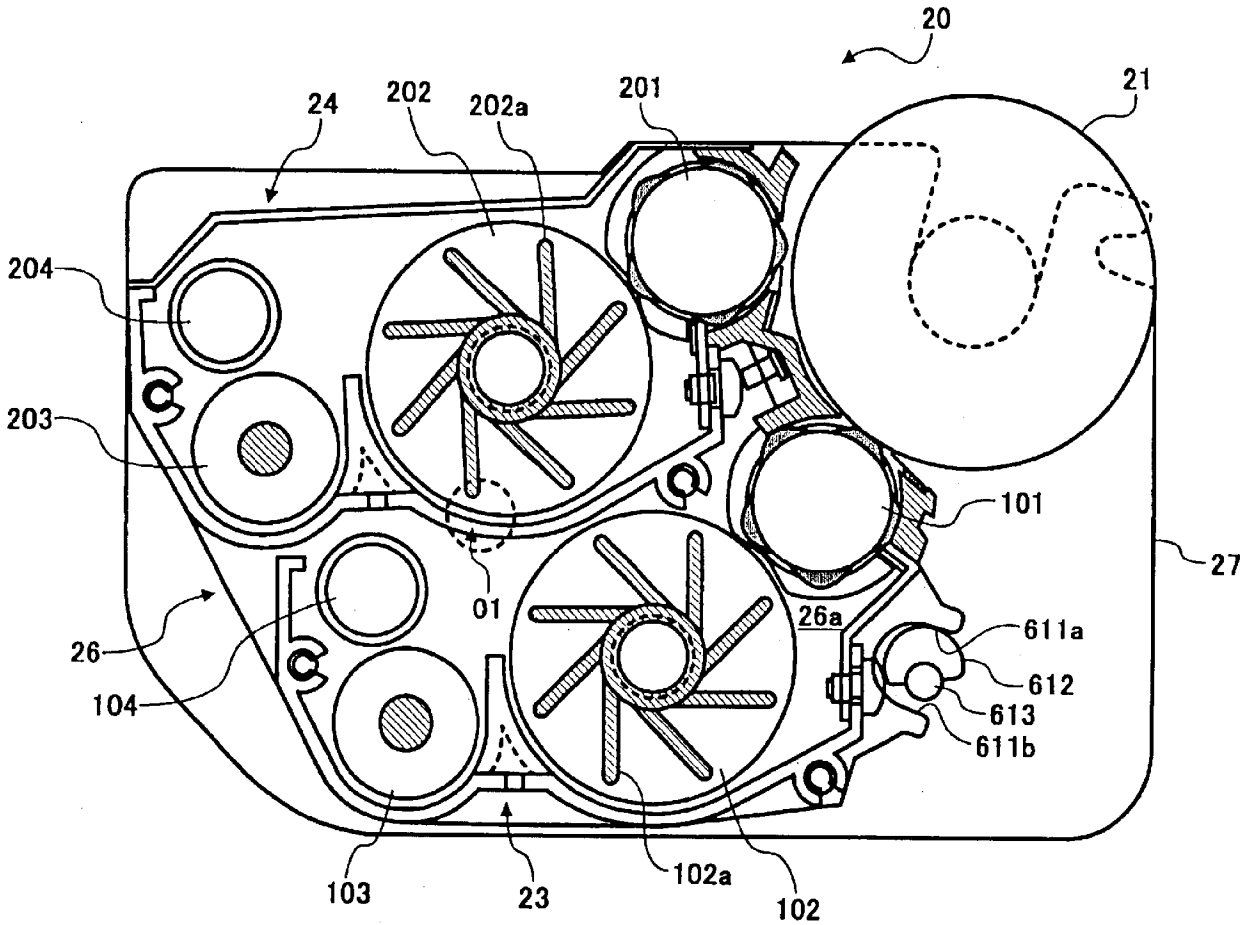
FIG. 14 is an enlarged view, as seen from the other side, a third embodiment of the present invention in a condition wherein one developing roller of the first developing unit contacts the drum.
Figure 15:
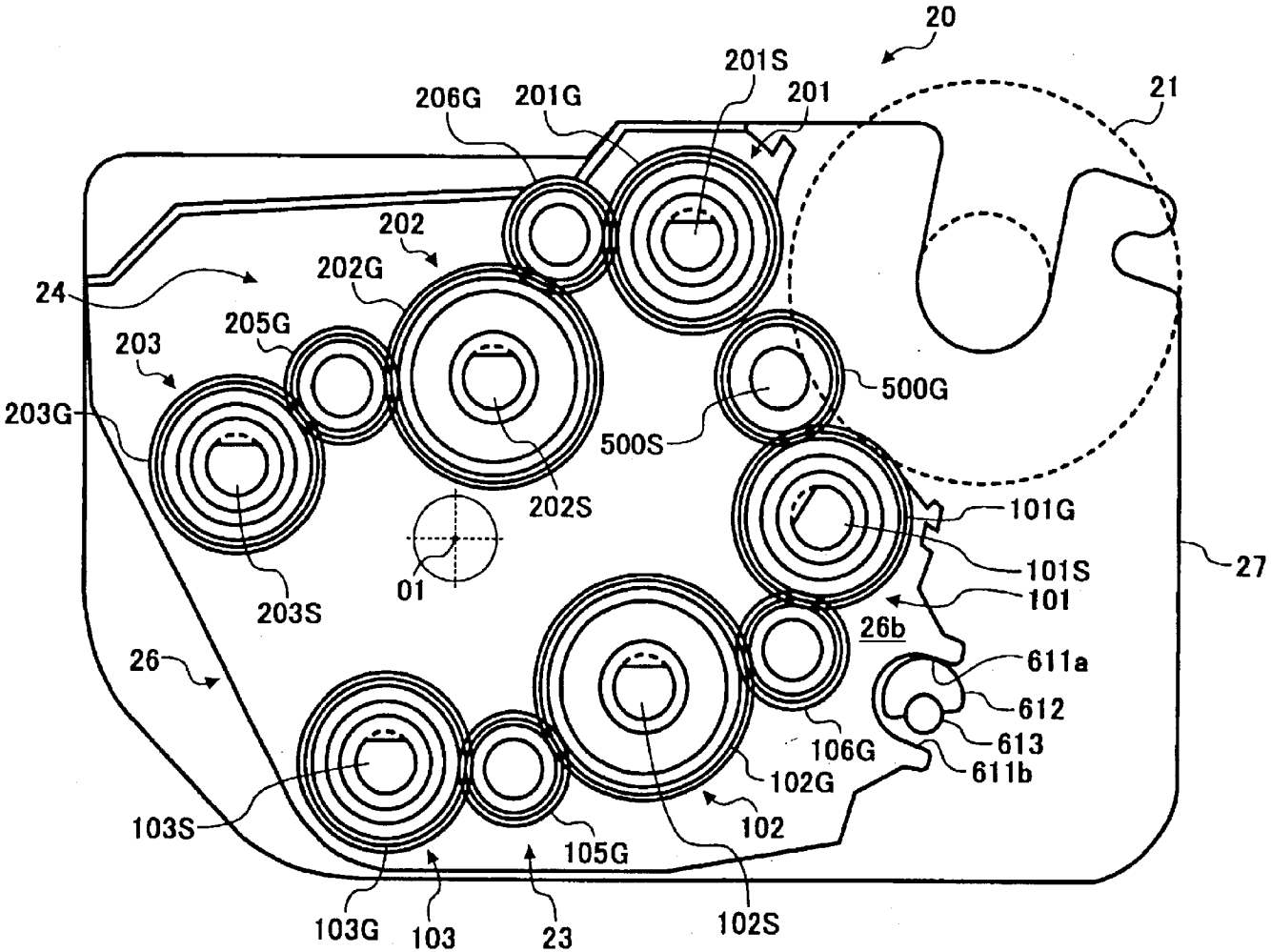
FIG. 15 is an enlarged view, as seen from the one side, showing one developing roller of the first development unit contacting the drum.
Figure 16:
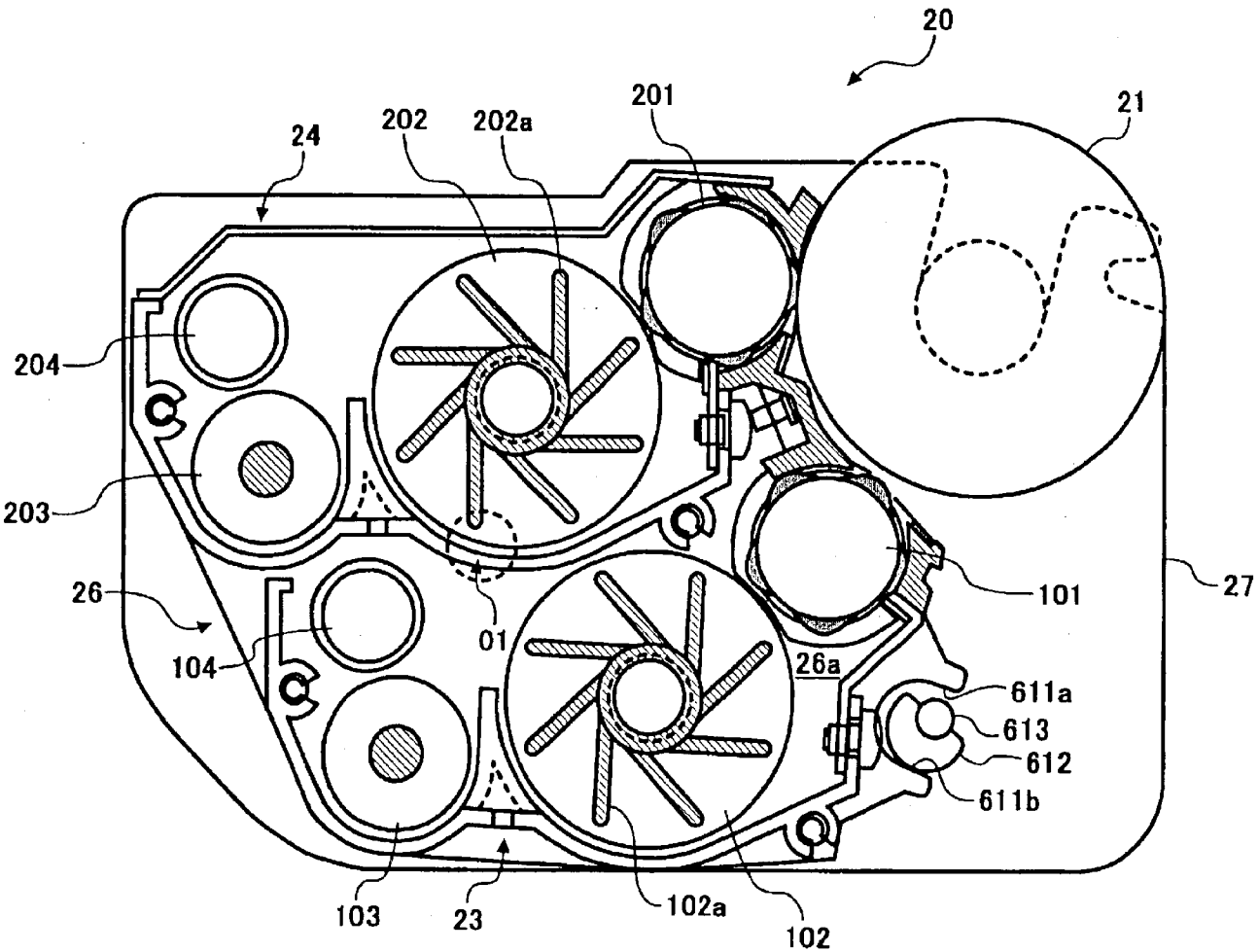
FIG. 16 is an enlarged view, as seen from the other side, showing the other developing roller of the first development unit contacting the drum.
Figure 17:
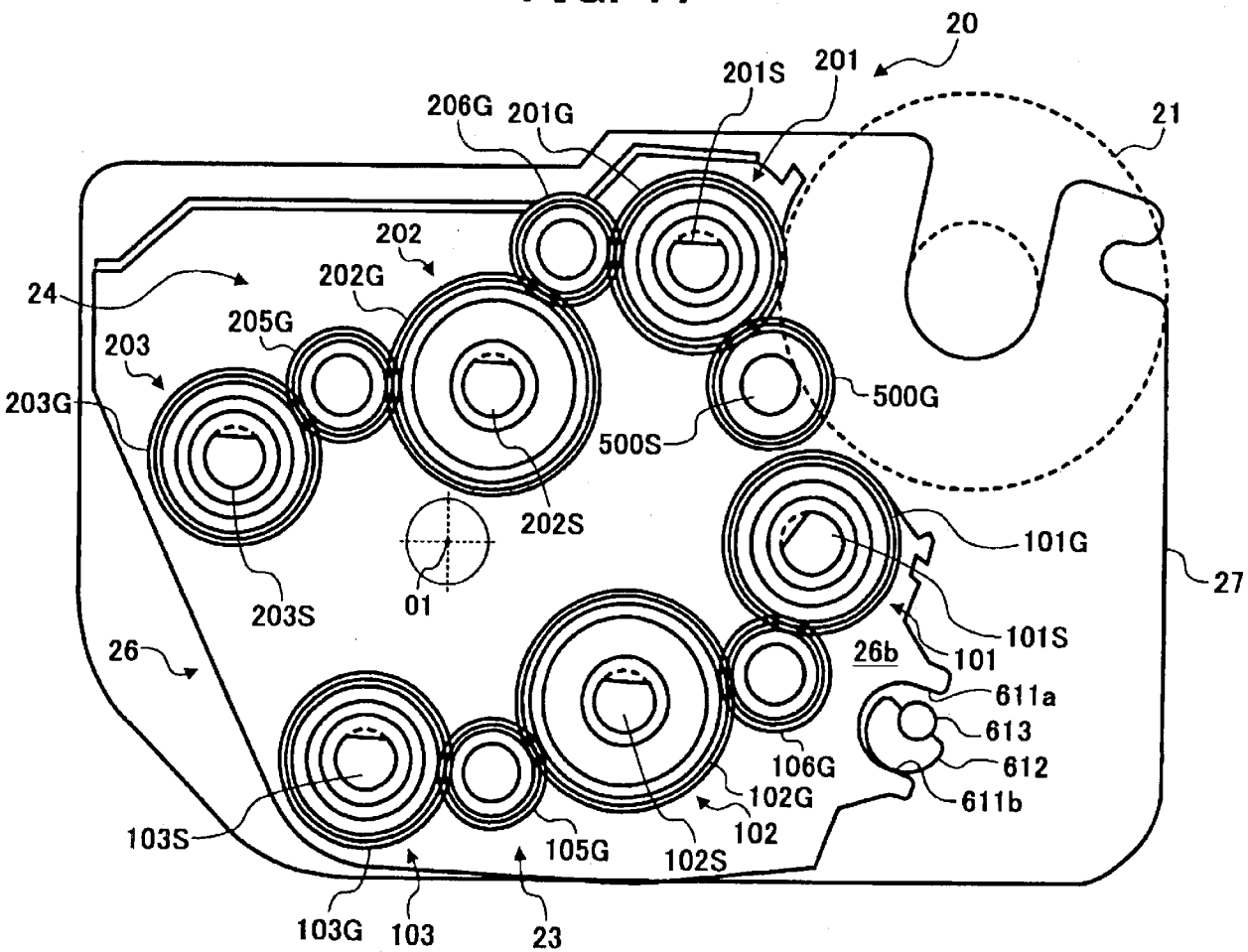
FIG. 17 is an enlarged view, as seen from the one side, showing the other developing roller of the first development unit contacting the drum.

The configuration shown in FIG. 14 is applied to the second developing unit 36 as well.

As stated above, in the illustrative embodiment, the angular movement of the developing unit 26 or 36 and the limitation of the angular movement are attained at the same time, realizing size and cost reduction.

Further, to insure initial parallelism between the developing rollers 101 and 201 and the drum 21 or the developing rollers 301 and 401 and the drum 31 during assembly at the preselected positions, the illustrative embodiment includes arrangements to be described with reference to FIGS. 18 through 21 hereinafter.

Figure 18:
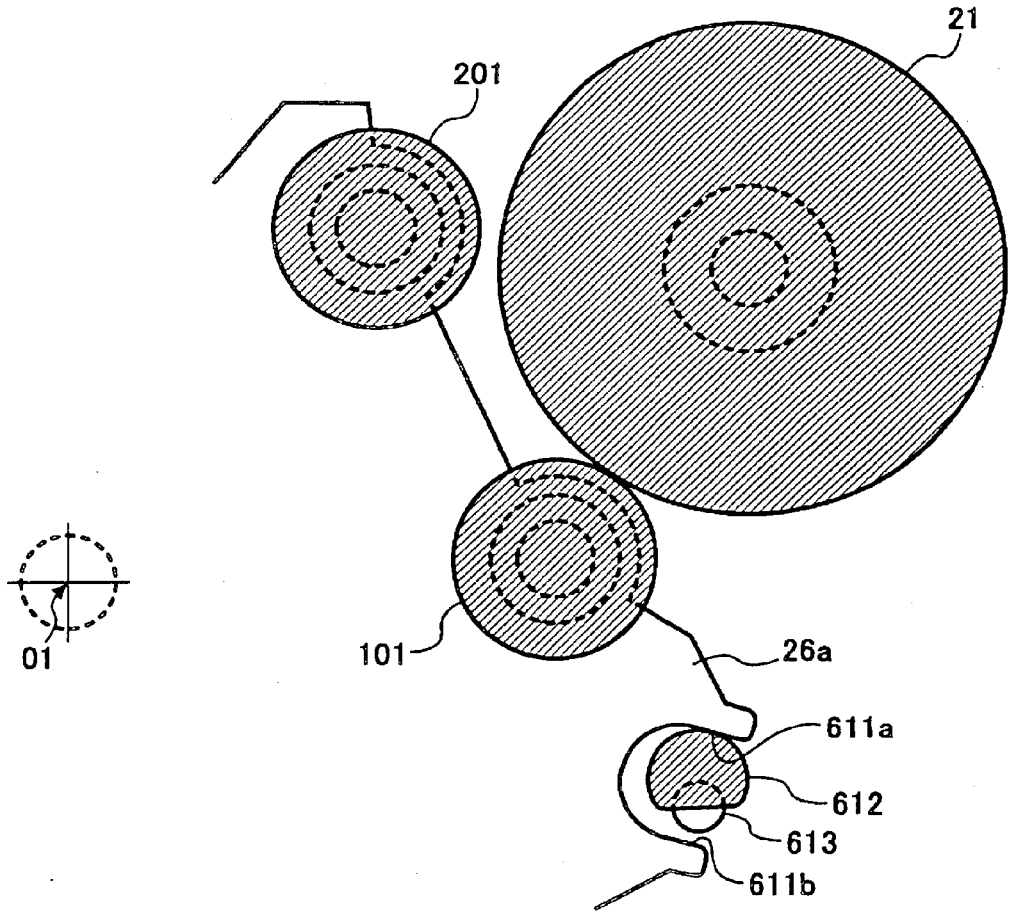
FIG. 18 is a fragmentary enlarged view, as seen from the other side, one developing roller of the first developing unit contacting the drum.
Figure 19:
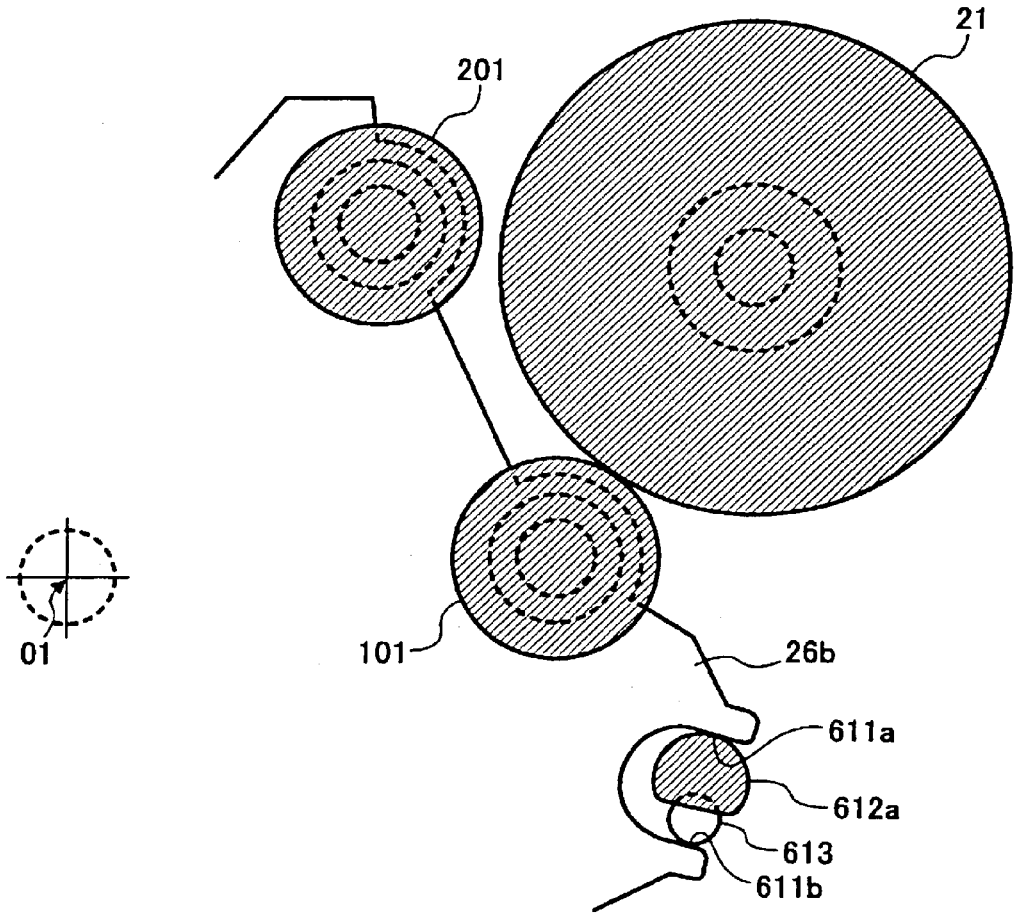
FIG. 19 is a fragmentary enlarged view, as seen from the one side, one developing roller of the first developing unit contacting the drum.

As shown in FIGS. 18 through 21 also pertaining to the first developing unit 26 by way of example, the eccentric cam 612 is formed integrally with one end of the cam shaft 613. Two eccentric cams 612*a* and 612*b* are mounted on the other end of the cam shaft 613 such that the cams 612*a* and 612*b* each are adjustable in position relative to the cam shaft 613. As shown in FIG. 18, a position where the cam 613 is to stop rotating is selected such that the cam 612 contacts the cam contact surface 611*a* at a position where a preselected gap is formed between the developing roller 101 and the drum 21 at one end of the axis O1. Subsequently, as shown in FIG. 19, the eccentric cam 612*a* is adjusted relative to the cam shaft 613 such that the eccentric cam 612*a* contacts the cam contact surface 611*a* at the cam stop position of FIG. 18, i.e., at the position where the preselected gap is formed between the developing roller 101 and the drum 21 at the other end of the axis O1.

Figure 20:
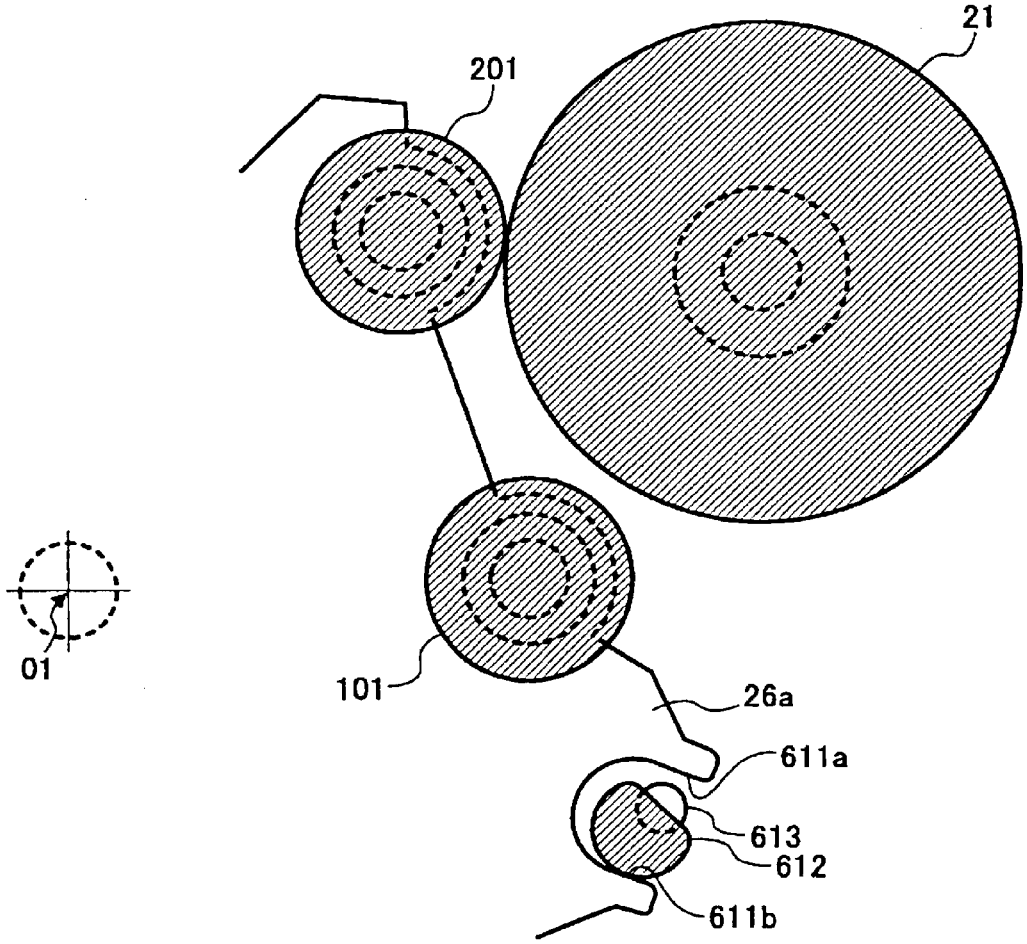
FIG. 20 is a fragmentary enlarged view, as seen from the other side, the other developing roller of the first developing unit contacting the drum.
Figure 21:
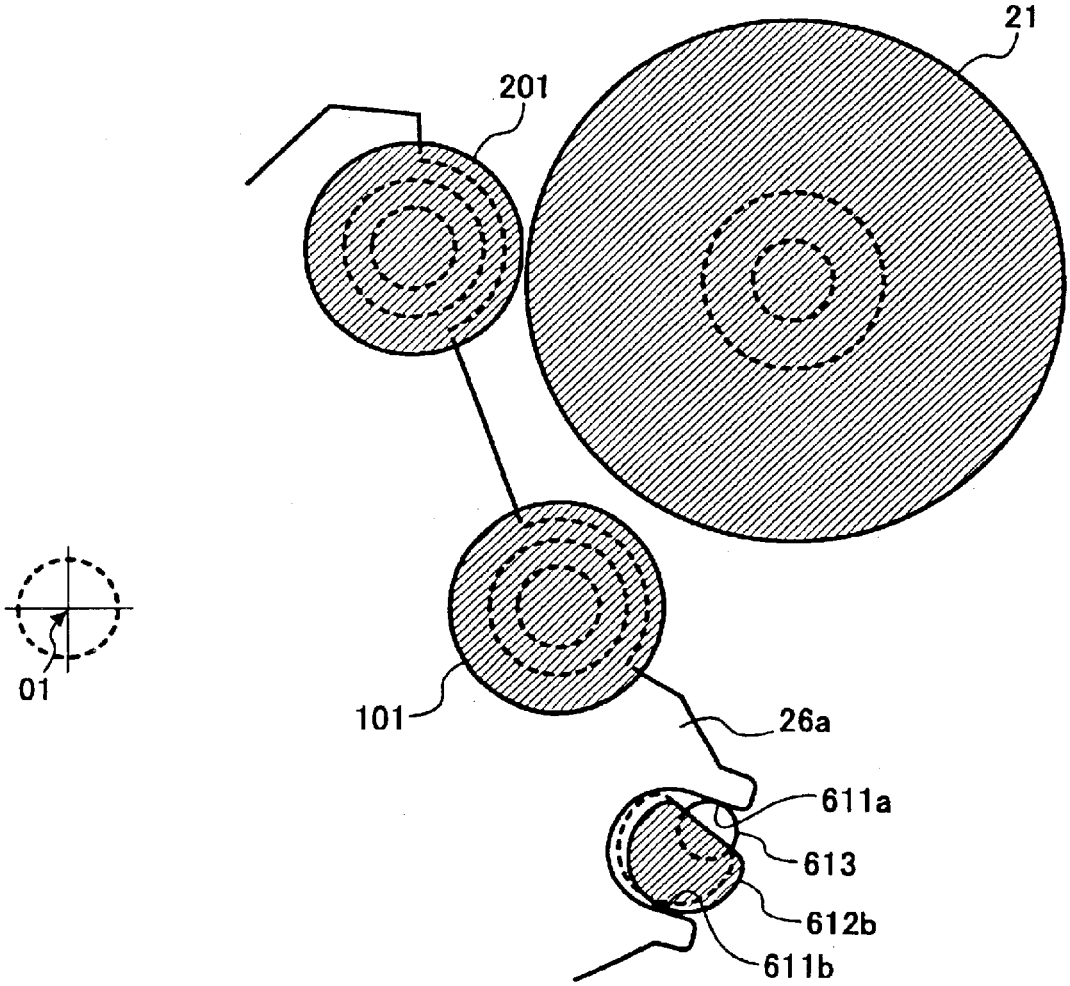
FIG. 21 is a fragmentary enlarged view, as seen from the one side, the other developing roller of the first developing unit contacting the drum.

As shown in FIG. 20, after the adjustment shown in FIG. 19, a position where the cam shaft 613 is to stop rotating is selected such that the eccentric cam 612 contacts the cam contact surface 611*b* at a position where a preselected gap is formed between the developing roller 201 and the drum 21 at one end of the axis O1. Subsequently, as shown in FIG. 21, the eccentric cam 612*b* is adjusted relative to the cam shaft 613 such that the eccentric cam 612*b* contacts the cam contact surface 611*b* at the cam stop position of FIG. 20, i.e., at the position where the preselected gap is formed between the developing roller 201 and the drum 21 at the other end of the axis O1.

Alternatively, one eccentric cam 612 and one adjustable eccentric cam may be mounted on each end of the cam shaft 613. In such a case, an adjusting mechanism will be used for adjusting, at a position where the eccentric cam at one end contacts the cam contact surface at the same end to thereby determine the angular position of the developing unit, a condition wherein the eccentric cam and cam contact surface at the other end contact each other. This readily implements initial parallelism between the developing rollers 101 and 201 and the drum 21.

The configuration described above may be applied to the second developing unit 26 as well.

FIGS. 22 through 25, also pertaining to the first developing unit 26 by way of example, show another specific configuration for implementing initial parallelism between the developing rollers 101 and 201 and the drum 21 at the preselected angular position of the developing unit 26. As shown, the two cam contact surfaces 611*a* and 611*b* are formed integrally with the developing unit 26 at one end of the cam shaft 613. A position adjusting mechanism 620 is mounted on the other end of the cam shaft 613 such that two cam surfaces 620*a* and 620*b* thereof are adjustable in position relative to the developing unit 26.

Figure 22:
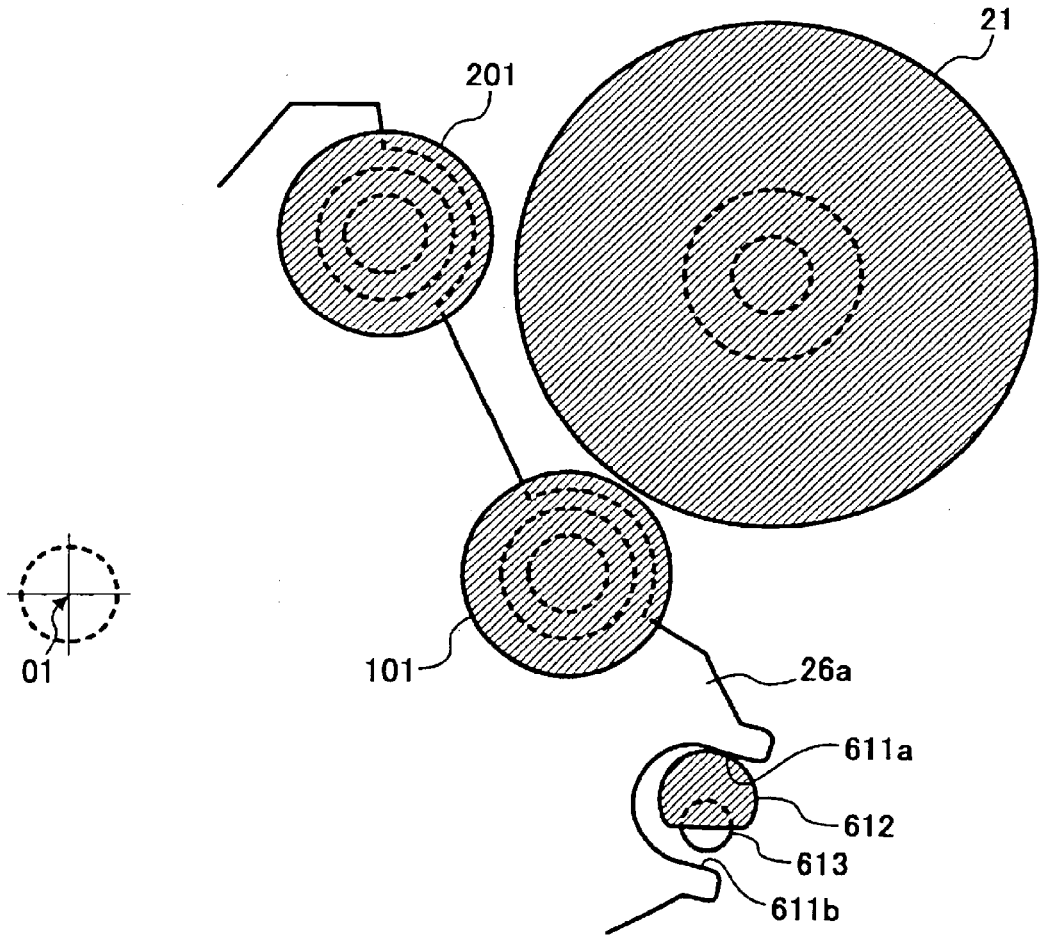
FIG. 22 is a fragmentary enlarged view, as seen from the other side, the operation of an eccentric cam included in the first developing unit.

More specifically, as shown in FIG. 22, a position where the eccentric cam 612 is to stop rotating is selected such that the cam 612 contacts the cam contact surface 611*a* at a position where a preselected gap is formed between the developing roller 101 and the drum 21 at one end of the axis O1. Subsequently, as shown in FIG. 23, the position of the cam contact surface 620*a* relative to the developing unit 26 is adjusted such that the eccentric cam 612 contacts the cam contact surface 620*a* at the cam stop position of FIG. 22, i.e., at the position where the preselected gap is formed between the developing roller 101 and the drum 21 at the other end of the axis O1.

Figure 23:
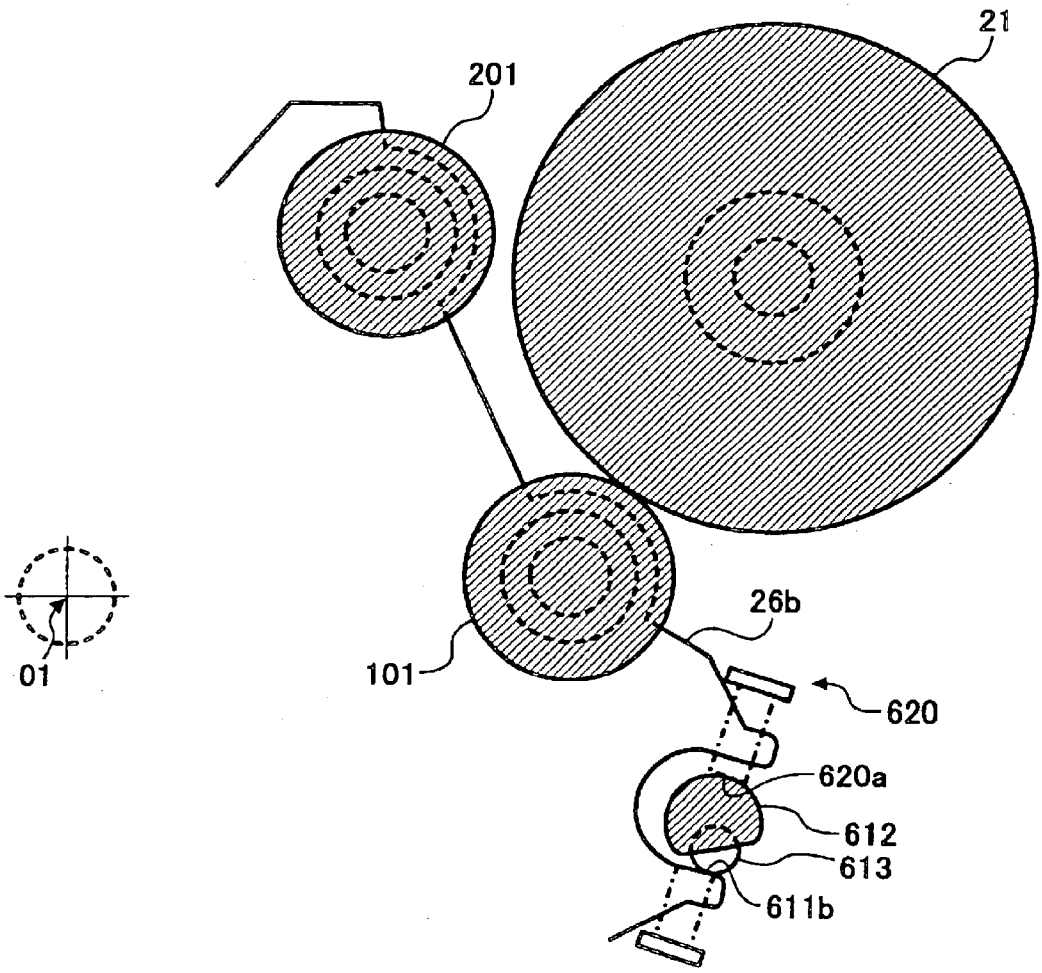
FIG. 23 is a fragmentary enlarged view showing the first developing unit including an adjusting mechanism for adjusting a cam contact surface relative to the eccentric cam.
Figure 24:
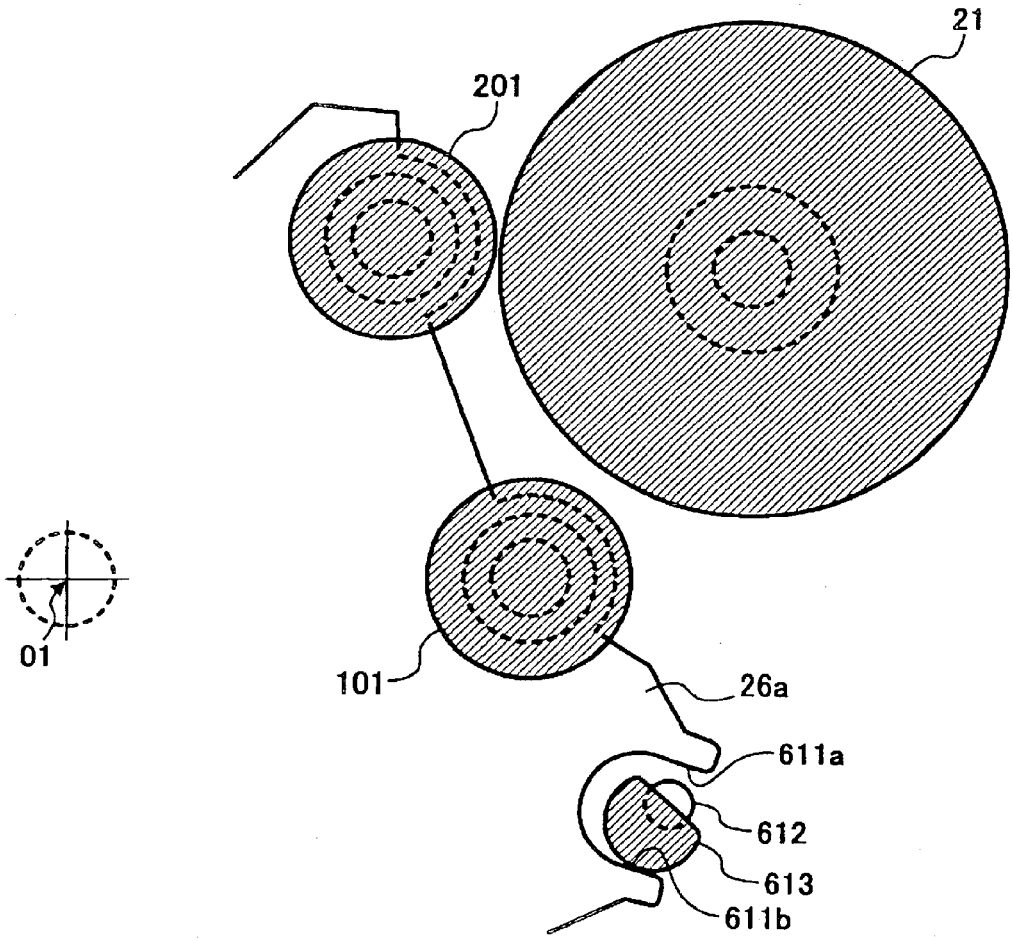
FIG. 24 is a fragmentary enlarged view, as seen from the other side, the operation of the eccentric.
Figure 25:
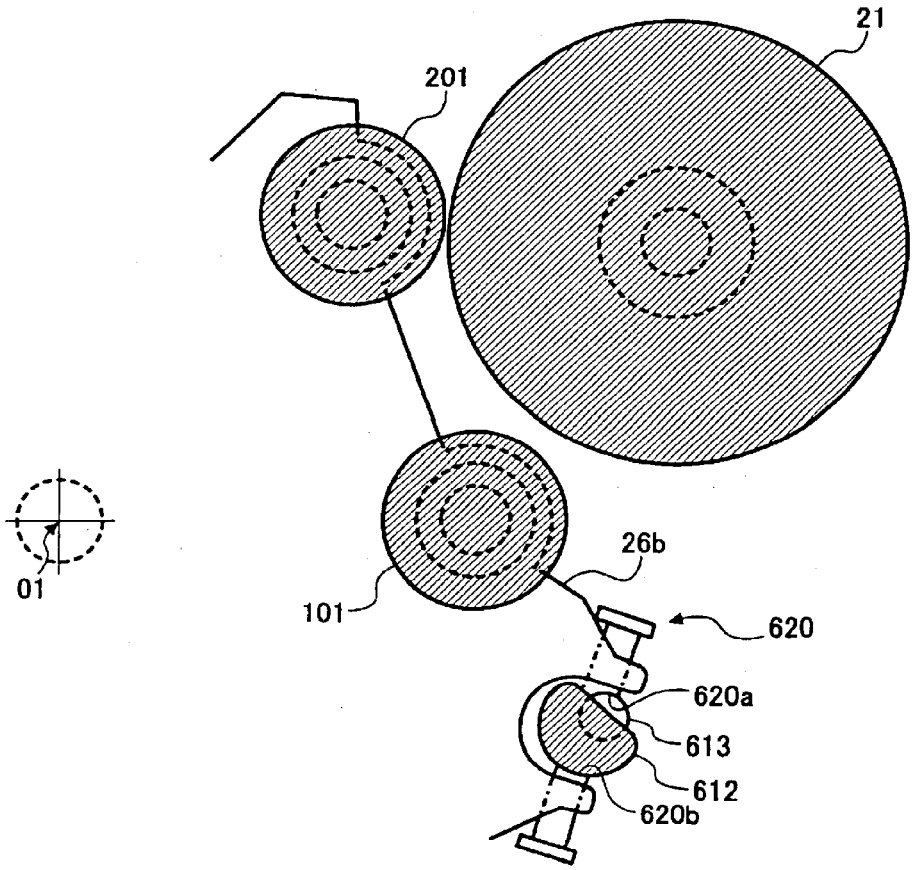
FIG. 25 is a fragmentary enlarged view showing the first developing unit including an adjusting mechanism for adjusting the cam contact surface relative to the eccentric cam.
Figure 26:
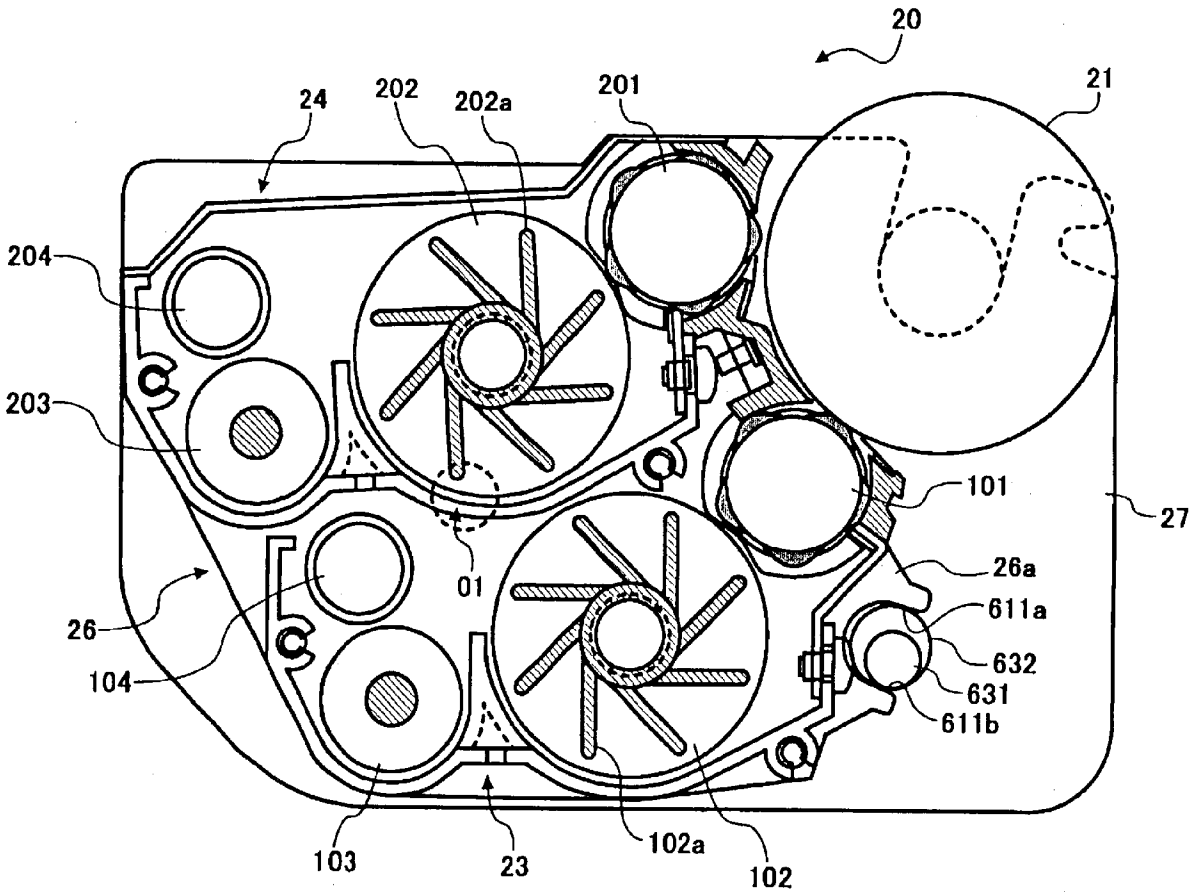
FIG. 26 is an enlarged view, as seen from the other side, showing a fourth embodiment of the present invention.
Figure 27:
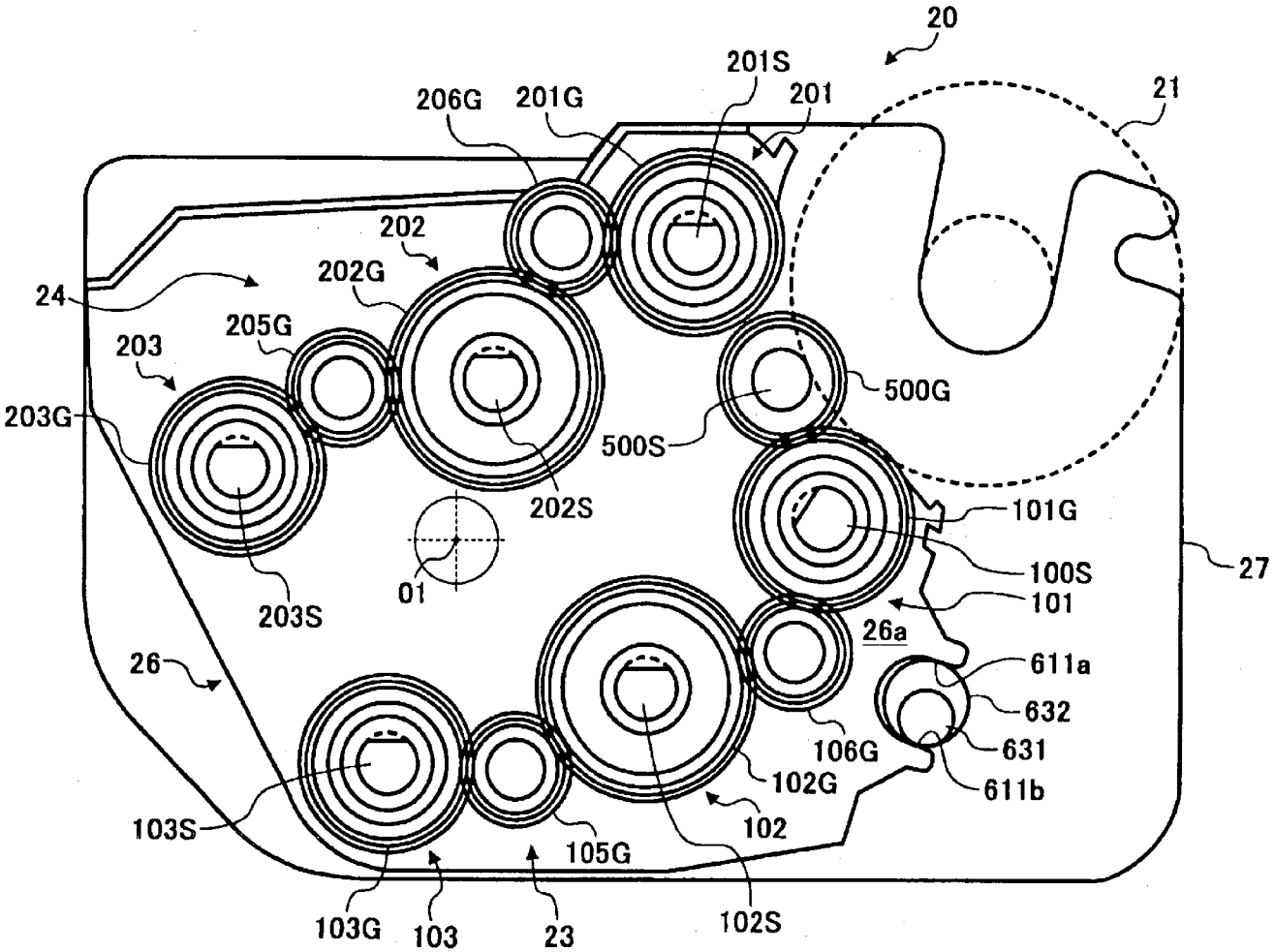
FIG. 27 is an enlarged view, as seen from one side, showing one developing roller of the first developing unit included in the fourth embodiment and contacting the drum.
Figure 28:
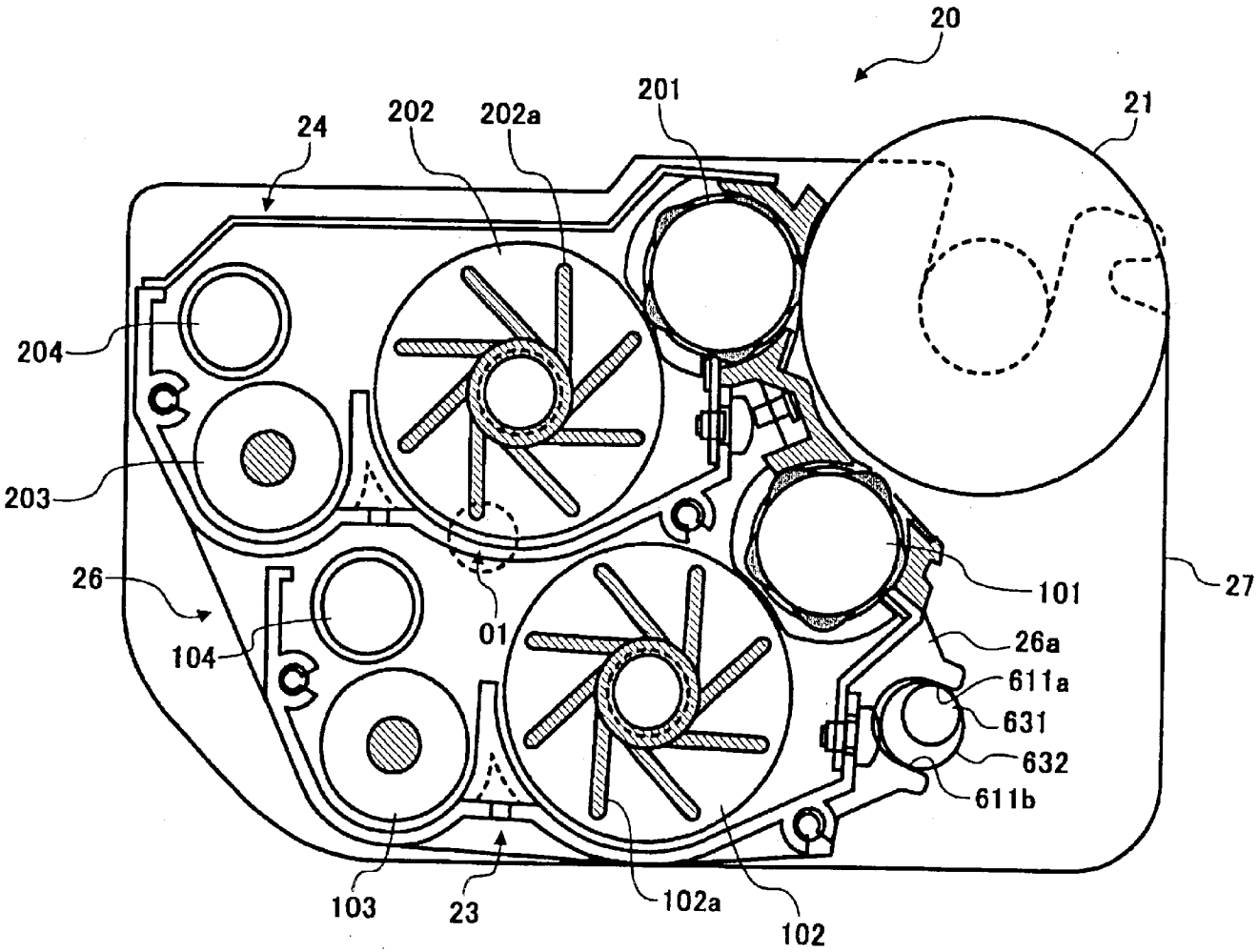
FIG. 28 is an enlarged view, as seen from the other side, showing the other developing roller of the first developing unit included in the fourth embodiment and contacting the drum.
Figure 29:
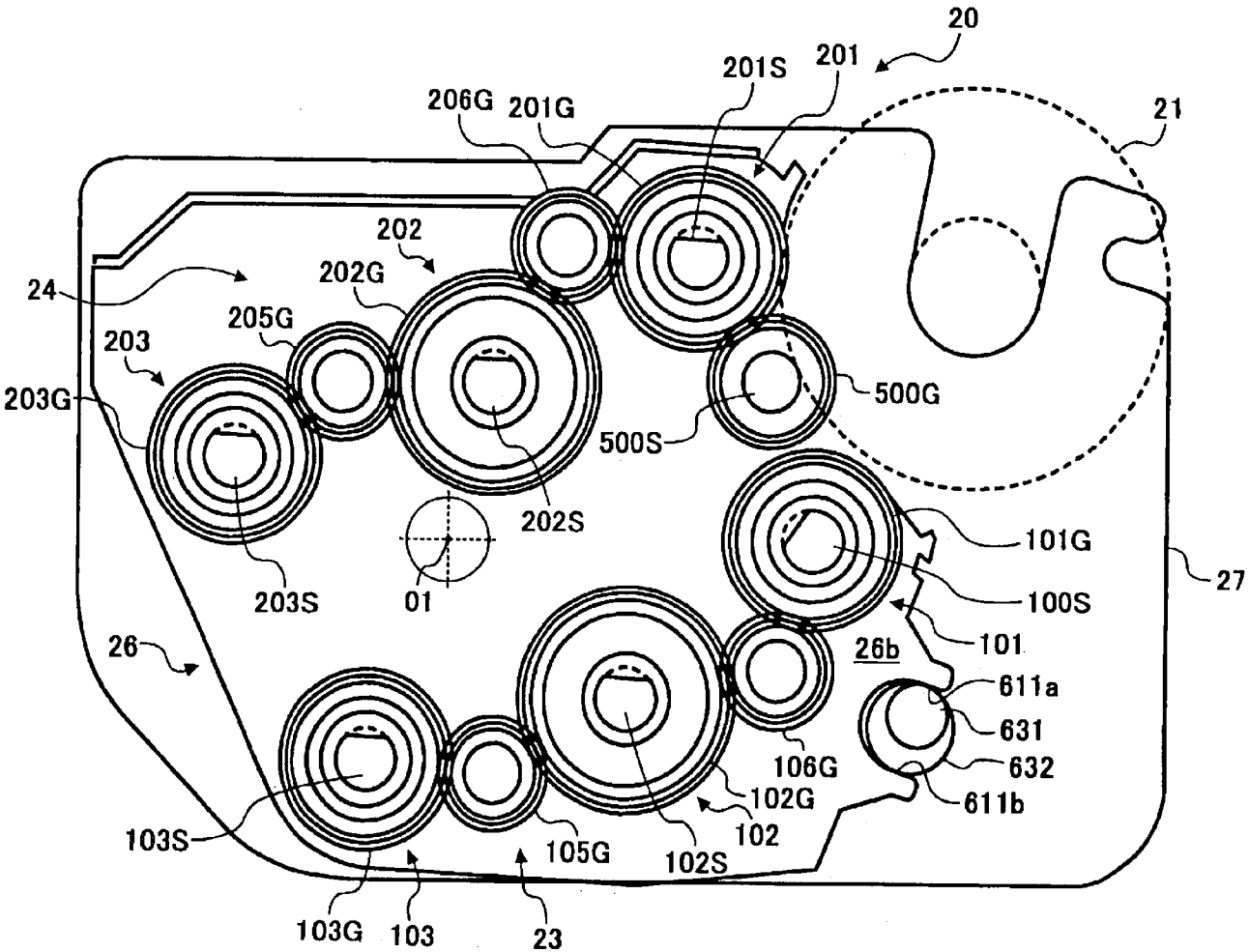
FIG. 29 is an enlarged view, as seen from the one side, showing the other developing roller of the first developing unit included in the fourth embodiment and contacting the drum.

As shown in FIG. 24, after the adjustment shown in FIG. 23, a position where the cam shaft 613 stops rotating is selected such that the eccentric cam 612 contacts the cam contact surface 611*b* at a position where a preselected gap is formed between the developing roller 201 and the drum 21 at one end of the axis O1. Subsequently, as shown in FIG. 25, the position of the cam contact surface 620*b* relative to the developing unit 26 is adjusted such that the eccentric cam 612 contacts, at the cam stop position of FIG. 24, the cam contact surface 620*b* at a position where a preselected gap is formed between the developing roller 201 and the drum 21.

The configuration described above is applied to the second image forming unit 30 as well.

The illustrative embodiment therefore readily implements, at the time of assembly, initial parallelism between the developing rollers 101 and 201 and the drum 21 at the preselected angular position of the developing unit 26.

Alternatively, one unmovable cam contact surface and one adjustable cam contact surface may be provided on each of opposite side walls 26*a* and 26*b*. In such a case, an adjusting mechanism will be used for adjusting, at a position where the cam contact surface at one end contacts the eccentric cam at the same end to thereby determine the angular position of the developing unit, a condition wherein the cam contact surface and eccentric cam at the other end contact each other. This also readily implements initial parallelism between the developing rollers 101 and 201 and the drum 21.

Fourth Embodiment

A fourth embodiment of the present invention, which is also applied to the image forming apparatus 1 of FIG. 1, will be described with reference to FIGS. 26 through 29. In the illustrative embodiment, parts and elements identical with those of the first embodiment are designated by identical reference numerals and will not be described specifically in order to avoid redundancy. FIGS. 26 through 29 also pertain to the first developing unit 26 by way of example. As shown, a cam shaft 631 is rotatable about an axis parallel to the axis O1 of the developing unit 26. An eccentric cam 632 is mounted on the cam shaft 631. The developing unit 26 is formed with cam contact surfaces 611*a* and 611*b* contacting the eccentric cam 632 and implemented as two flat surfaces substantially perpendicular to the direction of angular movement of the developing unit 26. Such flat, cam contact surfaces 611*a* and 611*b* contact the eccentric cam 632 in such a manner as to nip it therebetween.

The above configuration is applied to the second image forming unit 30 as well.

To maintain the developing rollers 101 and 201 and drum 21 parallel to each other in relation to the eccentric cam mechanism by overcoming the torque around the axis O1 stated earlier, it is necessary to maintain the surface of the eccentric cam 632 and non-driven cam contact surfaces 611*a* and 611*b* in stable contact.

In the configurations shown in FIGS. 14 through 25, assume that the force, tending to enlarge the gap between the developing roller 101 or 201 in operation and the drum 21 due to the resistance of the developer, is sufficiently stronger than the force tending to reduce the above gap, the force, biasing the cam contact surface against the cam is sufficiently strong. However, if the former force acting on the gap cannot overcome the latter force also acting on the gap, then it is difficult to maintain parallelism between the developing roller 101 or 201 and the drum 21.

By contrast, in the illustrative embodiment, even when undesirable torque is generated around the axis O1, the cam contact surfaces 611*a* and 611*b* of the developing unit 26 and eccentric cam 632 constantly remain in contact with each other. It is therefore possible to insure accurate angular movement and accurate stop position of the developing unit 26 and therefore to insure high image quality while reducing the size of the cam drive mechanism and saving power.

If desired, the cam contact surfaces 611*a* and 611*b* may be positioned in the vicinity of opposite ends of the axis O1, in which case two eccentric cams, each being capable of contacting the surfaces 611*b* and 611*b* at one end, will be mounted on the cam shaft 631. This alternative configuration is successful to maintain the gap for development accurate over the entire image region in the axial direction of the developing roller 101 or 201, thereby further enhancing image quality.

Fifth Embodiment

Reference will be made to FIGS. 30 through 42 for describing a fifth embodiment of the present invention also applied to the image forming apparatus 1, FIG. 1. In the illustrative embodiment, parts and elements identical with those of the first embodiment are designated by identical reference numerals and will not be described specifically in order to avoid redundancy.

To implement high image quality with the image forming apparatus 1, it is necessary that during development the gap between, e.g., the developing roller 101 or 201 in operation and the drum 21 be accurately maintained, as stated earlier. Therefore, the developing roller 101 or 201 in operation and drum 21 must be accurately maintained parallel to each other during development.

Further, the drum 21, for example, is rotatably supported by the side walls 27 of the image forming unit 20 while the developing rollers 101 and 201 are rotatably supported by the side walls 26*a* of the developing unit 26. In addition, the developing rollers 101 and 201 and drum 21 each are supported by a particular part. It follows that if initial parallelism is established between the developing rollers 101 and 201 and drum 21 by relying only on the accuracy of parts, then the individual parts must be machined with extremely high accuracy, resulting in an increase in cost.

Figure 30:
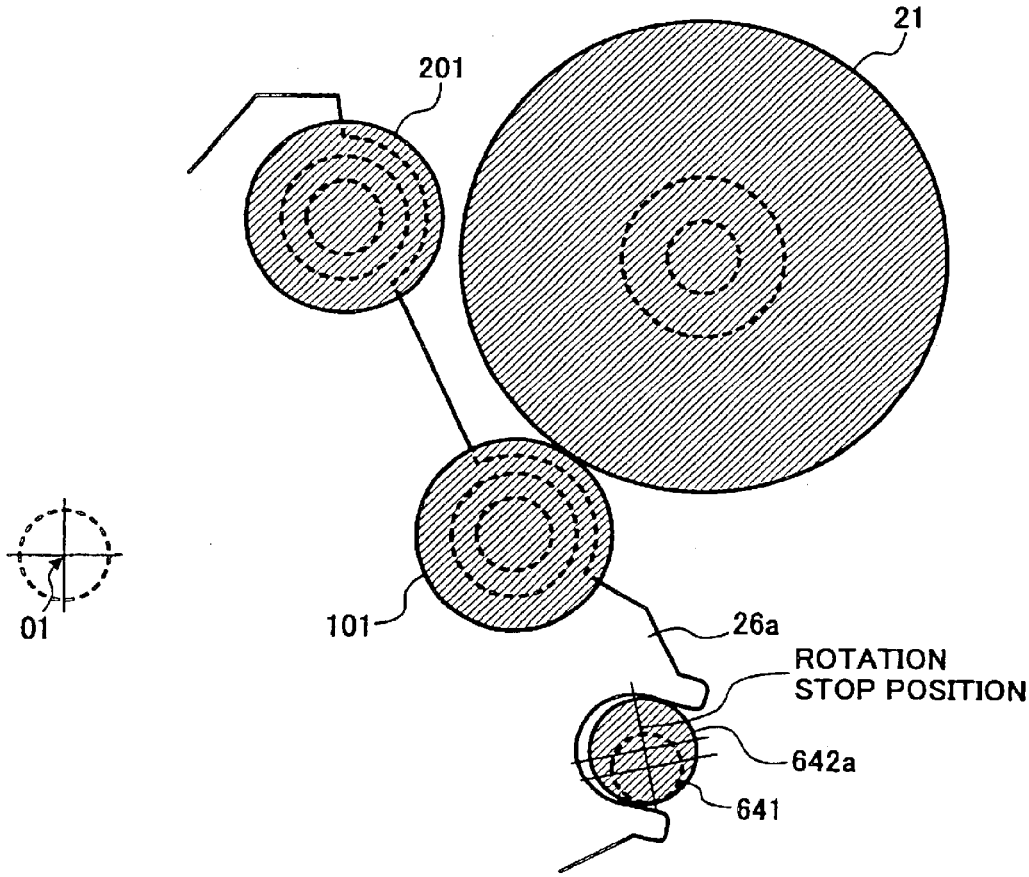
FIG. 30 is an enlarged view, as seen from the other side, showing a fifth embodiment of the present invention in which an eccentric cam is provided integrally with a cam shaft and the other developing roller contacts the drum.
Figure 31:
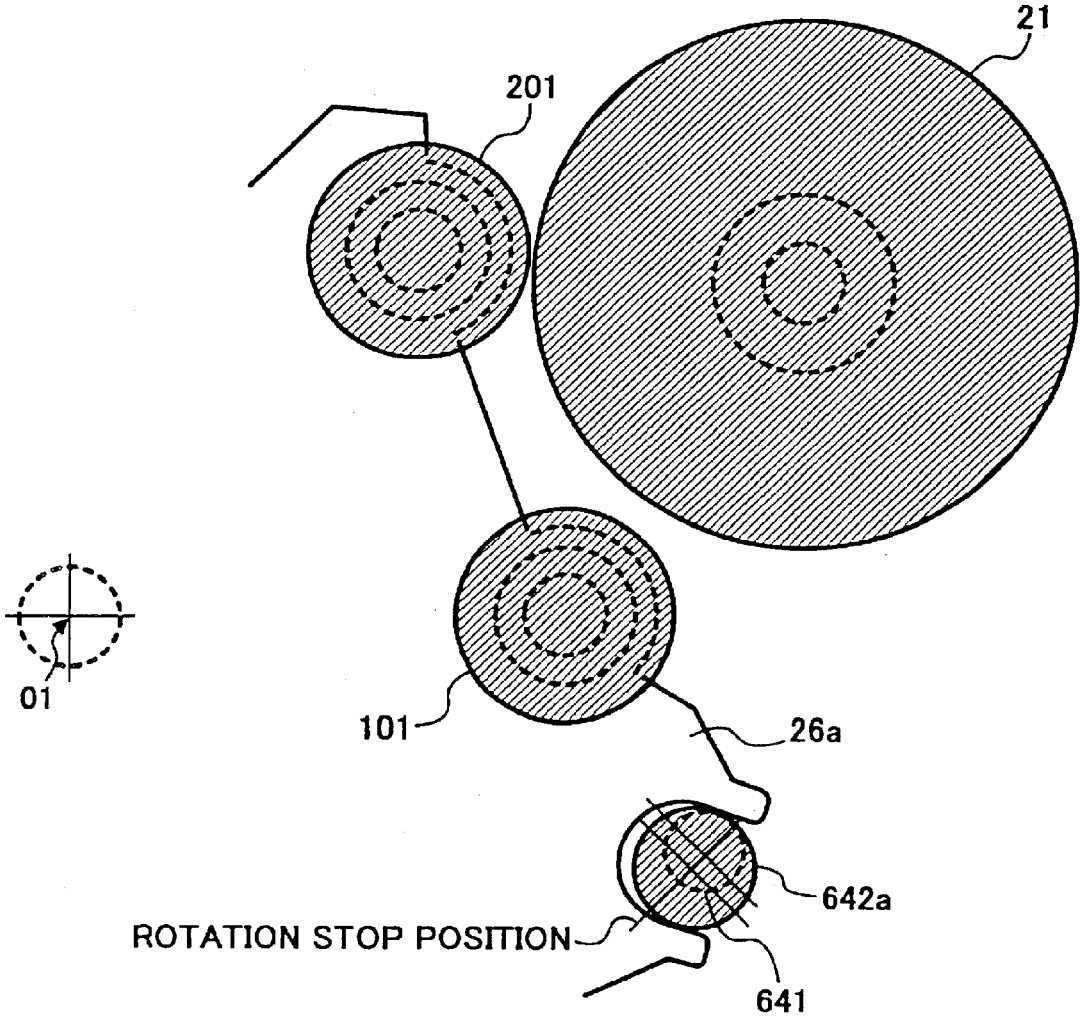
FIG. 31 is an enlarged view, as seen from the other side, showing the eccentric cam provided integrally with the cam shaft and the other developing roller contacting the drum.
Figure 32:
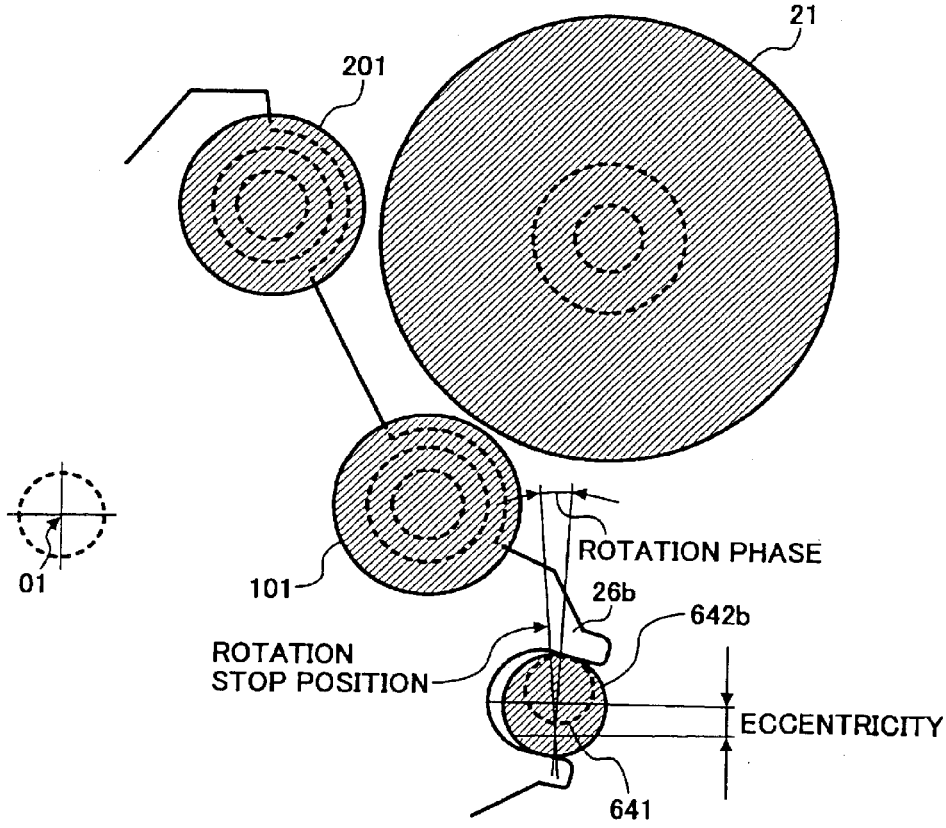
FIG. 32 is an enlarged view, as seen from the one side, showing the eccentric cam provided integrally with the cam shaft and one developing roller contacting the drum.
Figure 33:
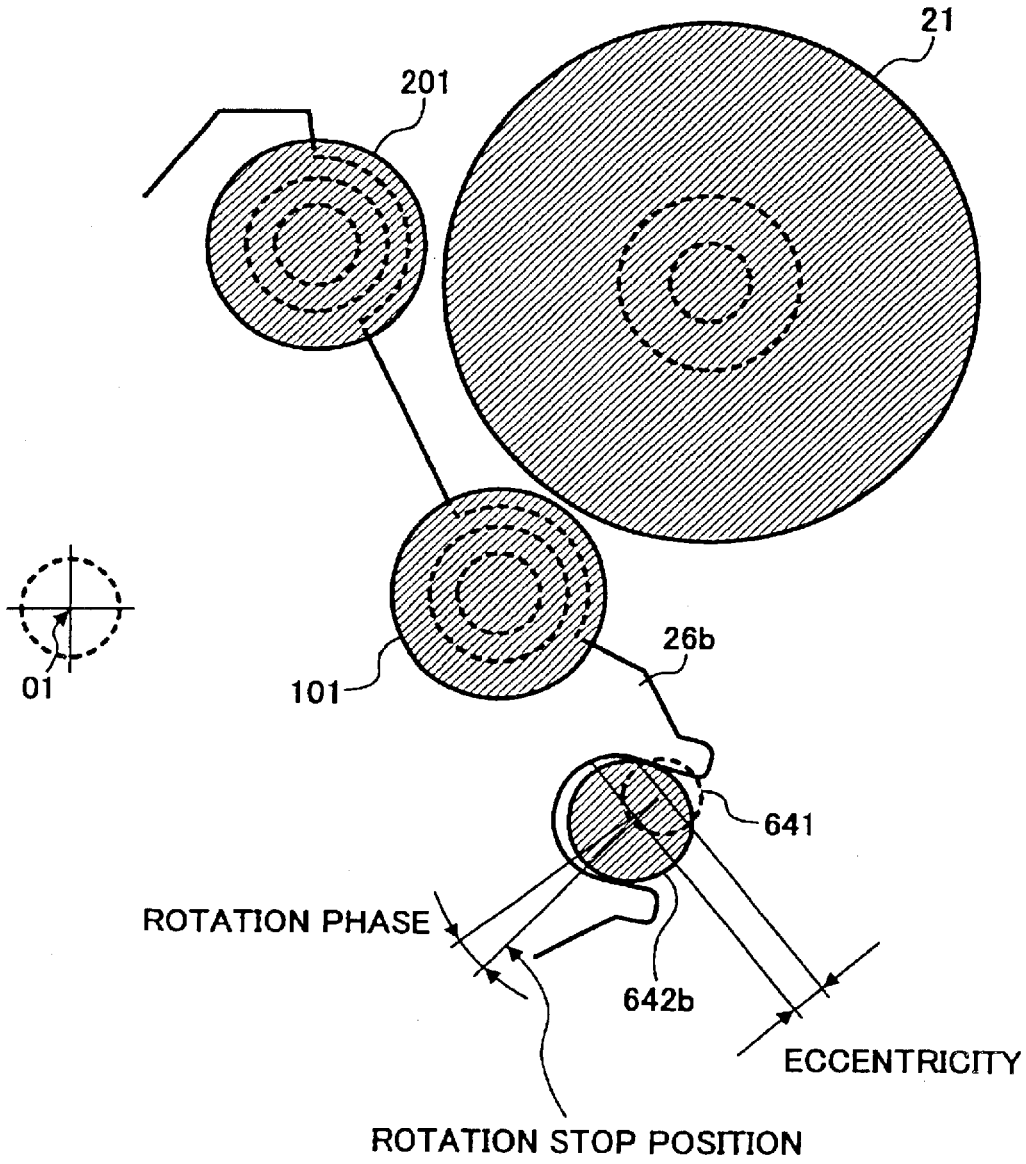
FIG. 33 is an enlarged view, as seen from the one side, showing the eccentric cam provided integrally with the cam shaft and one developing roller contacting the drum.
Figure 34:
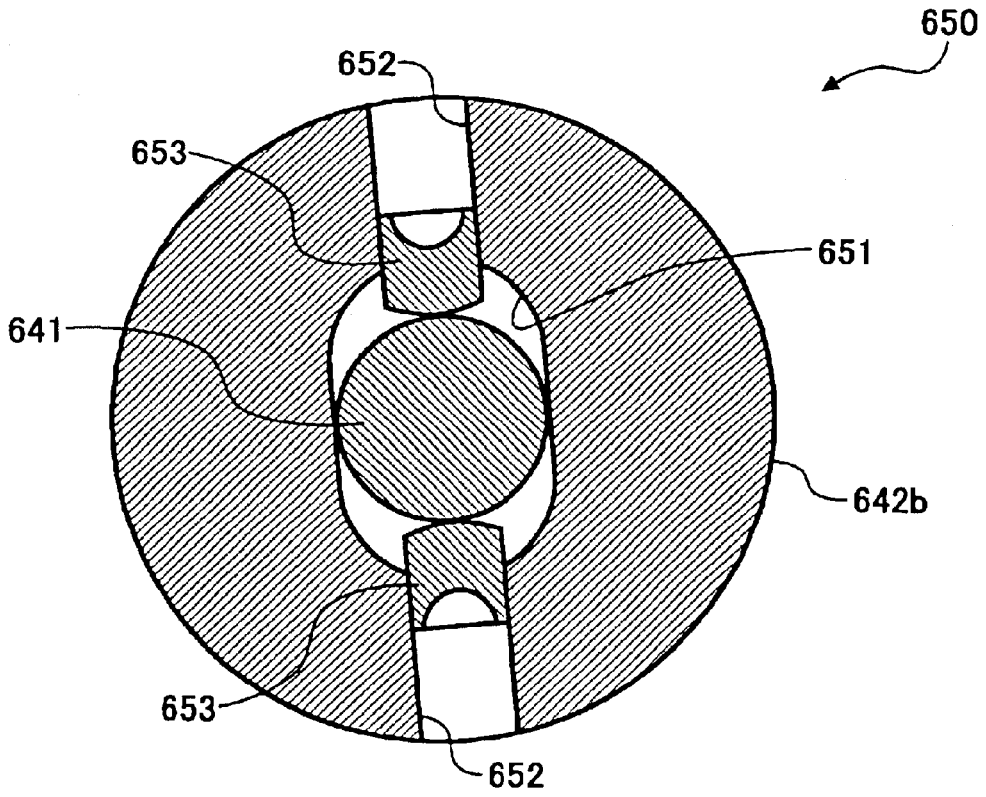
FIG. 34 is an enlarged view showing a specific configuration of a mechanism for adjusting the eccentricity and rotation phase of the eccentric cam.

To solve the above problem, as shown in FIG. 34, the illustrative embodiment includes an adjusting mechanism 650 associated with one of two eccentric cams 642*a* and 642*b* mounted on a cam shaft 641. As shown in FIGS. 30 and 31, the stop positions of the cam shaft 641 are determined at one end of the axis O1, where the other eccentric cam 642*a* is positioned, such that the gap between the developing roller 101 or 201 and the drum 21 is accurate when the developing unit 26 is angularly moved. In the illustrative embodiment, as shown in FIGS. 32 and 33, the amount of eccentricity and rotation phase of the eccentric cam 642*b* relative to the cam shaft 641 are adjusted such that, at the above stop position of the cam shaft 641, the gap between the developing roller 101 or 201 and the drum 21 remains, during development, adequate at the other end of the axis O1 where the eccentric cam 642*b* is positioned.

With the above configuration, it is possible to easily establish parallelism between the developing rollers 101 and 201 and drum 21 during development.

As shown in FIG. 34, the adjusting mechanism 650, associated with one eccentric cam 642*b* for adjusting eccentricity and rotation phase, includes the eccentric cam 642*b* throughout which the cam shaft 641 extends. The eccentric cam 642*b* is formed with a slot 651 long enough to implement a preselected displacement for eccentricity adjustment. At a position where the eccentricity and rotation angle of the eccentric cam 642*b* relative to the cam shaft 641 are optimum, set screws 653 are driven into two screw holes 652 also formed in the eccentric cam 642*b*, thereby fastening the eccentric cam 642*b* to the cam shaft 641.

However, the adjusting mechanism 650 associated with one eccentric cam 642*b* needs a larger space than the other eccentric cam 642*a* and therefore increases the size of the apparatus 1. Further, it is difficult to insure firm fastening of the eccentric cam 642*b* to the cam shaft 641. FIGS. 35 through 40 show a modification of the illustrative embodiment configured to solve this problem.

As shown in FIGS. 35 through 40 also pertaining to the first developing unit 26 by way of example, two eccentric cams 642*c* and 642*d* are mounted on opposite ends of the cam shaft 641. Adjusting mechanisms 660 and 670 (see FIGS. 41 and 42) are respectively associated with the eccentric cams 642*d* and 642*c* and assigned to eccentricity adjustment and rotation phase adjustment.

Figure 35:
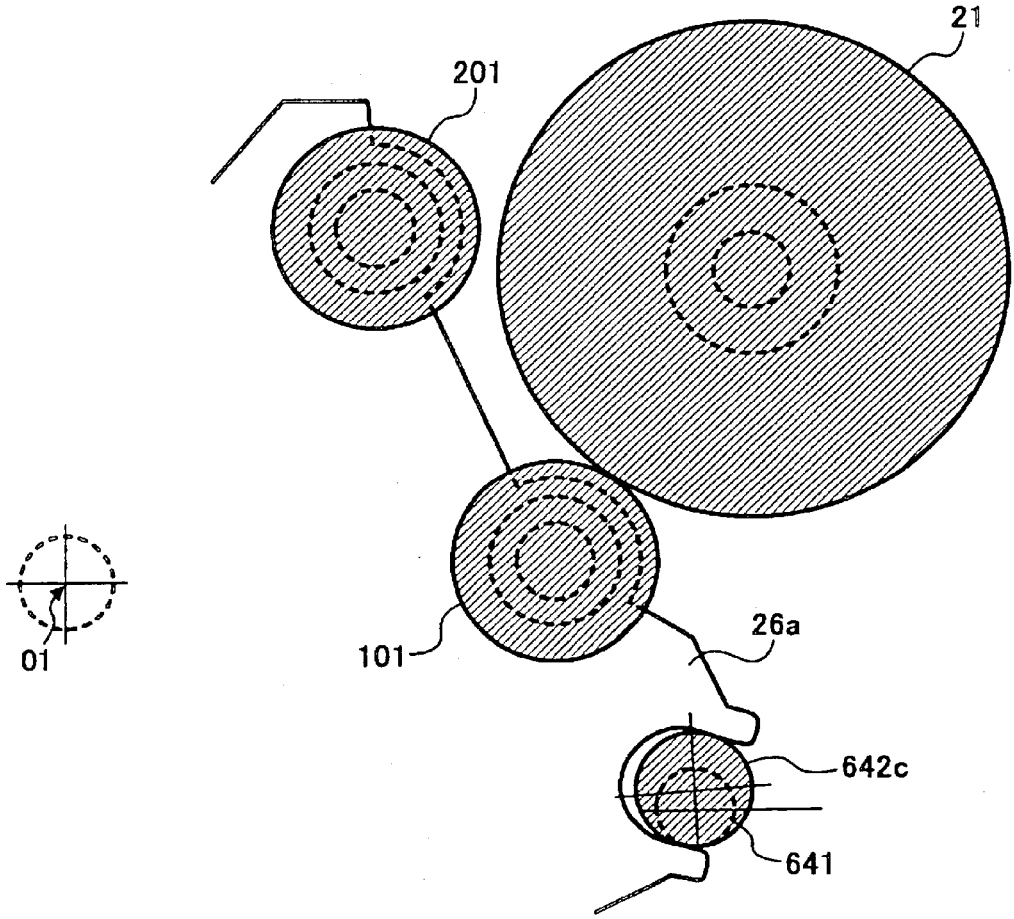
FIG. 35 is a view, as seen from the other side, the eccentric cam provided integrally with the cam shaft and one developing roller, included in the first developing unit provided with the adjusting mechanism, contacting the drum.
Figure 36:
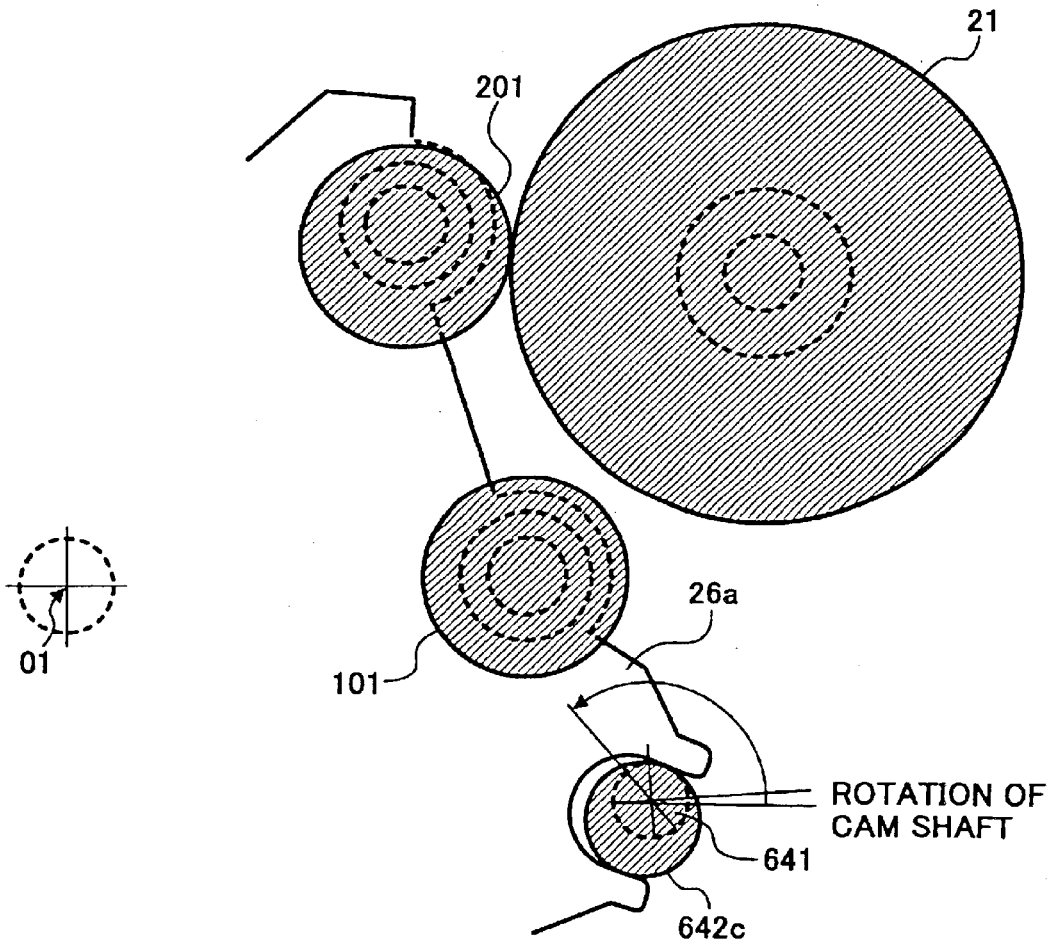
FIG. 36 is a view, as seen from the other side, the eccentric cam provided integrally with the cam shaft and the other developing roller, included in the first developing unit provided with the adjusting mechanism, contacting the drum.
Figure 37:
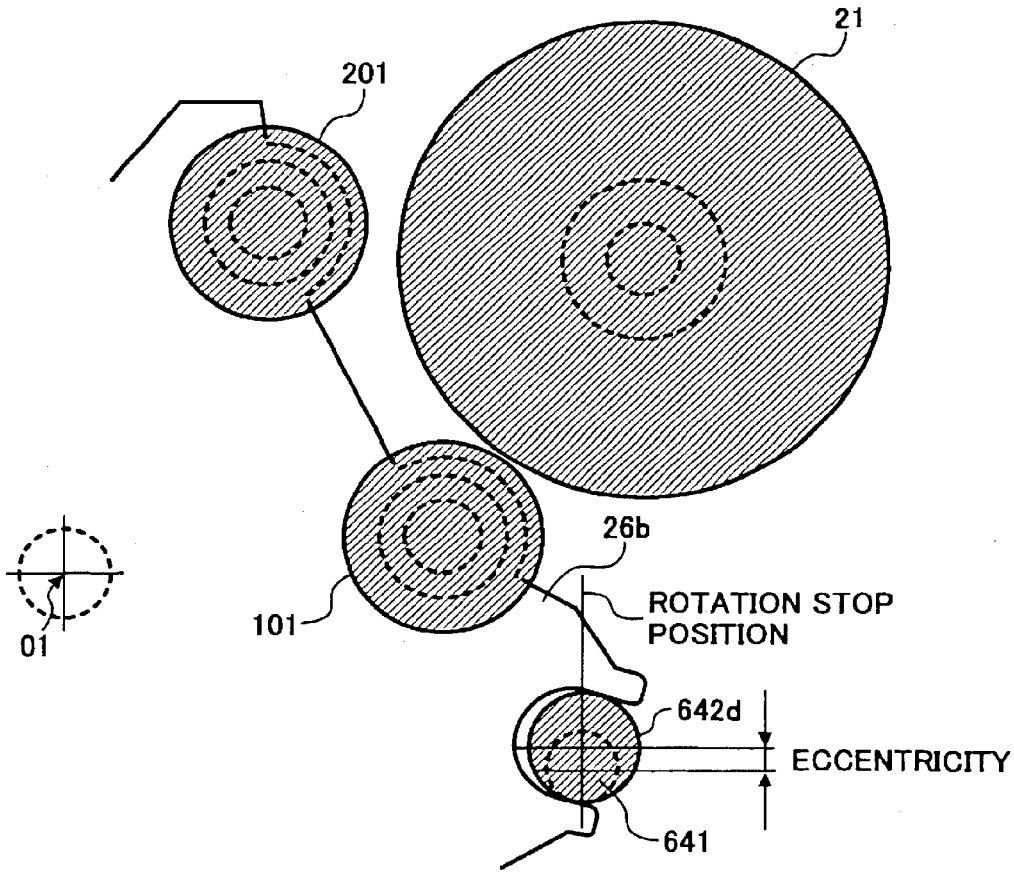
FIG. 37 is a view, as seen from the one side, the eccentric cam provided integrally with the cam shaft and one developing roller, included in the first developing unit provided with the adjusting mechanism, contacting the drum.
Figure 38:
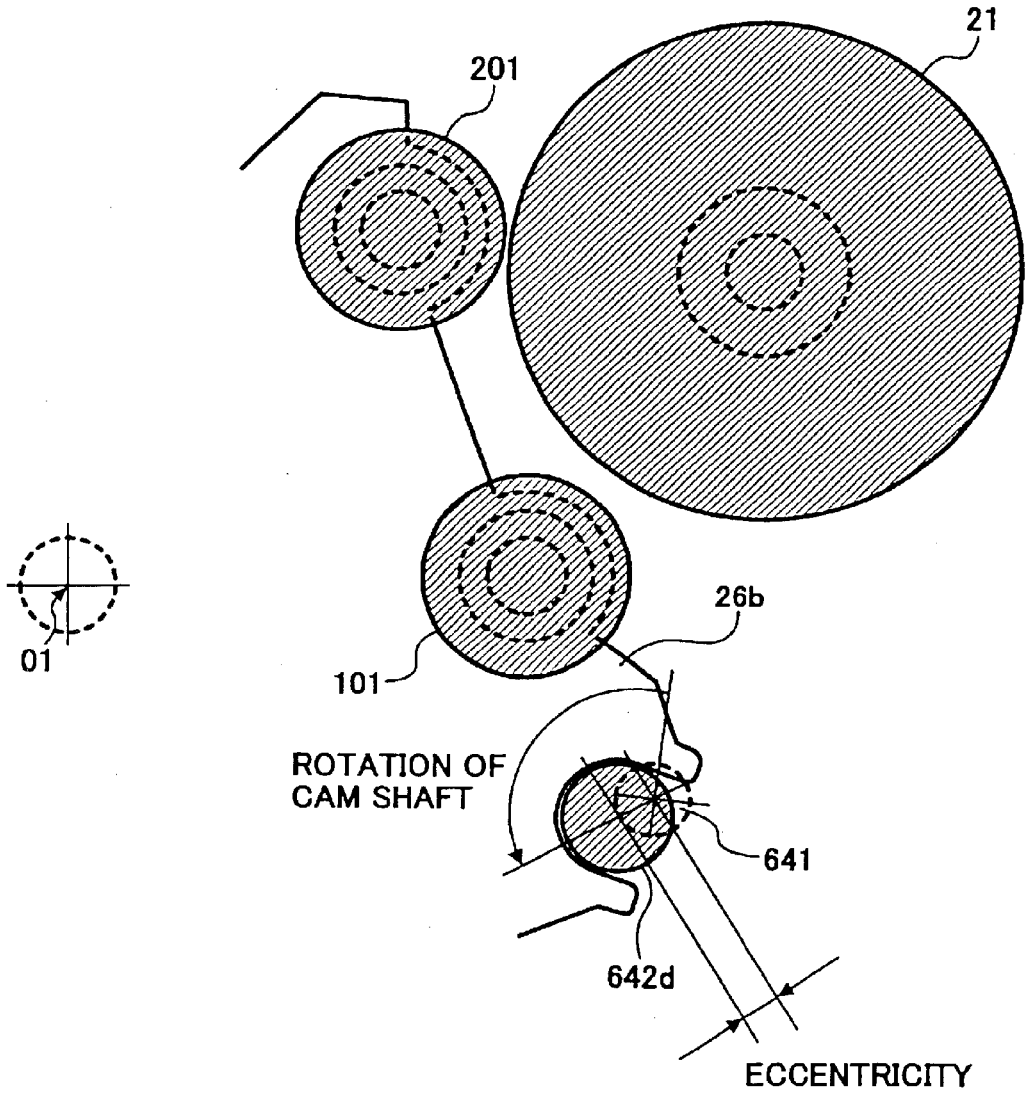
FIG. 38 is a view, as seen from the one side, the eccentric cam provided integrally with the cam shaft and the other developing roller, included in the first developing unit provided with the adjusting mechanism, contacting the drum.
Figure 39:
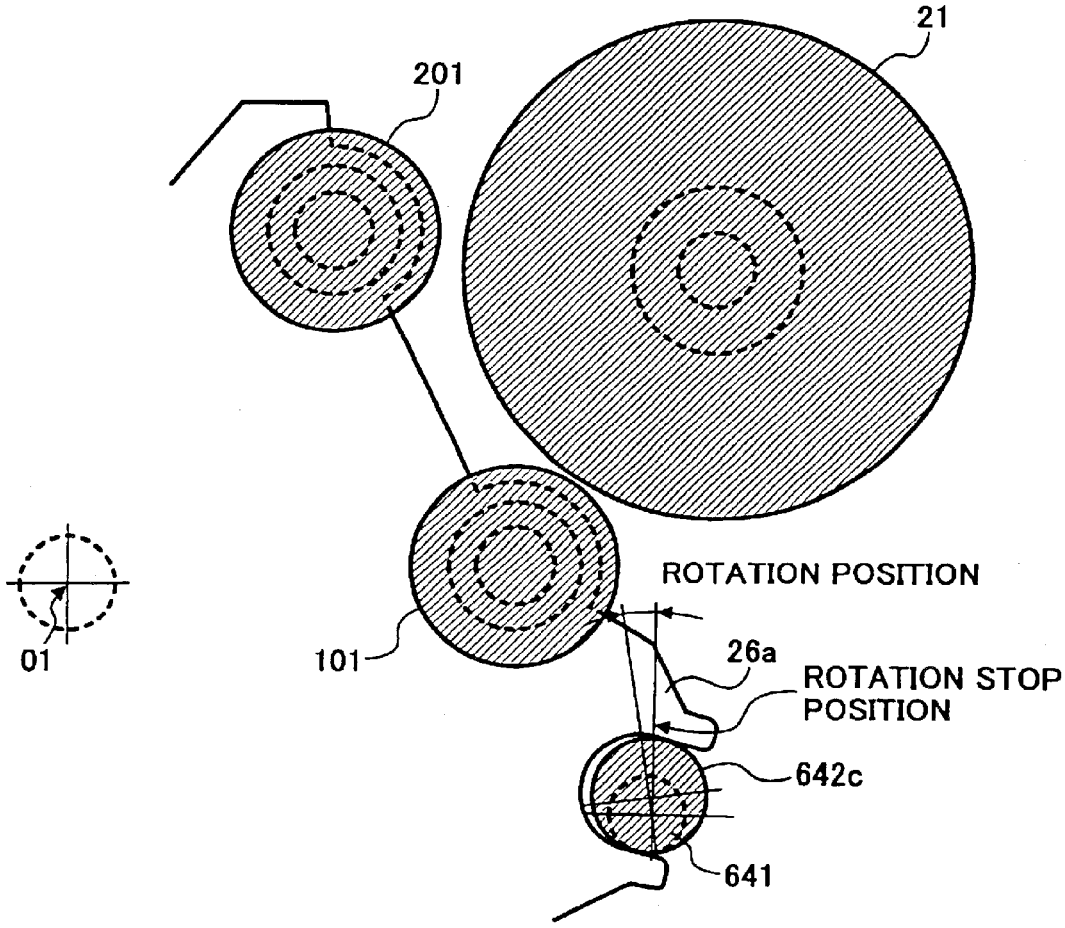
FIG. 39 is a view, as seen from the other side, the eccentric cam in the condition wherein one developing roller of the first developing unit, adjusting the rotation phase with the adjusting mechanism, contacts the drum.
Figure 40:
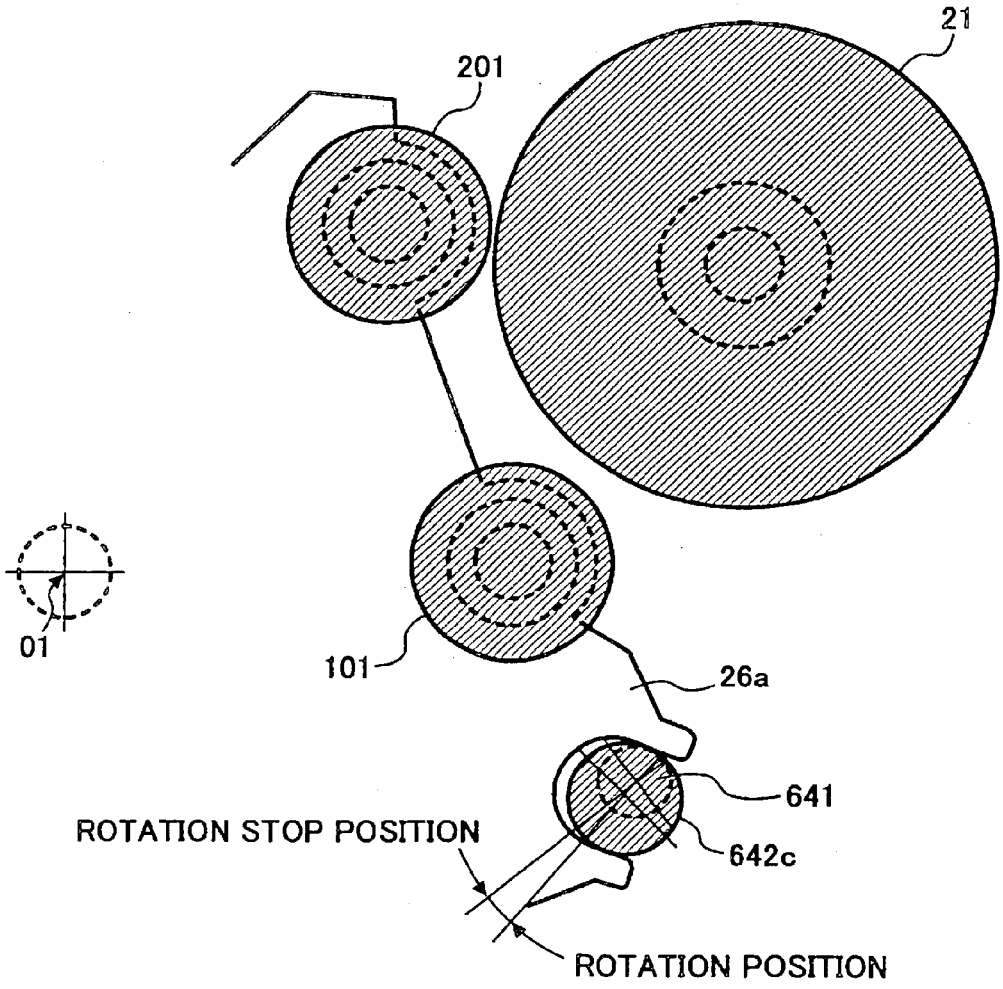
FIG. 40 is a view, as seen from the other side, the eccentric cam in the condition wherein the other developing roller of the first developing unit, adjusting the rotation phase with the adjusting mechanism, contacts the drum.

As shown in FIGS. 35 and 36, the amount of rotation of the cam shaft 641 is determined at one end of the axis O1, where the other eccentric cam 642*c* is positioned, such that the gap between the developing roller 101 or 201 and the drum 21 is accurate when the developing unit 26 is angularly moved. Also, as shown in FIGS. 37 and 38, the eccentricity of the eccentric cam 642*d* relative to the cam shaft 641 is adjusted such that, for the above amount of rotation of the cam shaft 641, the gap between the developing roller 101 or 201 and the drum 21 remains, during development, adequate at the other end of the axis O1 where the eccentric cam 642*d* is positioned. Subsequently, as shown in FIGS. 39 and 40, the rotation phase of the eccentric cam 642*c* relative to the cam shaft 641 is adjusted such that, for the above stop position of the cam shaft 641, the distances between the developing rollers 101 and 201 and the drum 21 remain, during development, adequate at the end of the axis O1 where the eccentric cam 642*c* is positioned.

With the above configuration, it is also possible to easily establish parallelism between the developing rollers 101 and 201 and drum 21 during development.

Figure 41:
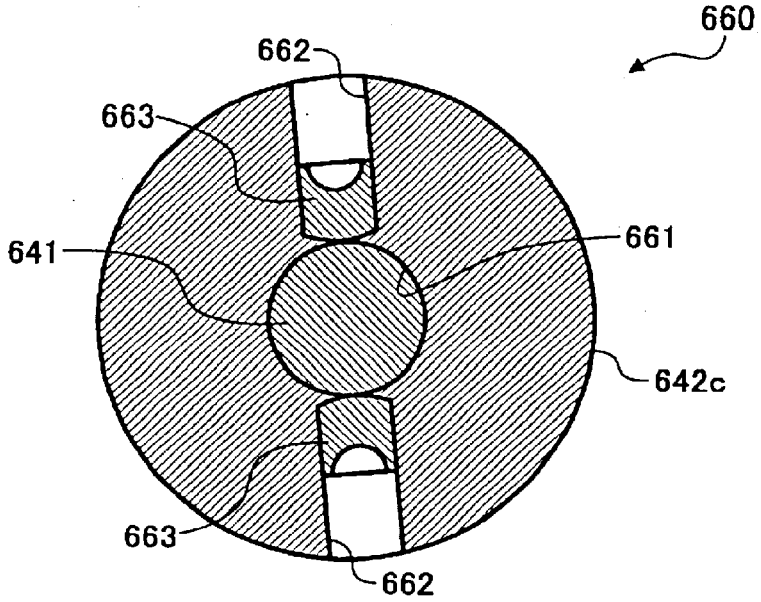
FIG. 41 is a fragmentary section showing another specific configuration of the rotation phase adjusting mechanism.

As shown in FIG. 41, the adjusting mechanism 660 assigned to rotation phase includes a hole 661 formed in the eccentric cam 642*c* and receiving the cam shaft 641. At a position where the rotation phase of the eccentric cam 642*c* relative to the cam shaft 641 is optimum, set screws 663 are driven into two holes 662 formed in the eccentric cam 642*c*, thereby fastening the eccentric cam 642*c* to the cam shaft 641.

Figure 42:
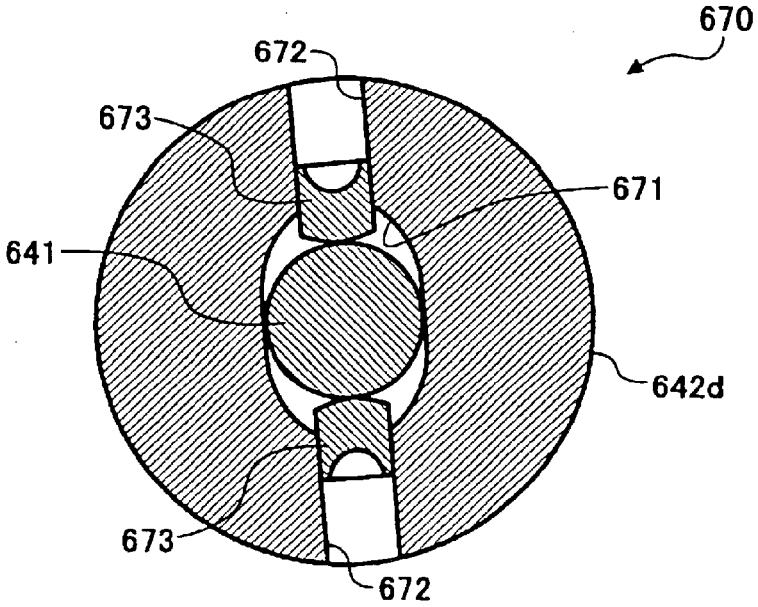
FIG. 42 shows another specific configuration of the eccentricity adjusting mechanism.

As shown in FIG. 42, the adjusting mechanism 670 assigned to eccentricity includes a slot 671 formed in the eccentric cam 642*d* and elongate enough to implement a preselected displacement for adjustment. Part of the cam shaft 641 is configured as an eccentric portion received in the slot 671. At a position where the eccentricity of the eccentric cam 642*d* relative to the cam shaft 641 is optimum, set screws 673 are driven into two holes 672 formed in the eccentric cam 642*d*, thereby fastening the eccentric cam 642*d* to the cam shaft 641.

The adjusting mechanisms 670 and 660, distributed to the two eccentric cams 642*d* and 642*c*, need a minimum of space and reduce the size of the apparatus 1. Further, firm fastening to the cam shaft 641 is achievable to thereby enhance reliability.

It is to be noted that the adjusting mechanisms 660 and 670 and adjusting methods described above are similarly applicable to the third and fourth embodiments.

Sixth Embodiment

A sixth embodiment of the present invention also applied to the image forming apparatus 1, FIG. 1, will be described with reference to FIGS. 43 through 46. In the illustrative embodiment, parts and elements identical with those of the first embodiment are designated by identical reference numerals and will not be described specifically in order to avoid redundancy.

Figure 43:
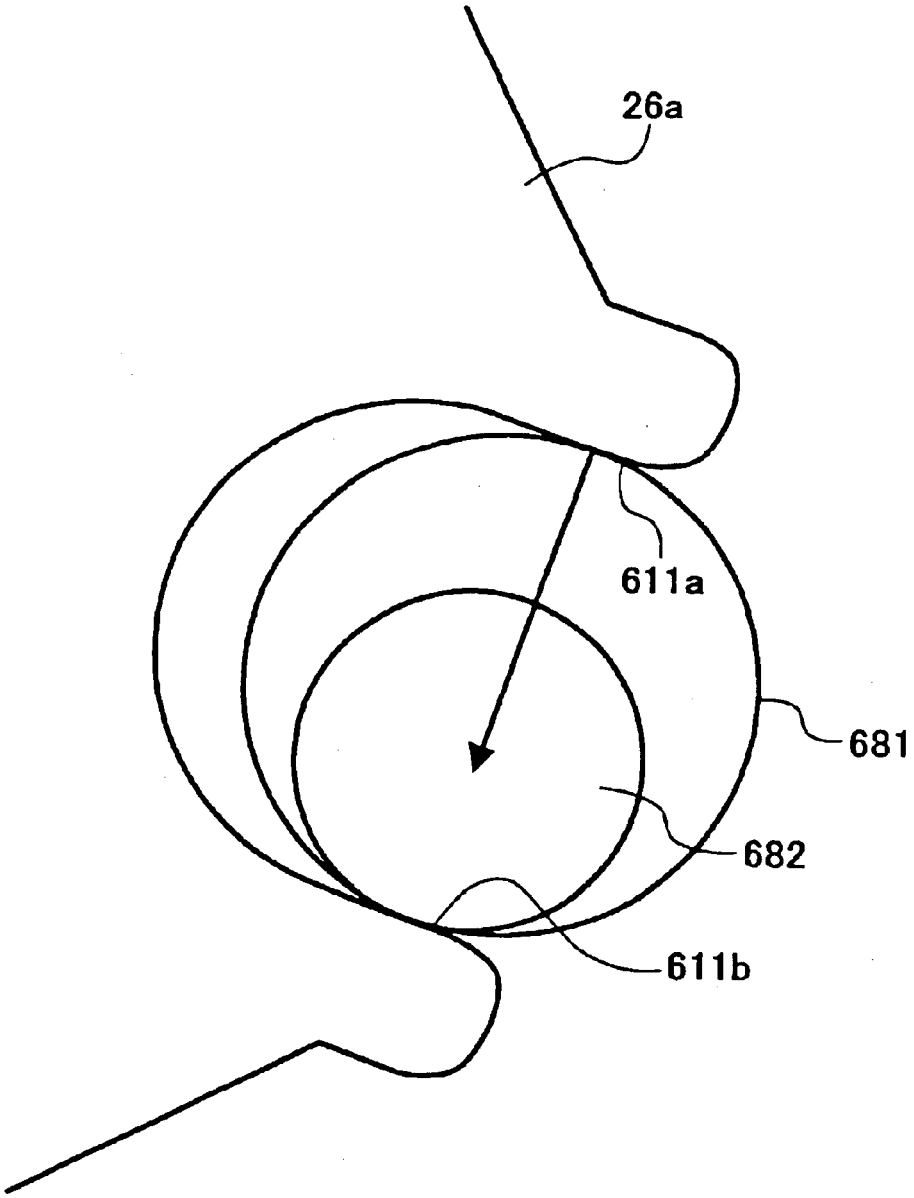
FIG. 43 is an enlarged view showing a sixth embodiment of the present invention in which the contact force of the other cam contact surface of the first developing unit, acting on the cam surface of the eccentric cam, extends in a direction extending in the vicinity of the axis of the cam shaft.

As shown in FIG. 43 also pertaining to the first developing unit 26 by way of example, so long as a force exerted by the cam contact surface 611*a* or 611*b* on the eccentric cam 681 acts in a direction extending in the vicinity of the axis of the cam shaft 682, a force that tends to rotate the cam shaft 682 is not generated even when unnecessary torque acts on the developing unit 26. The rotation stop position of the eccentric cam 68 can therefore be accurately maintained.

Figure 44:
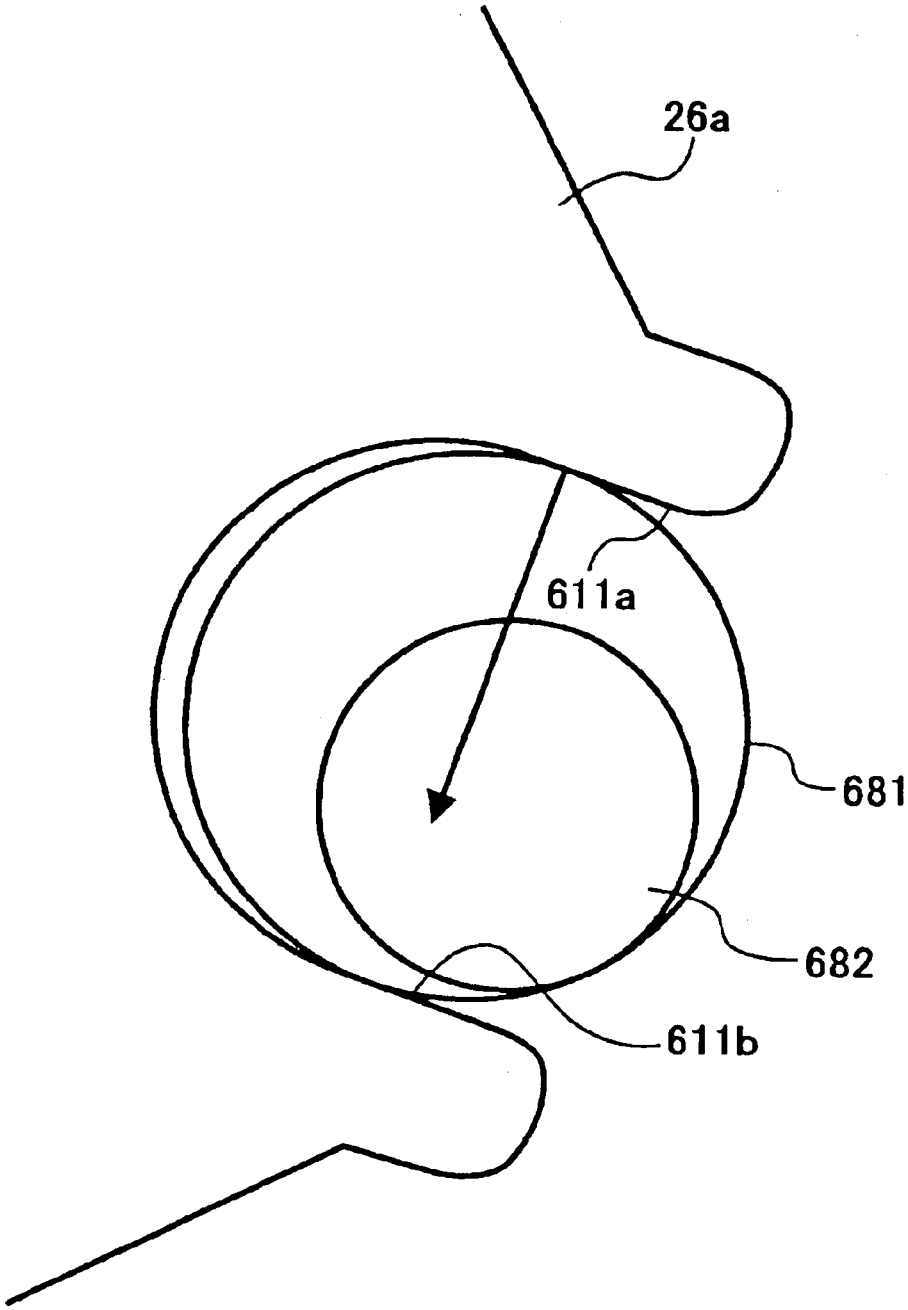
FIG. 44 is an enlarged view showing a condition wherein the contact force of the other cam contact surface of the first developing unit, acting on the cam surface of the eccentric cam, does not extend in a direction extending in the vicinity of the axis of the cam shaft.

However, as shown in FIG. 44, when the rotation angle of the cam shaft 682 at the time of angular movement of the developing unit 26 is relatively small, the direction in which the force of the cam contact surface 611*a* or 611*b* acts on the eccentric cam 681 does not extend in the vicinity of the axis of the cam shaft 682. As a result, when unnecessary torque acts on the developing unit 26, a force that tends to rotate the cam shaft 682*is* generated.

Figure 45:
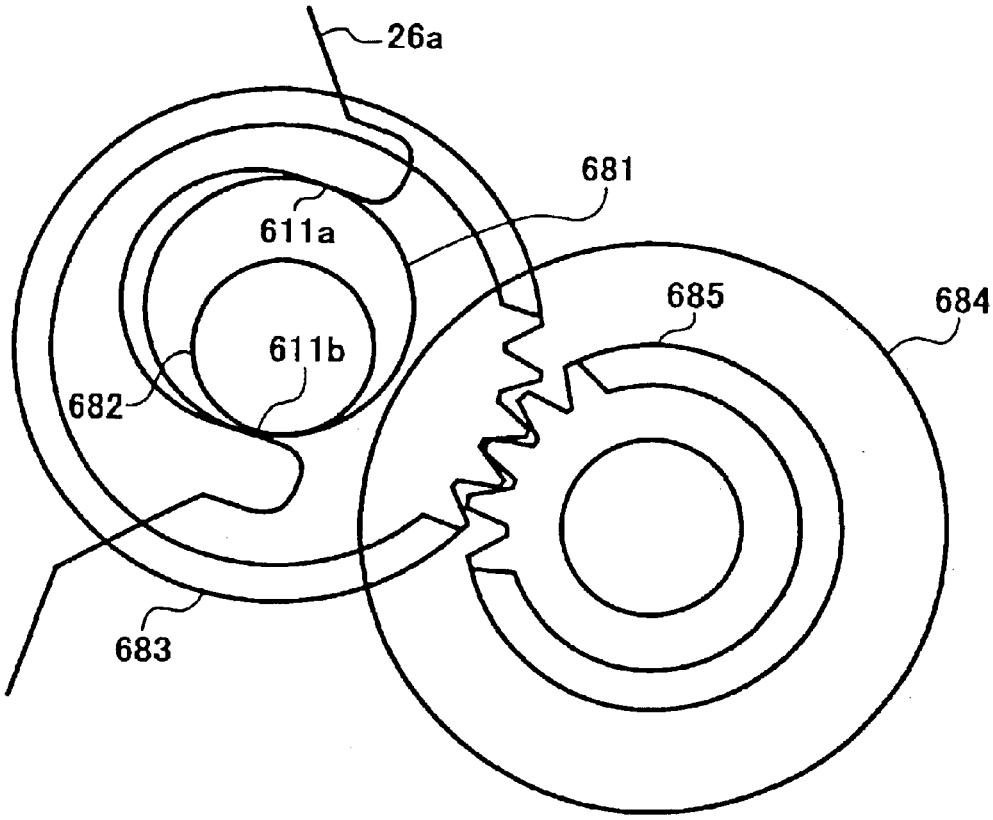
FIG. 45 is a fragmentary view showing a drive source implemented as a stepping motor.

In light of the above, as shown in FIG. 45, the drive source for rotating the cam shaft 682 is implemented as a stepping motor 684. More specifically, a driven gear 683 is coaxially mounted on the cam shaft 682 and held in mesh with a drive gear 685 mounted on the output shaft of the stepping motor 684. The stepping moor 684 therefore rotates the cam shaft 682 via the two gears 685 and 683. When the stepping motor 684 is in a halt, a hold current is fed to the stepping motor 684 so as to restrict the rotation of the output shaft. In this configuration, even when unnecessary torque acts on the developing unit 26 and generates a force tending to rotate the cam shaft 682, the cam shaft 682 is prevented from rotating and maintains the rotation stop position of the developing unit 26 accurate. This insures a highly accurate gap for development and therefore high image quality.

Further, the number of steps of the stepping motor 684 is controllable to establish any desired amount of rotation. Therefore, the amount of rotation of the cam shaft 682 necessary for the developing unit 26 to move from the preselected position where one of the developing rollers 101 and 201 operate to the preselected position where the other developing roller operates can be easily, accurately determined in terms of the number of steps.

If the stepping motor 684 looses synchronism, it is impossible to control the number of steps. To solve this problem, a sensor or sensing means for sensing a reference angular position during the angular movement of the developing unit 26 may be used, in which case the number of steps necessary from the time when the reference position is sensed to the time when the developing unit 26 reaches the preselected position will be stored. With this configuration, it is possible to immediately resume, even when the stepping motor 684 looses synchronism, the angular rotation of the developing unit 26.

The arrangements described above are applied to the second developing unit 36 as well.

Figure 46:
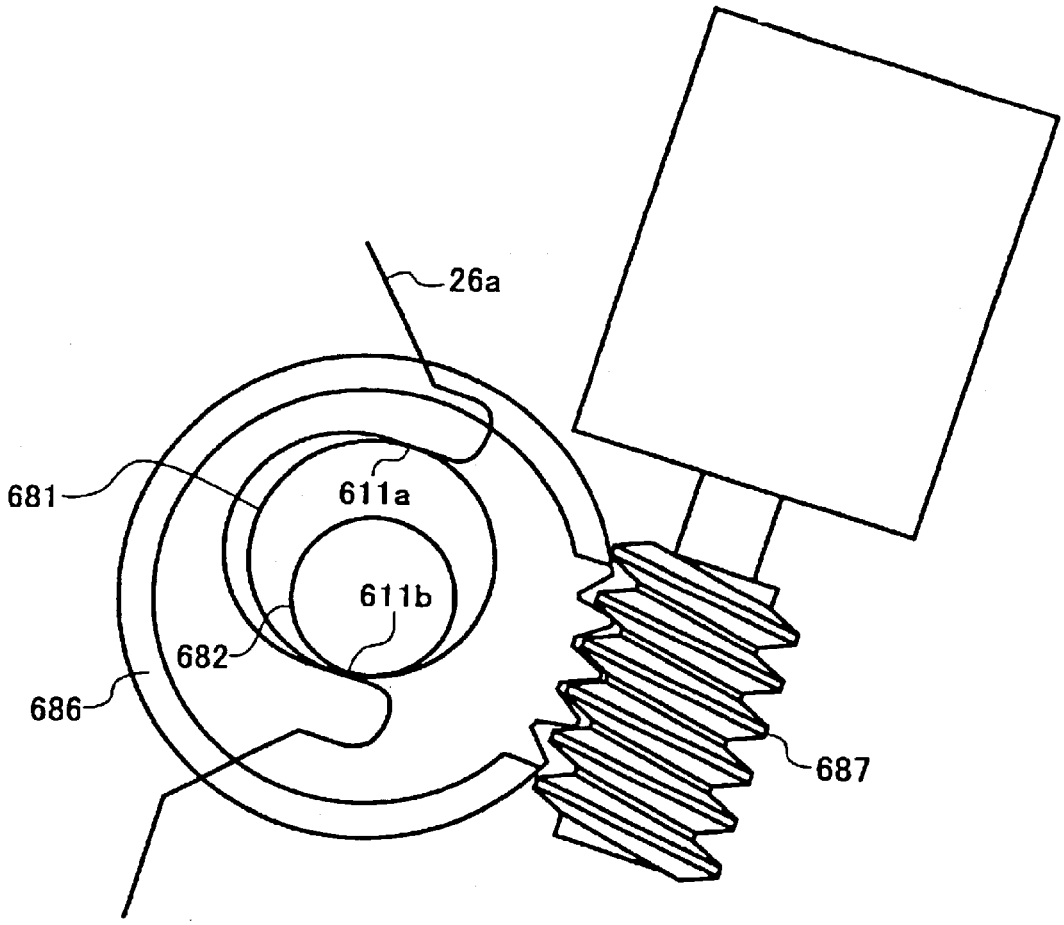
FIG. 46 is a fragmentary view showing the drive source implemented as a worm wheel.

FIG. 46, which also pertains to the first developing unit 26 by way of example, shows another specific mechanism for driving the cam shaft 682. As shown, a worm wheel 686 is coaxially mounted on the cam shaft 613 and driven by a worm gear 687. Even when a force, tending to rotate the worm wheel 686 due to an extraneous force, acts when the worm wheel 686 is in a halt, the worm gear 687 prevents the worm wheel 686 from rotating. This drive mechanism achieves the same advantages as the drive mechanism shown in FIG. 45.

In the drive mechanism shown in FIG. 45, by suitably selecting the number of steps of the stepping motor 684 and therefore the amount of rotation of the cam shaft 682, it is possible to control the distance between the developing roller 101 or 201 and the drum 21, i.e., the gap for development, as will be described hereinafter. While high image quality is not achievable unless the gap for development is highly accurate, the optimum gap varies in accordance with temperature, humidity and other environmental conditions and toner content, charge potential, exposure potential and other process conditions for image formation, as known in the art. It is therefore possible to noticeably enhance image quality by maintaining the optimum gap at all times in accordance with the above various conditions.

An arrangement may therefore be made such that the optimum gap is determined on the basis of the outputs of sensing means responsive to the environmental and process conditions, and then the number of steps for implementing the optimum gap is determined. When the stepping motor 684 is driven by the number of steps thus determined so as to move the developing unit 26, the optimum gap can be maintained in accordance with the various conditions.

Further, the optimum process conditions for image formation depend on the kind of a desired image (mode), e.g., a color image, a black-and-white image, a photo image or a text image. It is a common practice with the apparatus 1 to automatically establish, when the operator selects a desired image mode, the optimum process conditions matching with the image mode for thereby realizing high image quality. The optimum gap for development also depends on the image mode and may therefore be controlled in accordance with the image mode for thereby noticeably enhancing image quality.

In light of the above, setting means for allowing the operator to select a desired image mode or image forming mode may be provided on the apparatus 1.

Seventh Embodiment

Figure 47:
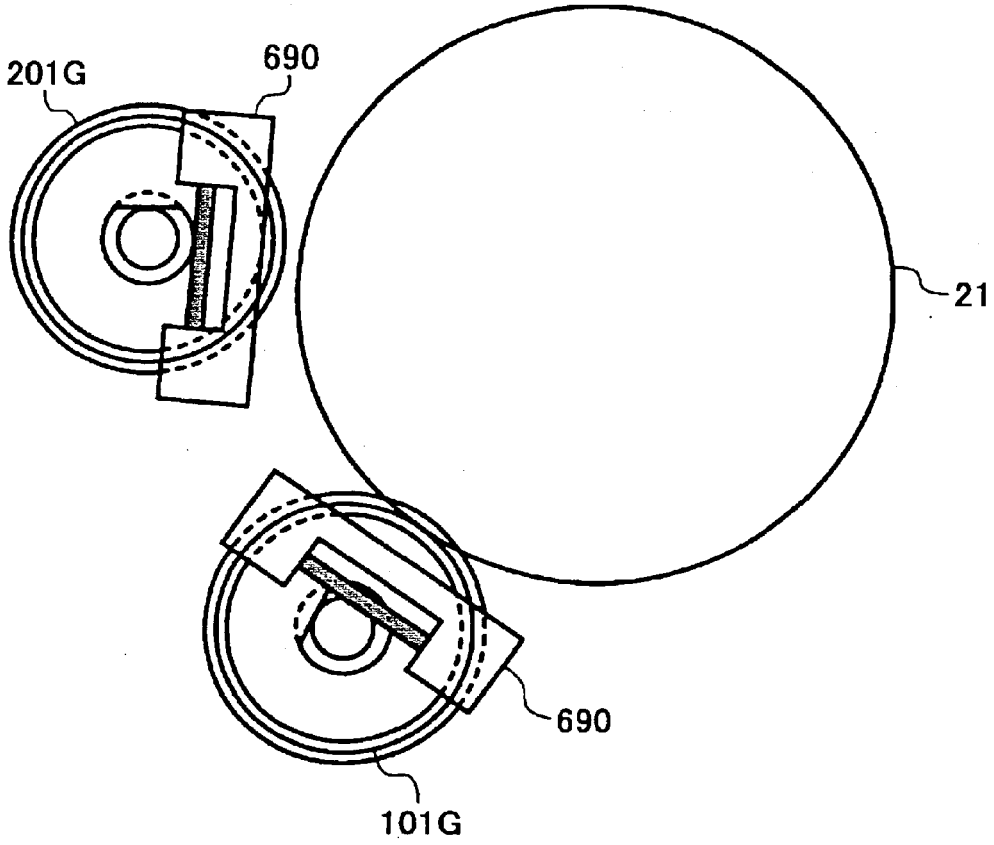
FIG. 47 is an enlarged view, as seen from one side, showing a seventh embodiment of the present invention including photosensors responsive to the distance between the developing rollers and the drum.
Figure 48:
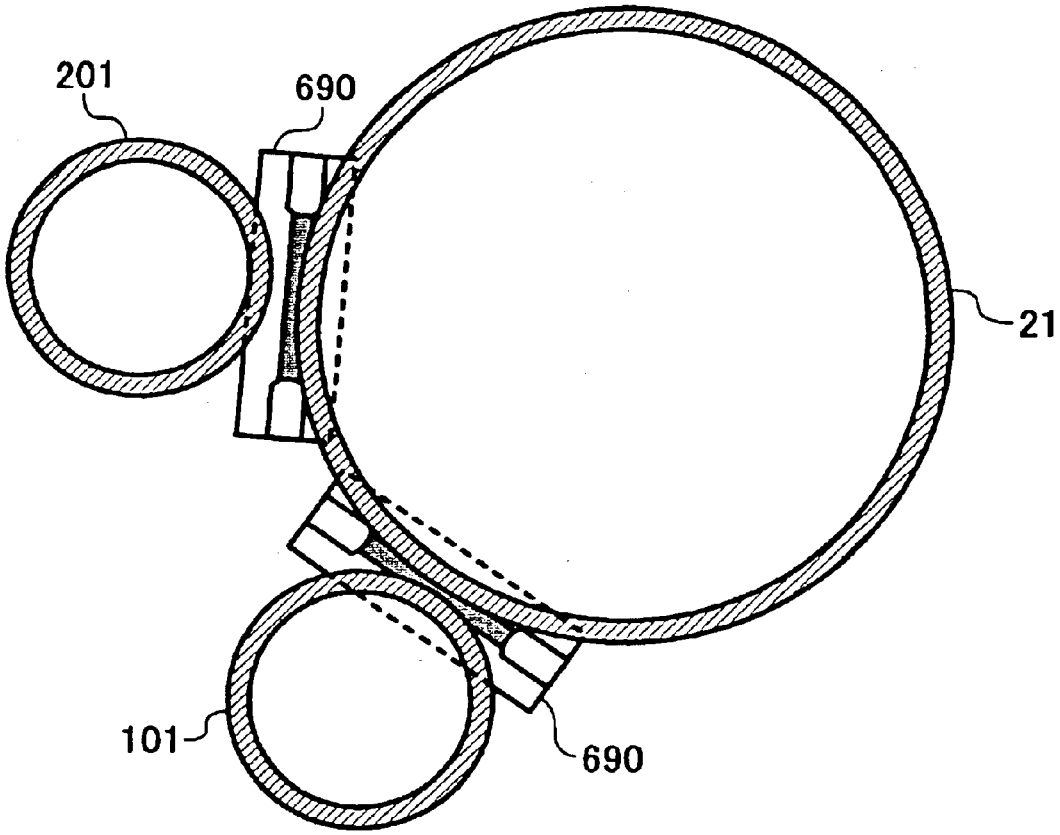
FIG. 48 is an enlarged view, as seen from one side, showing the optical sensors adjoining the ends of the developing rollers.

FIGS. 47 and 48 show a seventh embodiment of the present invention also applied to the image forming apparatus 1, FIG. 1. In the illustrative embodiment, parts and elements identical with those of the first embodiment are designated by identical reference numerals and will not be described specifically in order to avoid redundancy.

When the eccentricity of an eccentric cam or similar mechanical accuracy is used to determine the accuracy of the rotation stop position that, in turn, determines the gap for development, the accuracy is susceptible to dimensional variation ascribable to the varying environmental conditions or aging. To solve this problem, the illustrative embodiment includes distance sensing means responsive to the distance of the shaft of the developing roller and the shaft of the drum. When the developing unit 26 or 36 is angularly moved, the rotation stop position of the developing unit 26 or 36 is determined in accordance with the output of the distance sensing means. This not only makes the rotation stop position, which determines the gap, accurate, but also absorbs dimensional accuracy other than the positioning accuracy of the distance sensing means to thereby reduce the influence of the dimensional variation mentioned above.

More specifically, as shown in FIG. 47 also pertaining to the first developing unit 26 by way of example, photosensors or distance sensing means 690 are mounted on the first image forming unit 20, not shown, so as to sense the axis positions of the developing rollers 101 and 201 when the developing unit 26 is angularly moved. The output of each photosensor 690 varies with some linearity in accordance with the shift of a position to be sensed. Therefore, by varying the target output value of the photosensor 690 corresponding to the stop of movement of the developing unit, it is possible to vary the rotation stop position of the developing unit, i.e., the gap for development.

FIG. 48, which also pertains to the first developing unit 26 by way of example, shows another specific arrangement of the photosensors 690. As shown, the photosensors 690 are positioned in the vicinity of the ends of the developing rollers 101 and 201, respectively, in part of the gaps for development where the developer is absent, directly sensing the distance between the surfaces of the developing rollers 101 and 201 and the surface of the drum 21.

If desired, two photosensors 690 may be positioned in the vicinity of opposite ends of each of the developing rollers 101 and 201, in which case the outputs of the two photosensors 690 will be averaged. The resulting mean value can be used to determine the distance between the surface of the developing roller 101 or 201 and the surface of the drum 21. This not only allows the gap to be highly accurately controlled, but also allows an error in parallelism between the developing roller 101 or 201 and the drum 21 to be detected on the basis of a difference between the outputs of the two photosensors 690.

Eighth Embodiment

Figure 49A:
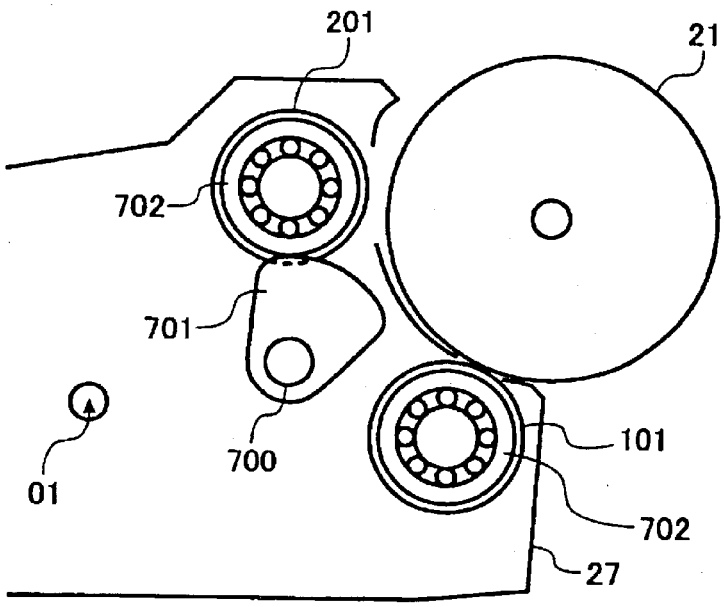
FIGS. 49A and 49B are enlarged views showing a ninth embodiment of the present invention.
Figure 49B:
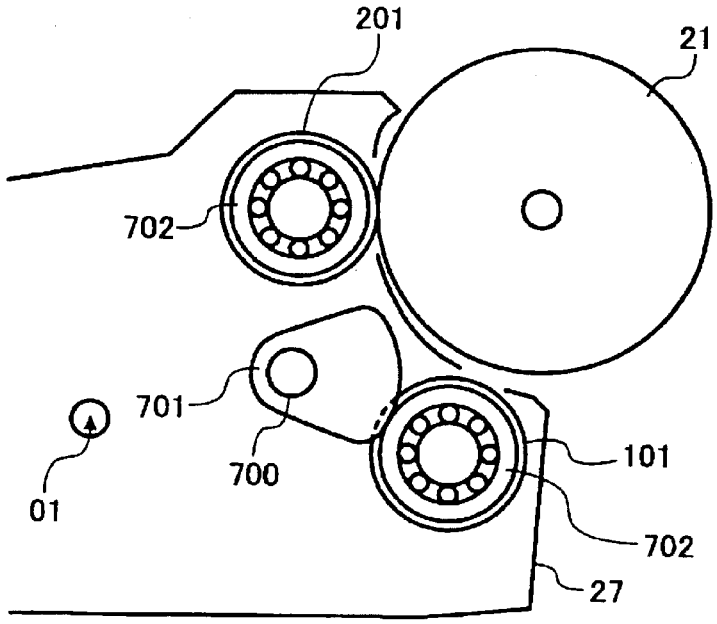

FIGS. 49A and 49B show an eighth embodiment of the present invention. To maintain the gap between the drum and the developing roller highly accurate, it is necessary to reduce the number of parts intervening between the drum and the developing roller and to increase the accuracy of the individual intervening part, as described in relation to the second embodiment. In the third embodiment described with reference to FIGS. 14 through 17, the side walls 27, supporting the drum 21 and cam shaft 613, eccentric cams 612 mounted on the cam shaft 613 and side walls 26*a* and 26*b*, formed with the cam contact surfaces 611*a* and 611*b* and supporting the developing rollers 101 and 201, intervene between the drum 21 and the developing rollers 101 and 201. In this case, the side walls 26*a* and 26*b* must be machined accurately enough to make the configuration between the developing rollers 101 and 201 and the cam contact surfaces 611 and 611*b* accurate, resulting in an increase in cost.

As shown in FIGS. 49A and 49B, the illustrative embodiment includes a cam shaft 700 rotatable about an axis parallel to the axis O1 of the developing unit. An eccentric cam 701 is mounted on the cam shaft 700. The cam contact surfaces that the eccentric cam 701 is expected to contact are implemented by roller members 702, which are rotatably mounted on the shafts of the developing rollers 101 and 201, respectively. The roller members 702 are simple in configuration and can therefore be accurately machined at low cost, so that the gap for development can be maintained accurate at low cost.

Ninth Embodiment

A ninth embodiment of the present invention will be described with reference to FIGS. 50A and 50B. During development, a force, tending to enlarge the gap for development, acts on the developing roller due to the resistance of the developer present in the gap, generating torque around the axis of the developing unit, as stated in relation to the third embodiment. Further, the drive force of the drive gear, acting on the driven gear, includes torque acting around the axis of the developing unit due to pressure angle. Therefore, when use is made of the eccentric cam mechanism, it is necessary that the eccentric cam constantly remains in contact with the cam contact surface. In the configuration shown in FIGS. 49A and 49B, so long as the force, acting on the developing roller during development and tending to enlarge the gap, is sufficiently stronger than the force tending to reduce the gap, the force, biasing the cam contact surface toward the eccentric cam, is sufficiently strong; otherwise, it is difficult to maintain the developing roller and drum parallel to each other.

Figure 50A:
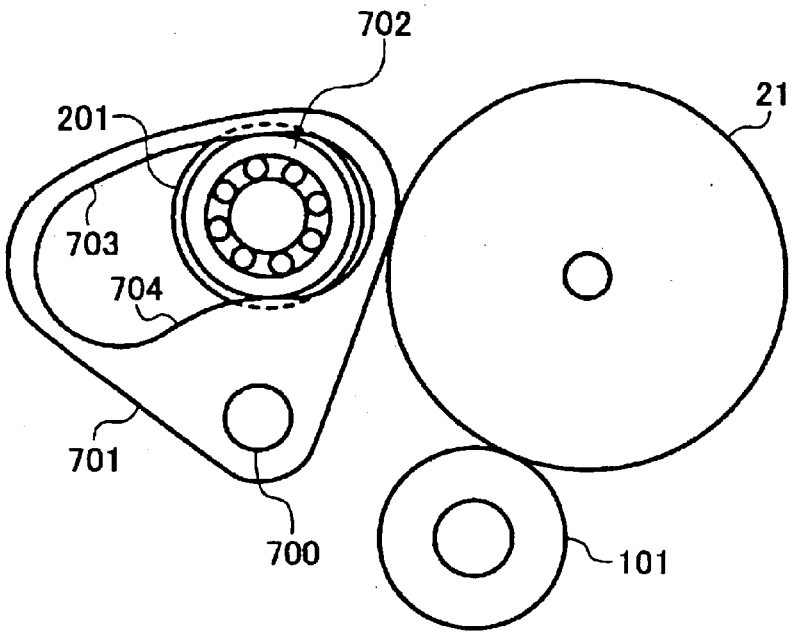
FIGS. 50A and 50B are enlarged views showing a tenth embodiment of the present invention.
Figure 50B:
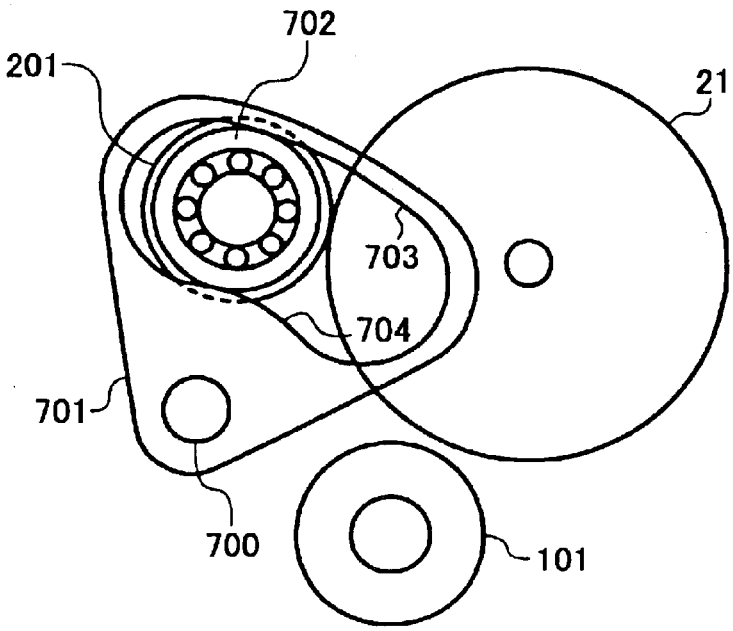

As shown in FIGS. 50A and 50B, in the illustrative embodiment, the eccentric cam 701 is also mounted on the cam shaft 700 whose axis is parallel to the axis of the developing unit. The roller member 702 is rotatably mounted on the shaft of the developing roller 201, constituting a cam contact surface. A guide groove is formed in the eccentric cam 701 while the roller member 701 is received in the guide groove. The guide groove includes two concentric, cam surfaces 703 and 704 contacting the roller member 702. In this configuration, even when unnecessary torque is generated around the axis of the developing unit, the cam surfaces 703 and 704 and roller member 702 constantly remain in contact with each other, so that the gap for development can be maintained accurate at low cost.

Tenth Embodiment

Figure 51A:
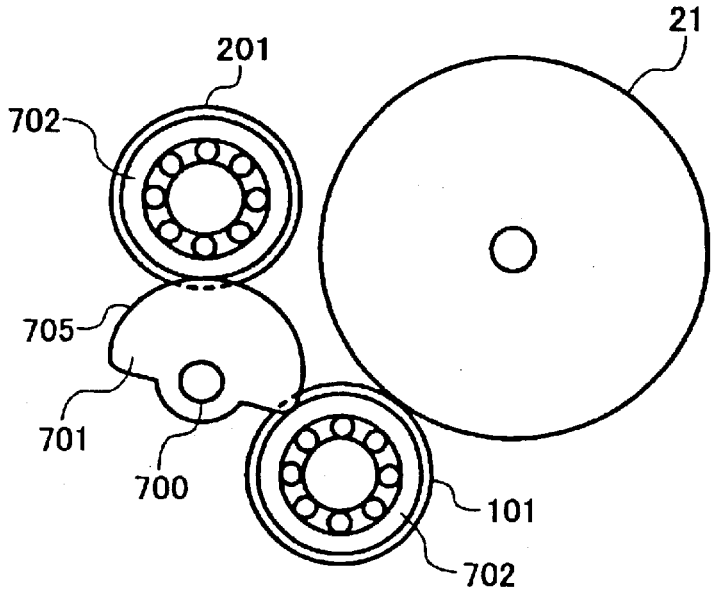
FIGS. 51A and 51B are enlarged views showing a tenth embodiment of the present invention.
Figure 51B:
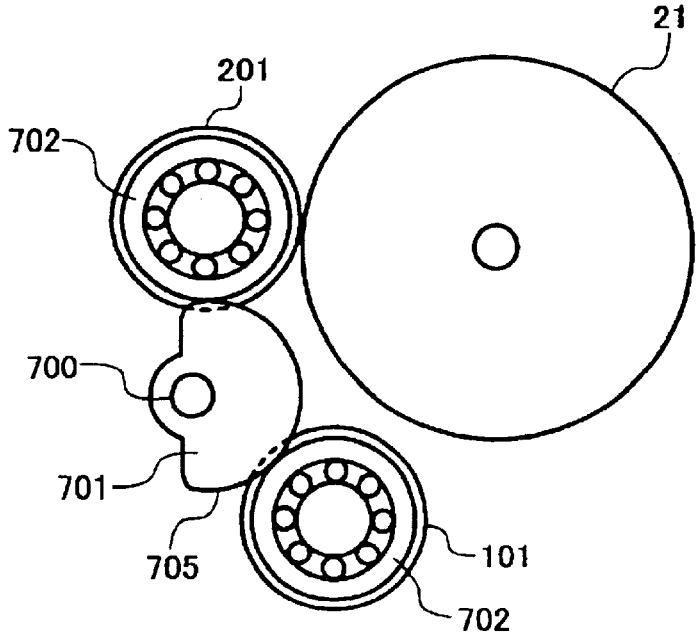

FIGS. 51A and 51A show a tenth embodiment of the present invention. In the ninth embodiment, the guide groove formed in the eccentric cam 701 for receiving the roller member 702 is apt to increase the size of the cam 701 and therefore the overall size of the apparatus 1. In the illustrative embodiment, as shown in FIGS. 51A and 51B, the eccentric cam 701 is mounted on the cam shaft 700 whose axis is parallel to the axis of the developing unit. The roller members 702 are mounted on the developing rollers 101 and 201, constituting cam contact surfaces. The eccentric cam 701 is formed with a cam surface 705 contacting the two roller members 702. In this configuration, too, even when unnecessary torque is generated around the axis of the developing unit, the cam surfaces 705 and roller member 702 constantly remain in contact with each other, so that the gap for development can be maintained accurate by a small size, low cost arrangement.

Eleventh Embodiment

An eleventh embodiment of the present invention will be described with reference to FIGS. 52A and 52B. In the third embodiment described with reference to FIGS. 14 through 17, the side walls 27, supporting the drum 21 and cam shaft 613, eccentric cams 612 mounted on the cam shaft 613 and side walls 26*a* and 26*b*, formed with the cam contact surfaces 611*a* and 611*b* and supporting the developing rollers 101 and 201, intervene between the drum 21 and the developing rollers 101 and 201. In this case, the side walls 26*a* and 26*b* must be machined accurately enough to make the configuration between the developing rollers 101 and 201 and the cam contact surfaces 611 and 611*b* accurate, resulting in an increase in cost.

Figure 52A:
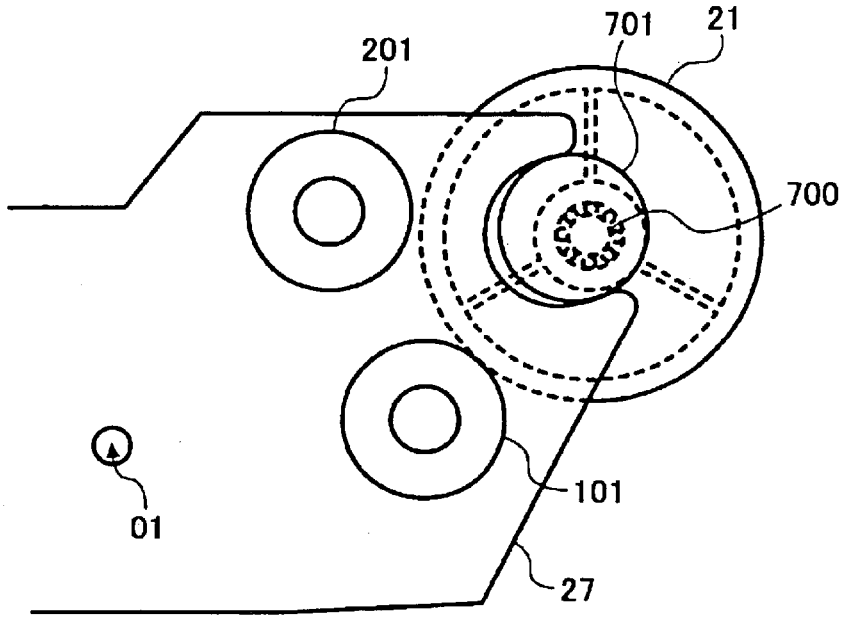
FIGS. 52A and 52B are enlarged views showing an eleventh embodiment of the present invention.
Figure 52B:
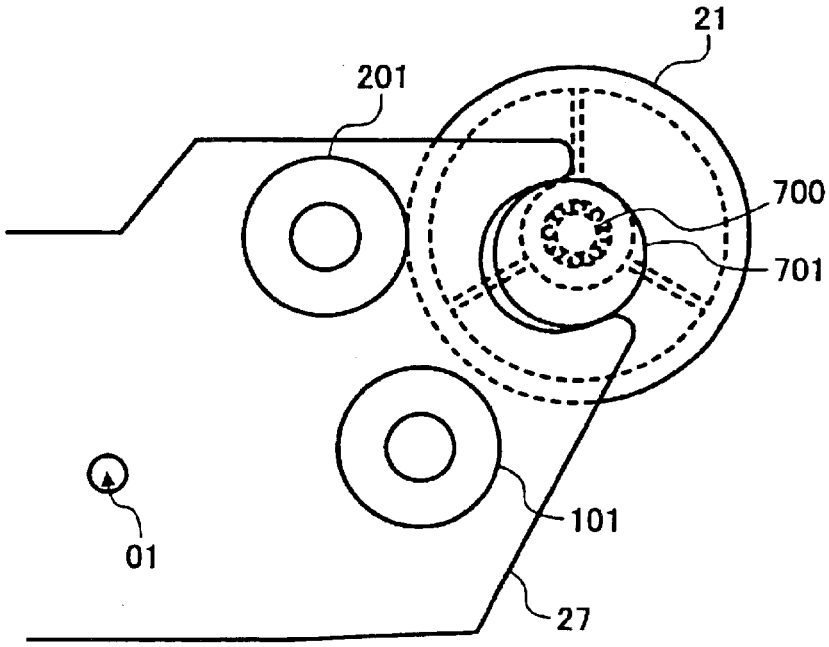

As shown in FIGS. 52A and 52B, in the illustrative embodiment, the eccentric cams 701 are mounted on both ends of the cam shaft 700 whose axis is parallel to the axis of the developing unit. The drum 21 is rotatably mounted on the cam shaft 700. Cam surfaces, which each eccentric cam 701 is expected to contact, are formed in each side wall 27 of the developing unit. The shaft of the drum 21 and cam shaft 701 are therefore implemented as a single part, i.e., the side wall 27 is not included in the roller members intervening between the developing rollers 101 and 201 and the drum 21, so that the number of parts between the drum 21 and the developing rollers 101 and 201 is reduced. This not only realizes an accurate gap for development, bur also makes it needless to accurately machine the side wall 27, which has a sophisticated configuration, thereby reducing the cost of the apparatus 1.

Figure 53A:
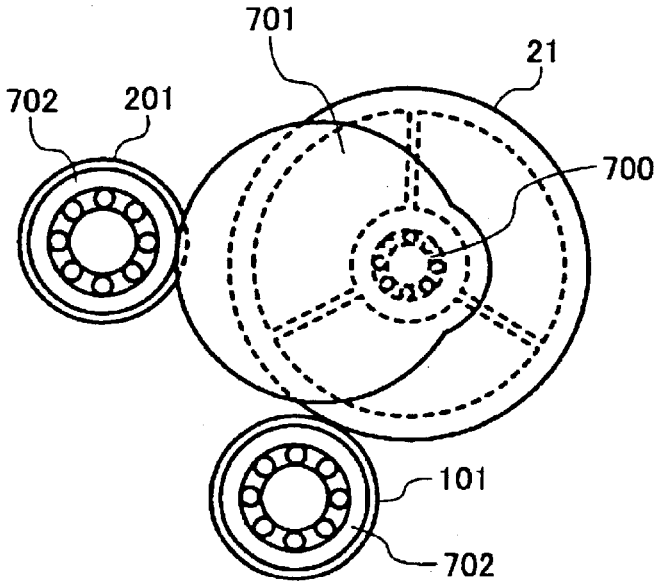
FIGS. 53A and 53B are enlarged views showing a specific application of the eleventh embodiment to the eighth embodiment.
Figure 53B:
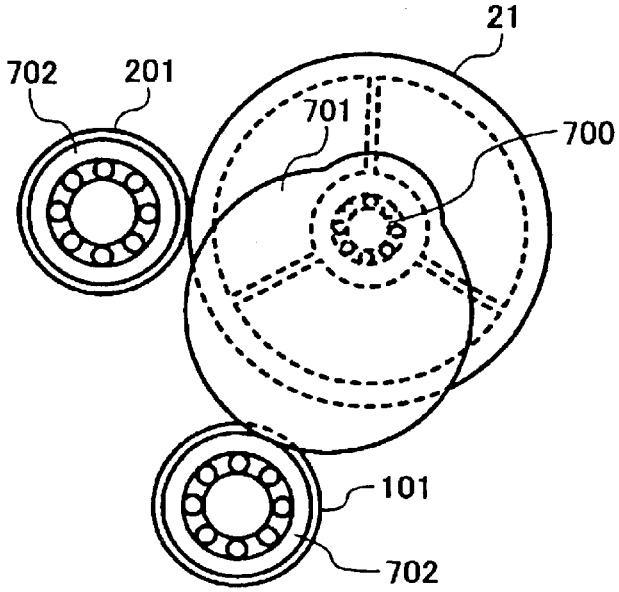

The illustrative embodiment is applicable to the eighth embodiment, as will be described hereinafter. As shown in FIGS. 53A and 53B, the eccentric cams 701 are mounted on both ends of the cam shaft 700 whose axis is parallel to the axis of the developing unit. The drum 21 is rotatably mounted on the cam shaft 700. The cam contact surfaces are constituted by the roller members 702 rotatably mounted on the shafts of the developing rollers 101 and 201. In this case, only the eccentric cam 701 and roller members 702, which are simple in configuration, low cost and capable of being accurately machined, intervene between the drum 21 and the developing rollers 101 and 201, reducing cost and enhancing accuracy to a noticeable degree.

Figure 54A:
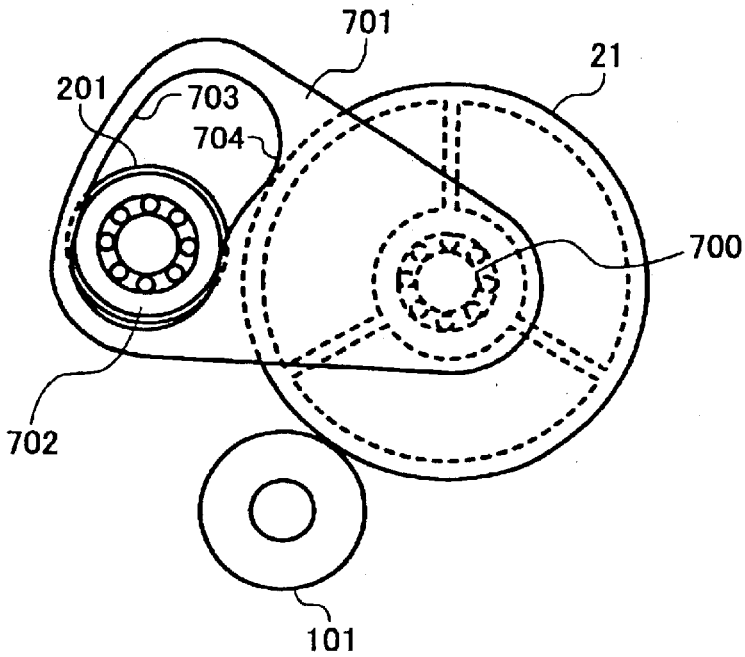
FIGS. 54A and 54B are enlarged views showing another specific application of the eleventh embodiment to the eighth embodiment.
Figure 54B:
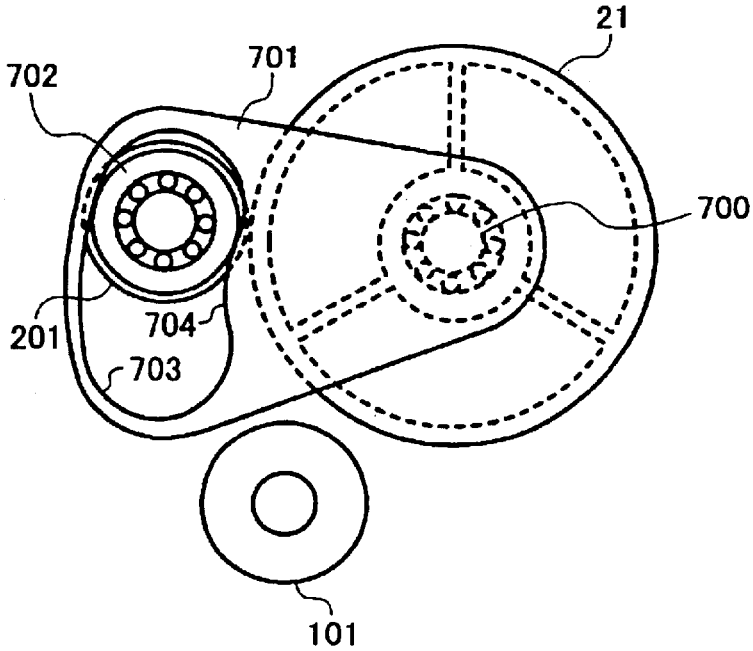
Figure 55A:
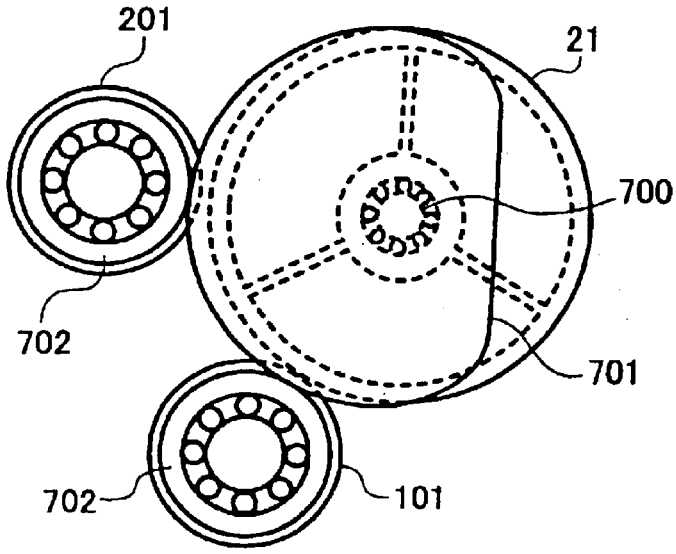
FIGS. 55A and 55B are enlarged views showing still another specific application of the eleventh embodiment to the eighth embodiment.
Figure 55B:
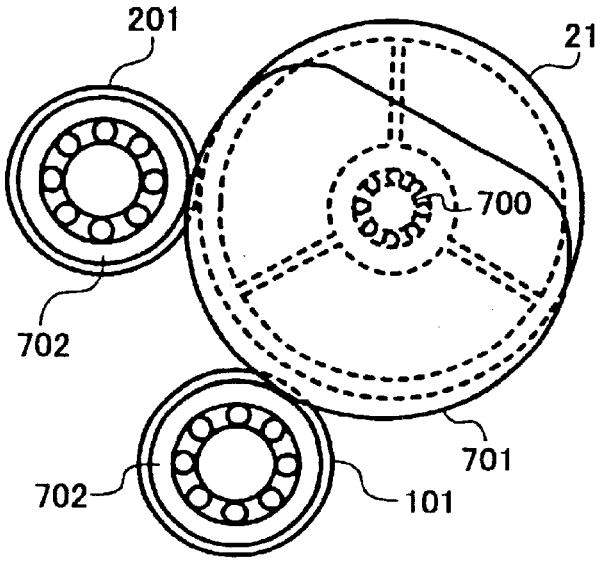

As shown in FIGS. 54A and 54B, the ninth embodiment, including the eccentric cam formed with the guide groove, is applicable to the illustrative embodiment as well. As shown, the eccentric cam 701 mounted on the same shaft as the drum 21 is formed with two concentric cam surfaces 703 and 704 contacting the roller member 702. Further, as shown in FIGS. 55A and 55B, the tenth embodiment including the eccentric having the cam surface that contacts two roller members is applicable to the illustrative embodiment as well. As shown, the eccentric cam 701 mounted on the same shaft as the drum 21 is formed with the cam surface 705 contacting two roller members.

Twelfth Embodiment

Figure 56A:
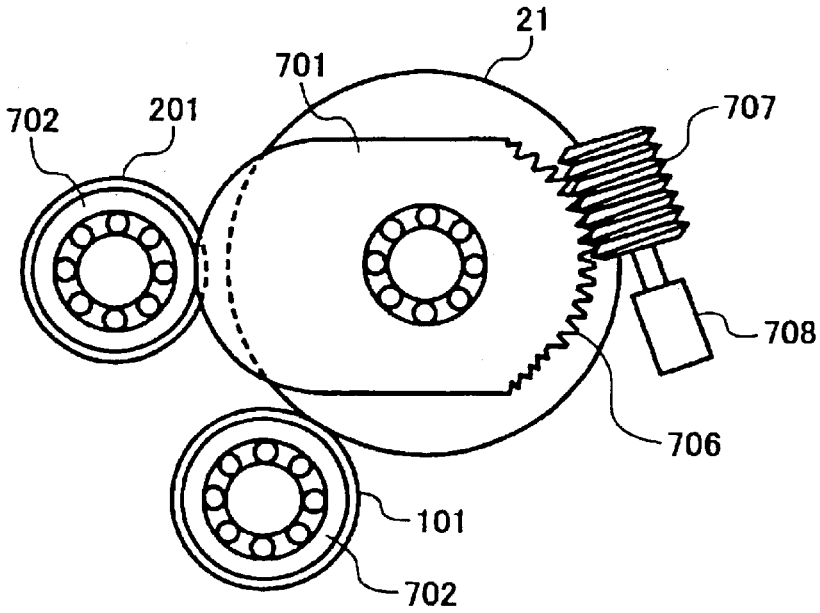
FIGS. 56A and 56B are enlarged views showing a twelfth embodiment of the present invention.
Figure 56B:
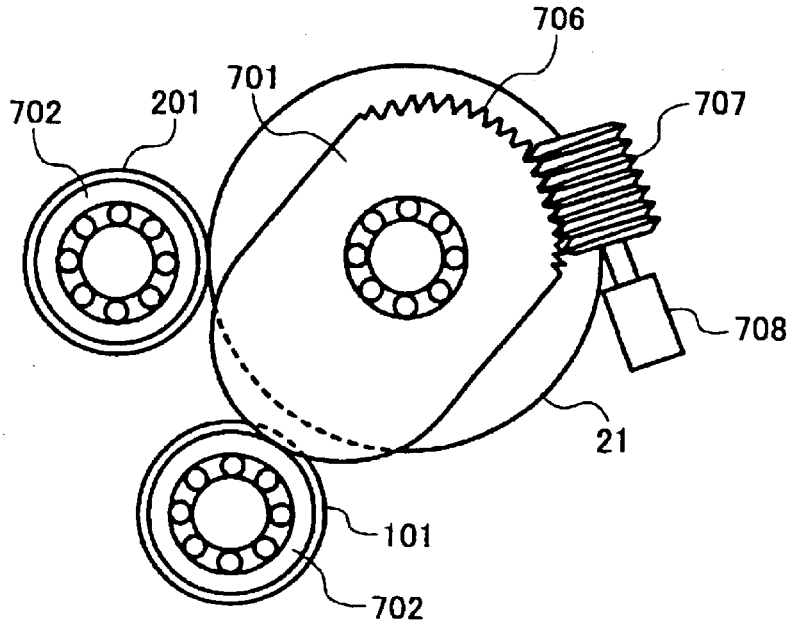

FIGS. 56A and 56B show a twelfth embodiment of the present invention. The eleventh embodiment described above has a problem that the drum 21 rotatably mounted on the cam shaft, which supports the eccentric cams 701 on opposite ends, limits the layout of the mechanism for driving the drum 21. In the third to fifth embodiments each including eccentric cams positioned in the vicinity of opposite ends of a single cam shaft and rotating the cam shaft by a preselected angle to move the developing unit, initial parallelism between the two developing rollers and the drum can be adjusted during assembly. However, when the initial parallelism is disturbed due to the varying environmental conditions or aging, readjustment must be effected by disassembly and repair. By contrast, by driving the eccentric cams in the vicinity of opposite ends with independent drive sources, it is possible to adjust the initial parallelism without any adjustment only if the rotation stop position of the individual eccentric cam is controlled.

As shown in FIGS. 56A and 56B, in the illustrative embodiment, the eccentric cams 701 are rotatably mounted on opposite ends of the shaft of the drum 21. A worm wheel 706 is formed integrally with each eccentric cam 701 and held in mesh with a worm shaft 707, which is driven by a stepping motor 708. The roller members 702, rotatably mounted on the shafts of the developing rollers 101 and 201, constitute the cam contact surfaces which the eccentric cam 701 is expected to contact. In this case, the drum 21 has a shaft rotatably integrally therewith and therefore does not limit the layout of the drum driving mechanism. Further, because the individual eccentric cam 701 is driven by an exclusive drive source, the initial parallelism can be adjusted only if the rotation stop position of the individual eccentric cam 701 is controlled.

Figure 57A:
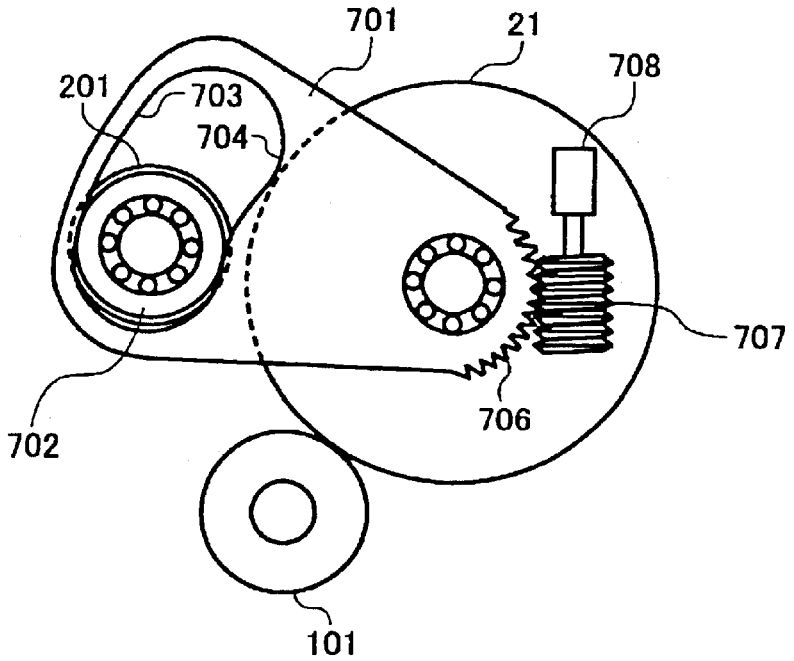
FIGS. 57A and 57B are enlarged views showing a specific application of the twelfth embodiment to the ninth embodiment.
Figure 57B:
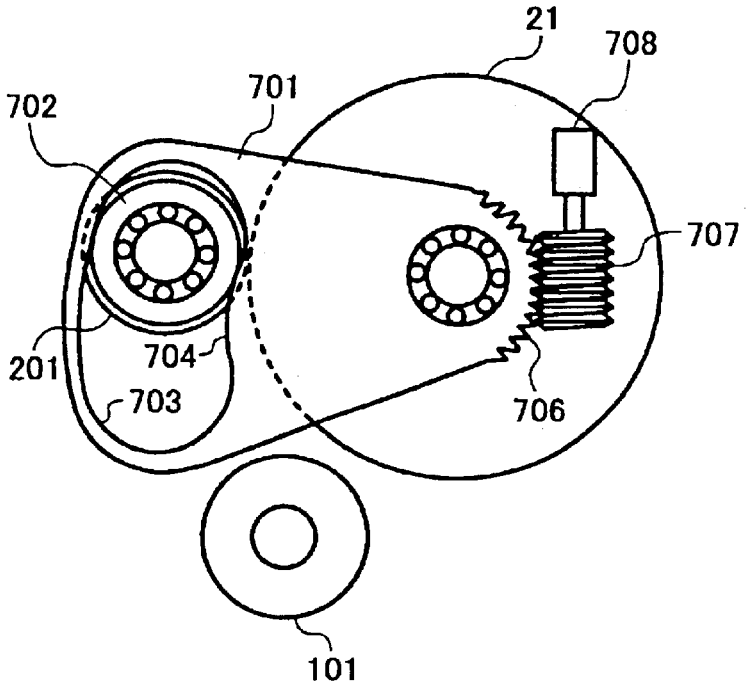
Figure 58A:
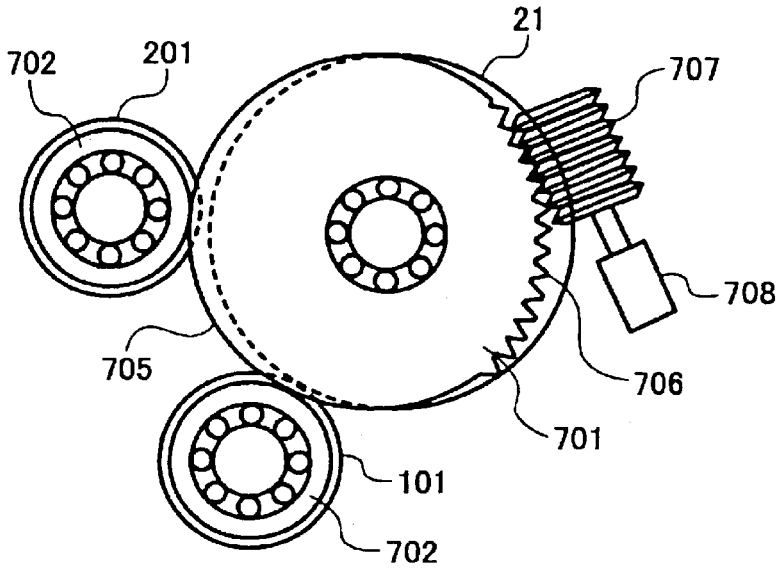
FIGS. 58A and 58B are enlarged views showing a specific application of the twelfth embodiment to the embodiment of FIGS. 55A and 55B
Figure 58B:
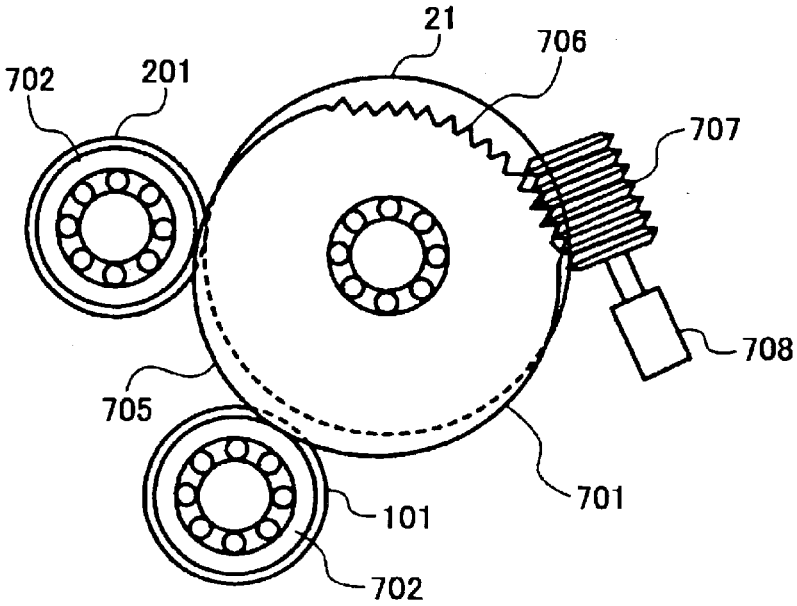

As shown in FIGS. 57A and 57B, the ninth embodiment is applicable to the illustrative embodiment as well, in which case the eccentric cam 701, mounted on the same shaft as the drum 21, is formed with the two cam surfaces 703 and 704 contacting the roller member 702. Also, as shown in FIGS. 58A and 58B, the tenth embodiment is applicable to the illustrative embodiment as well, in which case the eccentric cam 701, mounted on the same shaft as the drum 21, is formed with the cam surface 705 contacting the two roller members 101 and 201.

Thirteenth Embodiment

A thirteenth embodiment of the present invention also applied to the image forming apparatus 1, FIG. 1, will be described hereinafter. The description of the first embodiment made with reference to FIGS. 1 through 6 substantially directly applies to the illustrative embodiment as well. Parts and elements identical with those of the first embodiment are designated by identical reference numerals and will not be described in order to avoid redundancy. Briefly, the illustrative embodiment is capable of moving both of the A- and C-color developing devices 23 and 24 to the inoperative or non-developing positions.

Figure 59:
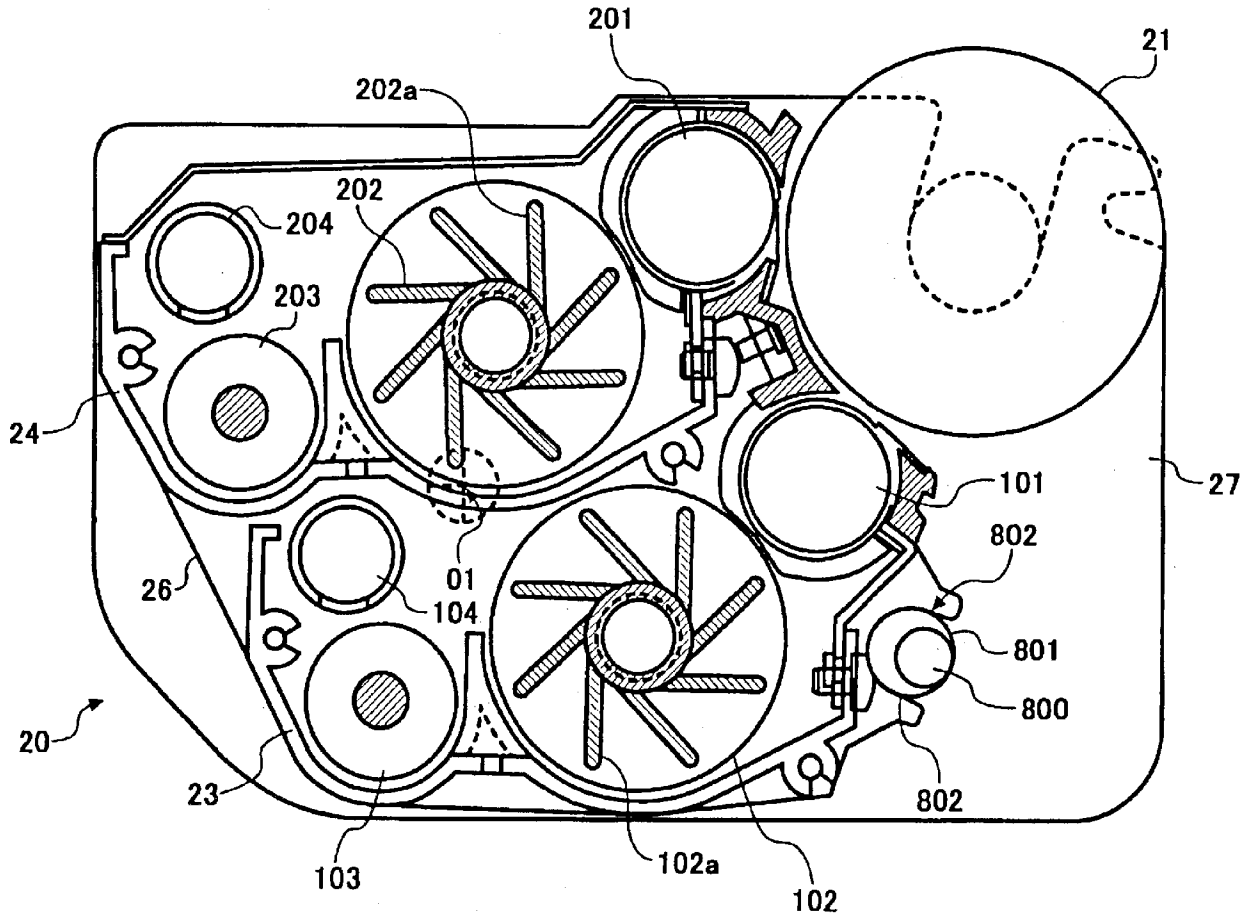
FIG. 59 is a view showing a thirteenth embodiment of the present invention in a condition wherein an A- and a C-color developing devices included in the first developing unit both are held at their non-developing positions.

FIG. 59 shows the A- and C-color developing devices 23 and 24 both of which are held in their inoperative positions in accordance with the illustrative embodiment. In a black-and-white print mode, for example, the A- and C-color developing devices 23 and 24 included in the first image forming unit 20 do not have to be driven. In this case, the illustrative embodiment includes unit rotating means for angularly moving the first developing unit 26 about the axis O1, so that the developing devices 23 and 24 do not function at all. The angular movement of the developing unit 26 is stopped when the developer on the downstream developing roller 201 and the developer on the upstream developing roller 101 both are released from the drum 21.

More specifically, in the illustrative embodiment, the drive gear 500G is so positioned as to mesh with the gear 101G when the developing roller 101 is spaced from the drum 21 by the preselected gap for development or to mesh with the gear 201G when the developing roller 201 is spaced from the drum 21 by the above gap. Further, when the preselected gap exists between the developing roller 101 and the drum 21, the developing roller 201 is shifted away from the above position while the gear 201G is revolved round the axis O1 by a preselected angle θ away from the drive gear 500G.

Now, the developing unit 26 must be rotated by an angle θr, as will be described hereinafter. Considering the condition wherein the A- and C-color developing units 23 and 24 both are inoperative, i.e., the entire developing unit 26 is inoperative, it is necessary to guarantee the following distance between the drum 21 and each of the developing rollers 101 and 201. The distance insures the preselected gap for development during development and spaces, in the inoperative condition, the developers on the developing rollers 101 and 201 from the drum 21 such that the former does not deposit on the latter. This prevents the developers on the developing rollers 101 and 102 from depositing on the drum 21 and prevents the developer on the drum 21 from depositing on the developing rollers 101 and 201, thereby obviating undesirable color mixture.

Figure 60:
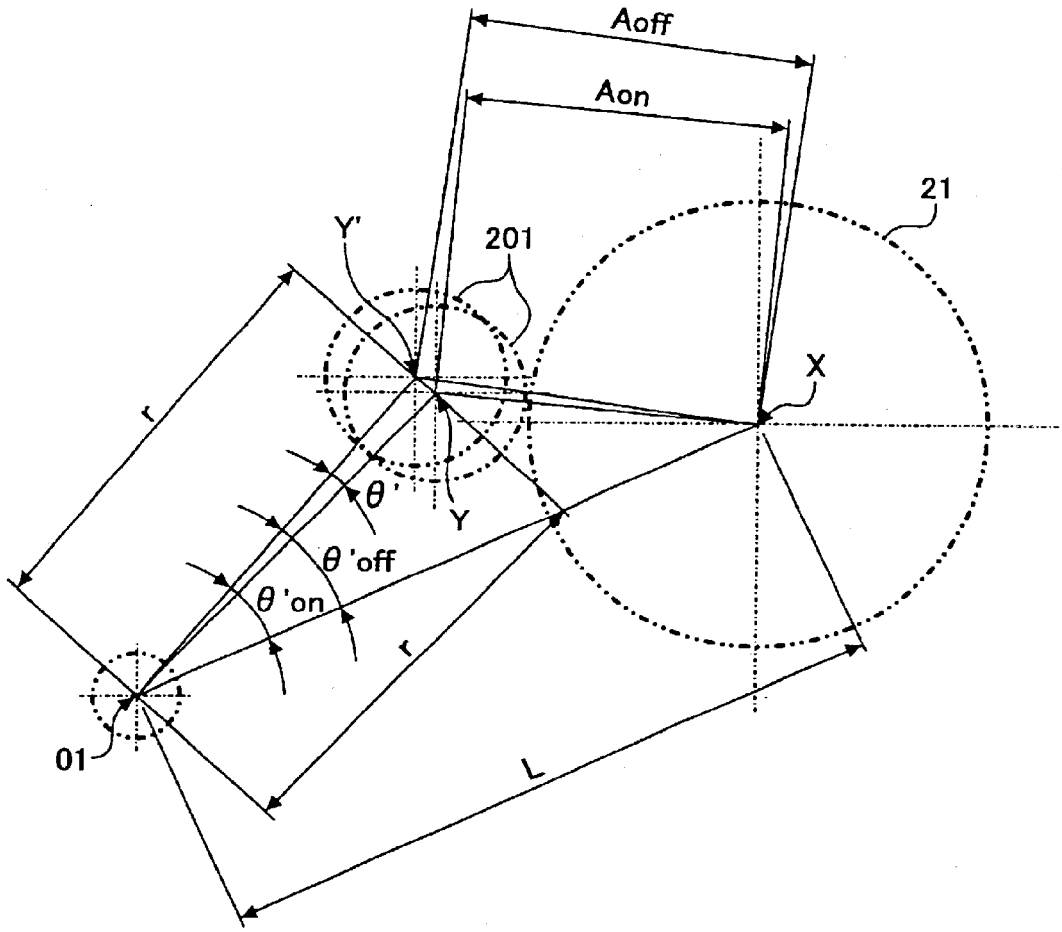
FIG. 60 shows a relation in distance between the rotation angle of the developing unit of the first image forming unit, the axis of the developing unit, the axis of the drum, and the axis of the developing roller.

FIG. 60 shows a relation between the rotation angle Or of the developing unit 26, the axis O1 of the developing unit 26, the axis X of the drum 21, and the axis Y of the developing roller. In FIG. 60, L denotes the distance between the axes O1 and X, r1 denotes the distance between the axis Y of one developing roller and the axis O1, r2 denotes the distance between the axis Y of the other developing roller and the axis O1, Aon denotes the distance between the axes X and Y necessary when the developing device is held at the operative or developing position, and Aoff denotes the distance between the axes X and Y necessary when the developing device is held in the inoperative or non-developing position.

As for a triangle formed by the axis O1, the axis X of the drum and the axis Y of the developing roller, assume that an angle XOY is θ'on. Then the following relation holds:

$$Aon^2 = r\mathbf{2}^2 + L^2 - 2 \cdot r \cdot L \cdot \cos\theta' on \quad (1)$$

As for a triangle formed by the axis O1, the axis X and the axis Y' of the developing roller held in the inoperative position, assume that an angel Y'OX is θ'off. Then, the following relation holds:

$$Aoff^2 = r\mathbf{2}^2 + L^2 - 2 \cdot L \cdot \cos\theta' \mathrm{off} \quad (2)$$

It follows that the minimum necessary angle θ' by which the developing unit must be rotated to bring one developing roller to the inoperative position is expressed as:

$$\begin{aligned}\theta' &= \theta' off - \theta' on \quad (3)\\ &= \cos^{-1}\{r1^2 + L^2 - Aoff^2\}/(2 \cdot r1 \cdot L)\} - \\ &\quad \cos^{-1}\{r1^2 + L^2 - Aon^2\}/(2 \cdot r1 \cdot L)\end{aligned}$$

If the distances between the two developing rollers 101 and 2301 and the axis O1 are different from each other, then the minimum necessary rotation angle θ' required of the developing unit for moving the developing roller to the inoperative position is greater when the above distance is smaller than when it is greater.

In light of the above, assuming that the distance between the axis Y of one developing roller and the axis O1 is r1, and that the distance between the axis Y of the other developing roller and the axis O1 is r2, then the minimum rotation angles θ'1 and θ'2 for moving the one and other developing rollers to their inoperative positions are, by substituting r1 and r2 for the equation (3), respectively produced by:

$$\theta'\mathbf{1} = \cos^{-1}\{(r\mathbf{1}^2 + L^2 - Aoff^2)/(2 \cdot r\mathbf{1} \cdot L)\} - \cos^{-1}\{(r\mathbf{1}^2 + L^2 - Aon^2)/(2 \cdot r\mathbf{1} \cdot L)\}$$

$$\theta'\mathbf{2} = \cos^{-1}\{(r\mathbf{2}^2 + L^2 - Aoff^2)/(2 \cdot r\mathbf{1} \cdot L)\} - \cos^{-1}\{r\mathbf{2}^2 + L^2 - Aon^2\}/(2r\mathbf{2} \cdot L)\}$$

Therefore, considering the stop of function of the developing unit 26, by rotating the developing unit by more than the sum of θ'1 and θ'2, it is possible to surely effect the switching operation.

For the above reason, the rotation angle θr of the developing unit is assumed to be:

$$\begin{aligned}\theta r \geq\ & [\cos^{-1}\{(r1^2 + L^2 - Aoff^2)/(2 \cdot r1 \cdot L)\} - \quad (4)\\ & \cos^{-1}\{(r1^2 + L^2 - Aon^2)/(2 \cdot r1 \cdot L)\}] + \\ & [\cos^{-1}\{(r2^2 + L^2 - Aoff^2)/(2 \cdot r2 \cdot L)\} - \\ & \cos^{-1}\{r2^2 + L^2 - Aon^2\}/(2 \cdot r2 \cdot L)\}]\end{aligned}$$

Figure 61:
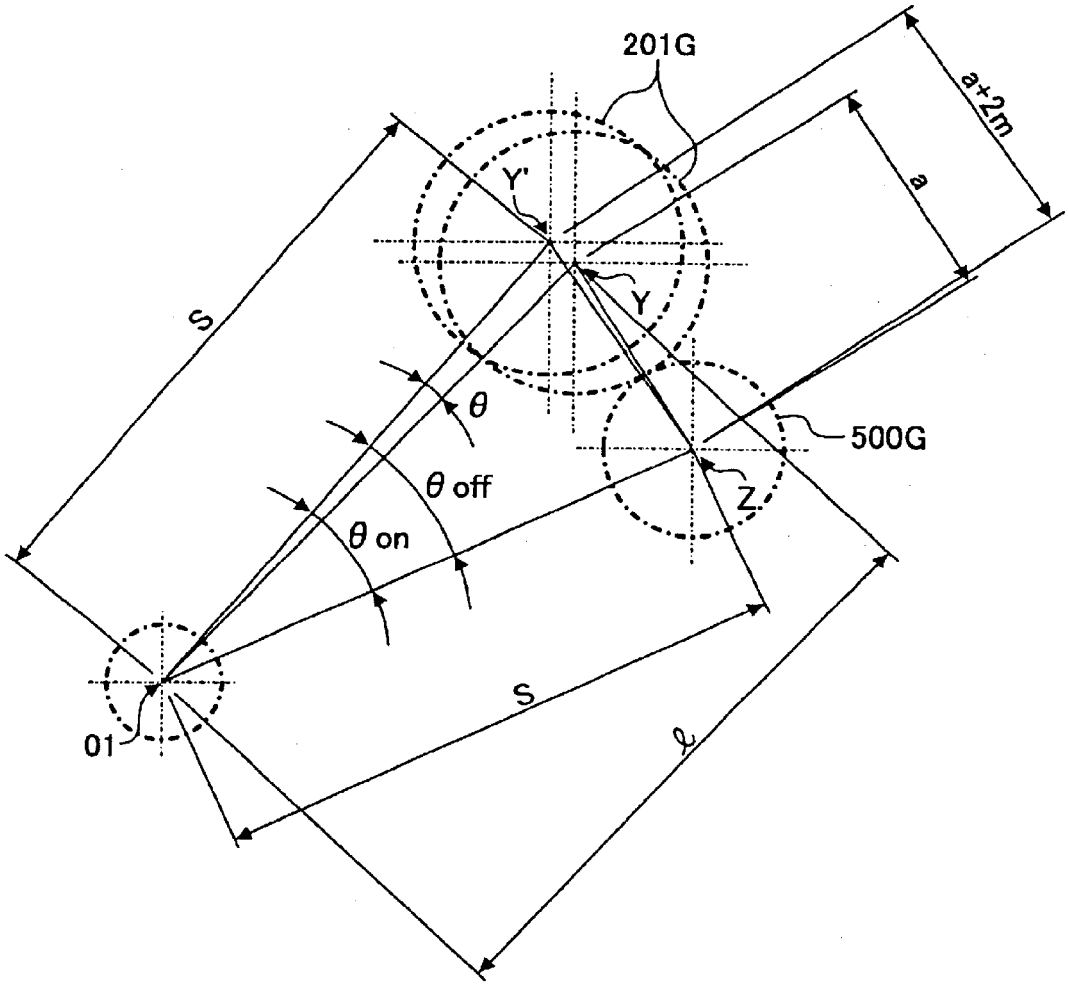
FIG. 61 shows a relation in distance between the rotation angle of the developing unit, the axis of the developing unit, the axis of a drive gear, and the axis of a driven gear.

Next, considering the switching of the drive of the developing roller, it is necessary to hold the meshing of the gears in the operative condition, but to prevent the tips of the teeth of the driven roller from interfering with the tips of the teeth of the drive gear 500G in the inoperative condition. FIG. 61 shows a relation between the rotation angle θg of the developing unit 26, the axis O1 of the developing unit, the axis Z of the drive gear, and the distance between the developing roller and the axis Y of the driven gear. In the illustrative embodiment, the axis Y of the driven gear is the same as the axis Y of the developing roller. In FIG. 61, l denotes the distance between the axes O1 and Z, s denotes the distance between the axes Y and O1, a denotes the distance between the axes Z and Y when the drive gear and driven gear are meshing with each other, and m denotes the module of the gear member.

As for a triangle formed by the Axes O, Z and Y, assume that an angle YOZ is θon. Then, there holds a relation:

$$a^2 = s^2 + l^2 - 2 \cdot s \cdot l \cdot \cos\theta on \quad (5)$$

As for a triangle formed by the axes O, Z and Y', which pertains to the inoperative position of the developing roller, assume that an angle Y'OZ is θoff. Then, there holds a relation:

$$(a + 2 \cdot m)^2 = s^2 + l^2 - 2 \cdot l \cdot \cos\theta \mathrm{off} \quad (6)$$

It follows that the minimum necessary angle θg by which the developing unit should be rotated to implement the switch from the meshing condition to the non-meshing condition is expressed as:

$$\theta g = \theta off - \theta on \tag{7}$$
$$= \cos^{-1}[\{s^2 + l^2 - (a + 2 \cdot m)^2\}/(2 \cdot s \cdot l)\}] - \cos^{-1}\{(s^2 + l^2 - a^2)/(2 \cdot s \cdot l)\}$$

If the distances between the driven gears of the two developing rollers and the axis O1 are different from each other, then the minimum necessary rotation angle θg required of the developing unit is, of course, greater when the above distance is smaller than when it is greater.

Assume that the distance between the axis of one driven gear and the axis O1 is s1, that the distance between the axis of the other driven gear and the axis O1 is s2, and that s1 is smaller than s2. Then, the minimum necessary angle of rotation θg of the developing unit is produced by substituting s1 for s included in the above equation (7). Therefore, to surely implement the switch from the meshing condition to the non-meshing condition, the rotation angle θg should satisfy:

$$\theta g \geq \cos^{-1}[\{s1^2 + l^2 - (a + 2 \cdot m)^2\}/(2 \cdot s1 \cdot l)] - \cos^{-1}\{(s1^2 + l^2 - a^2)/(2 \cdot s1 \cdot l)\} \tag{8}$$

When the first developing unit 26 practically stops operating, the two developing rollers 101 and 201 both can be moved to their inoperative positions. At this instant, the drive gear 500G may remain in mesh with either one of the two drive gears of the developing rollers 101 and 201. In such a case, by stopping the rotation of the drive gear 500G itself, it is possible to interrupt the drive of the members belonging to the C-color developing device 24. This protects the developer in the inoperative developing device from unnecessary agitation for thereby extending the life of the developer.

As stated above, by driving the developing unit 26 by the rotation angle θ satisfying both of the relations (4) and (8), it is possible to achieve both of the sure switching of the developing function and the sure switching of the drive for development.

Fourteenth Embodiment

A fourteenth embodiment of the present invention will be described hereinafter which is also similar to the first embodiment except for the following. Parts and elements identical with those of the first embodiment are designated by identical reference numerals and will not be described specifically in order to avoid redundancy.

In the thirteenth embodiment, the distances between the driven gears 101G and 201G and the axis O1 are assumed to be different from each other. The configuration of the thirteenth embodiment guarantees the rotation angle θg necessary for the driven gear closer to the axis O1 than the other driven gear. As a result, the other drive gear remote from the axis O1 is spaced from the drum 21 (and drive gear 500G) more than necessary. In this respect, an arrangement for further promoting the free layout of the developing devices may be contemplated.

More specifically, by locating the two driven gears 101G and 201G at the same distance from the axis O1, it is possible to construct a more space-saving switching mechanism. In this case, the rotation angle r required of the developing unit 26 is expressed by the following relation (9). Considering the practical stop of function of the developing rollers 101 and 201, it is assumed that the distance between the axis O1 and the axis X of the drum is L, the distance between the axis Y of the developing roller and the axis O is r, the distance between the axes X and Y necessary when the developing device is in the developing condition is Aon, and that the distance between the axes X and Y necessary when the developing device is in the inoperative condition is Aoff. Then, there holds:

$$\theta = 2 \cdot (\theta' off - \theta' on) \tag{9}$$
$$= 2 \cdot [\cos^{-1}\{r^2 + L^2 - Aoff^2\}/(2 \cdot r \cdot L)] - \cos^{-1}\{(r^2 + L^2 - Aon^2)/(2 \cdot r \cdot L)\}]$$

Also, considering the drive switching of the developing rollers, assume that l denotes the distance between the axes O1 and Z, s denotes the distance between the axes Y and O1, a denotes the distance between the axes Z and Y when the drive gear and driven gear are meshing with each other, and m denotes the module of the gear member. Then, the rotation angle θ represented by the following equation is required:

$$\theta = \theta off - \theta on \tag{10}$$
$$= \cos^{-1}[\{s^2 + l^2 - (a + 2 \cdot m)^2\}/(2 \cdot s \cdot l)\}] - \cos^{-1}\{(s^2 + l^2 - a^2)/(2 \cdot s \cdot l)\}$$

By driving the developing unit by the angle θ satisfying the equations (9) and (10), it is possible to implement a switching mechanism saving more space than in the thirteenth embodiment and promoting free layout of the developing devices. In addition, the sure switching of the developing function and the sure switching of drive can be attained at the same time. The developing devices are so laid out as to allow the developing unit to be rotated under the above conditions.

Figure 62:
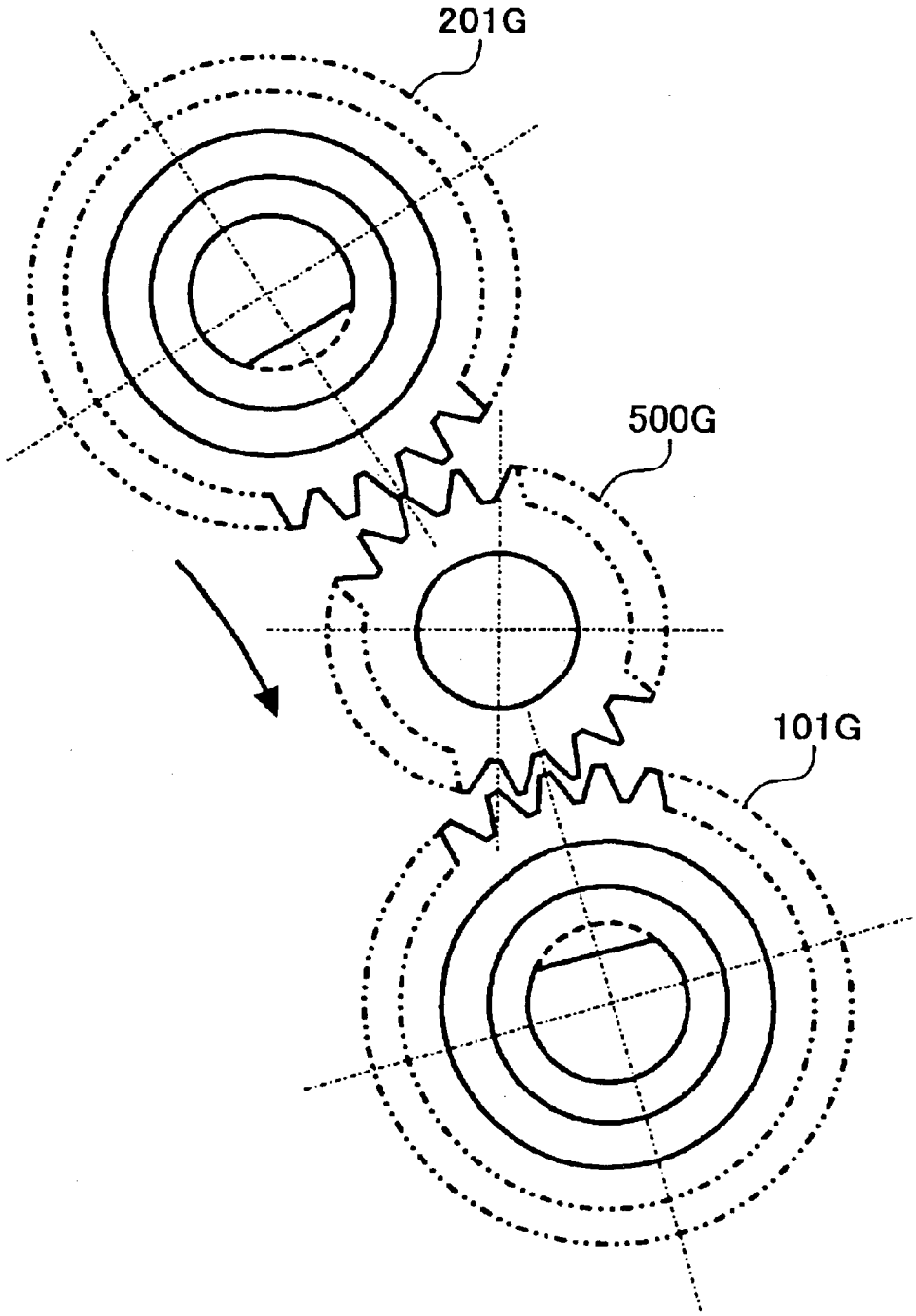
FIG. 62 shows a relation between the tips of the teeth of the drive gear and those of the driven gear.

FIG. 62 shows a positional relation between the teeth of the drive gear 500G and those of the driven gears 101G and 201G. As shown, when the driven members and drive member are implemented as gears, it is likely that the tips of the teeth abut against each other when the driven gear 101G or 201G and drive gear 500G are brought into mesh with each other, making it impossible to angularly move the developing unit 26. To solve this problem, the drive gear 500G may be continuously rotated when the developing unit 26 is being angularly moved.

Assume that when the drive gear 500G is rotated at relatively high speed during development, the driven gears 101G and 201G are rotated during the angular movement of the developing unit 26 at speed as high as during development. Then, the teeth of the drive gear 500G and those of the driven gears 101G and 201G repeatedly hit against each other around positions where meshing is to be canceled. This not only produces noise, but also causes the teeth to be damaged. In this sense, the driven gears 101G and 201G should preferably be rotated during the movement of the developing unit 26 at sufficiently lower speed than during development.

To insure high image quality, it is necessary to maintain the gap for development between the developing roller 101 or 201 and the drum 21 accurate during development. Any unnecessary torque generated around the axis O1 during development would disturb the accuracy of the above gap.

When the axis O1 is remote from the center of gravity of the developing unit 26, torque constantly acts on the developing unit 26 around the axis O1 due to gravity. This torque tends to enlarge the gap of one of the upstream and downstream developing rollers 101 and 102 while reducing the gap of the other roller 101 or 102, impairing the accuracy of the gap during development. In light of this, in the illustrative embodiment, the axis O1 is positioned on an axis extending through the center of gravity of the developing unit 26, so that the gap can be maintained accurate during development to thereby insure high image quality.

As stated above, in the thirteenth and fourteenth embodiments, the gap for development cannot be maintained accurate during development unless the drive mechanism for the developing unit 26 implements accurate rotation and accurate rotation stop position. When the developing unit 26 is driven via, e.g., gears, it is difficult to maintain the rotation and rotation stop position highly accurate for the extremely small rotation angle θ.

As shown in FIG. 59, the thirteenth and fourteenth embodiments each use an eccentric cam mechanism for driving the developing unit 26. Even when the rotation angle θ of the developing unit 26 is extremely small, an eccentric cam 801 can rotate by a relatively large angle and realizes the accurate rotation and rotation stop position of the developing unit 26 for thereby enhancing image quality.

During development, a force, tending to enlarge the gap for development, acts on the developing roller 101 or 201 held in the operative position. Further, the drive force of the drive gear 500G, acting on the driven gear 101G or 201G, includes torque around the axis O1 due to pressure angle. It is therefore necessary to constantly maintain the cam surface of the eccentric cam 801 and cam contact surfaces 802 to be driven in contact with each other. However, an exclusive mechanism for biasing the cam contact surfaces 802 toward the cam surface would increase a required drive force and would thereby render a cam drive mechanism bulky and high cost while aggravating power consumption.

In FIG. 59, the eccentric cam 801 is mounted on a cam shaft 800 rotatable about an axis parallel to the axis O1 of the developing unit 26. The developing unit 26 is formed with the cam contact surfaces 802 implemented as two flat surfaces contacting the eccentric cam 801 and substantially perpendicular to the direction of angular movement of the developing unit 26. Such flat, cam contact surfaces 802 contact the eccentric cam 801 in such a manner as to nip it therebetween.

In the above configuration, even when torque is generated around the axis O1, the eccentric cam 801 and cam contact surfaces 802 remain in contact with each other and therefore implement accurate rotation and accurate stop position for thereby insuring high image quality. In addition, the above arrangement reduces the size and cost of the cam driving mechanism as well as power consumption.

The cam surfaces 802 are positioned in the vicinity of opposite ends of the axis O1 of the developing unit 26 while two eccentric cams 801 are mounted on the cam shaft 800 in such a manner as to contact the cam surfaces 802 at opposite ends of the axis O1. This allows the gap for development to be maintained accurate over the entire image region in the axial direction of the developing rollers, further enhancing image quality.

Figure 63:
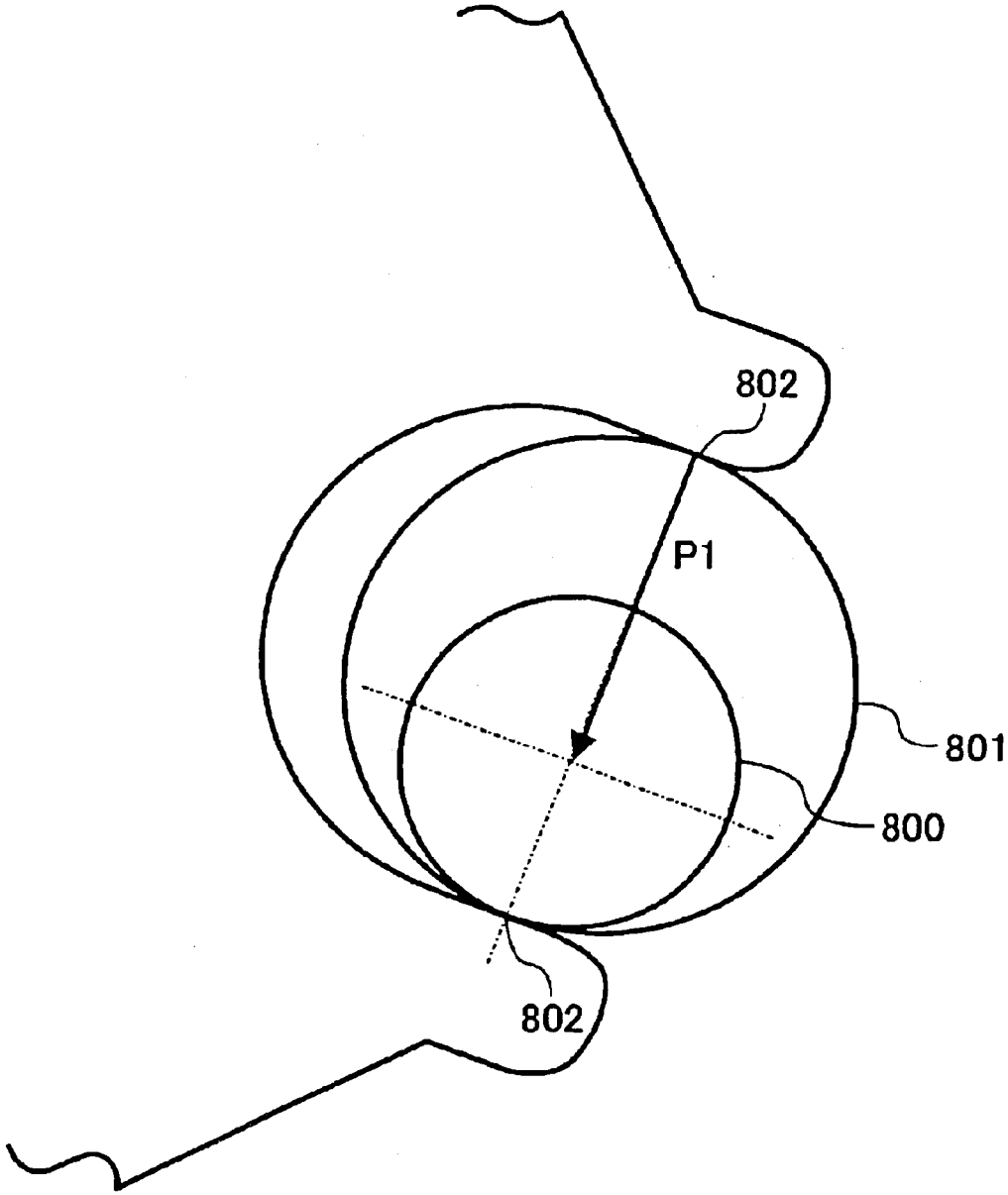
FIGS. 63 and 64 each show a particular direction in which the contact force of the cam contact surface acts on the cam surface of the eccentric cam.
Figure 64:
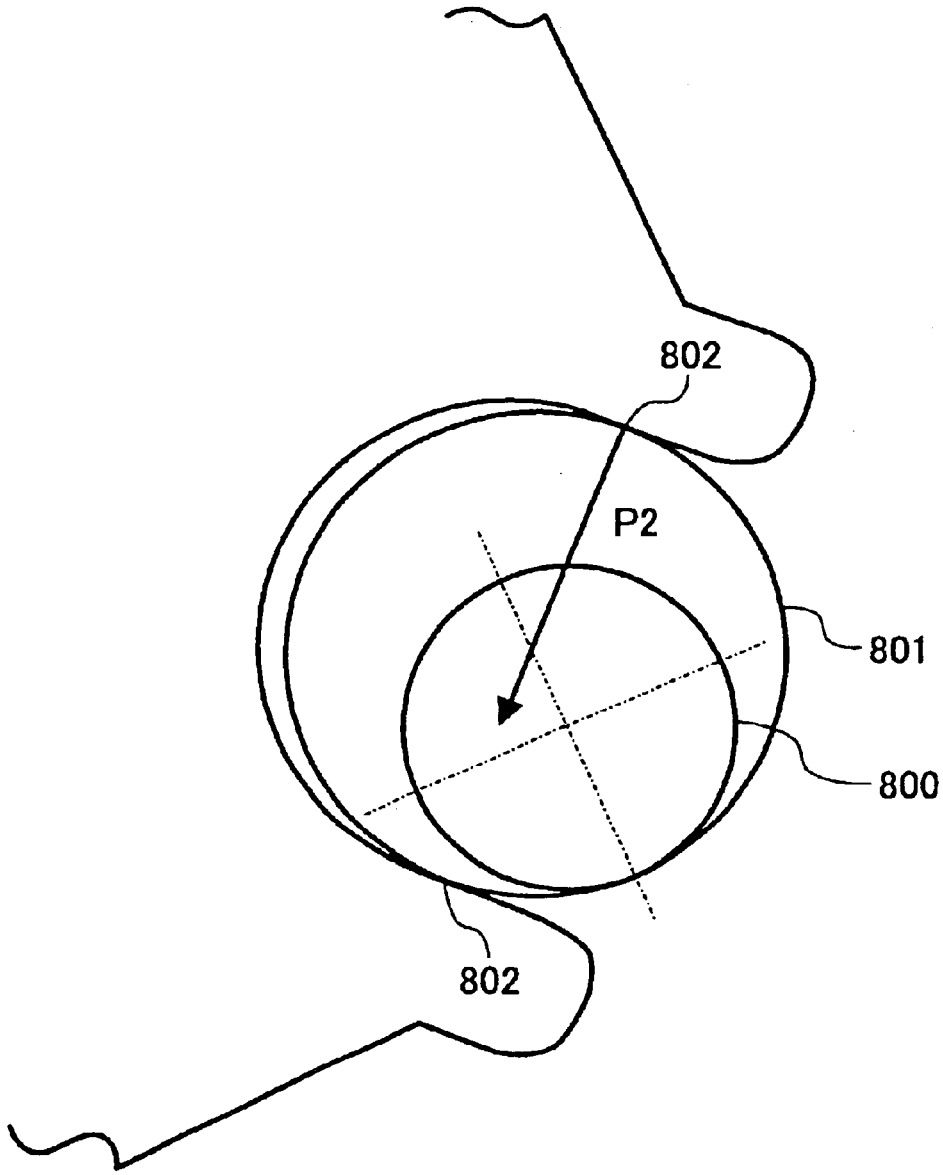

FIGS. 63 and 64 each show a particular direction in which the contact force of one of the cam contact surfaces 802 acts on the eccentric cam 801. When the eccentric cam mechanism is used as the mechanism for driving the developing unit 26 as in the thirteenth and fourteenth embodiments, the above direction effects the rotation stop position.

More specifically, as shown in FIG. 63, so long as the above force acts in a direction P1 extending in the vicinity of the axis of the cam shaft 800, a force that tends to rotate the cam shaft 800 is not generated even when unnecessary torque acts on the developing unit 26. The rotation stop position of the eccentric cam 68 can therefore be accurately maintained. However, as shown in FIG. 64, when the rotation angle of the cam shaft 800 at the time of angular movement of the developing unit 26 is relatively small, the direction P2 in which the force acts does not extend in the vicinity of the axis of the cam shaft 800. As a result, when unnecessary torque acts on the developing unit 26, a force that tends to rotate the cam shaft 800 is generated.

Figure 65:
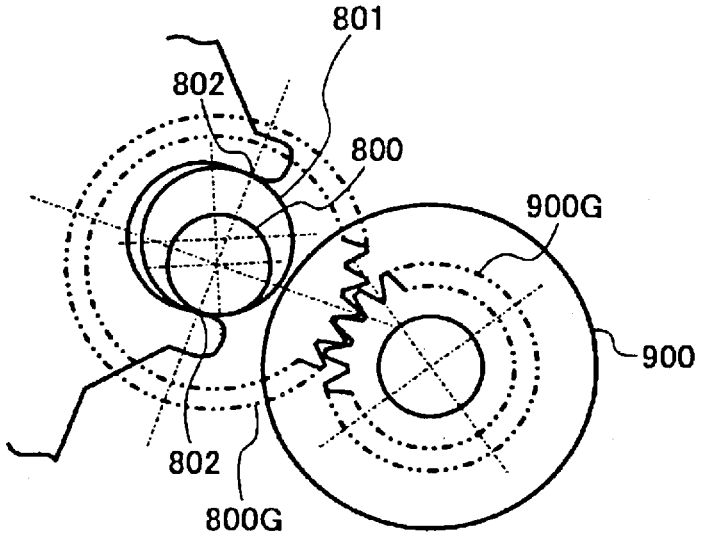
FIG. 65 shows a specific mechanism for driving the cam shaft.

In light of the above, as shown in FIG. 65, the drive source for rotating the cam shaft 800 may be implemented as a stepping motor 900. More specifically, in FIG. 65, a driven gear 800G is coaxially mounted on the cam shaft 800 and held in mesh with a drive gear 900G mounted on the output shaft of the stepping motor 900. The stepping motor 900 therefore rotates the cam shaft 800 via the two gears 900G and 800G. When the stepping motor 900 is in a halt, a hold current is fed to the stepping motor 900 so as to restrict the rotation of the output shaft. In this configuration, even when unnecessary torque acts on the developing unit 26 and generates a force tending to rotate the cam shaft 682, the cam shaft 800 is prevented from rotating and maintains the rotation stop position of the developing unit 26 accurate. This insures a highly accurate gap for development and therefore high image quality.

Figure 66:
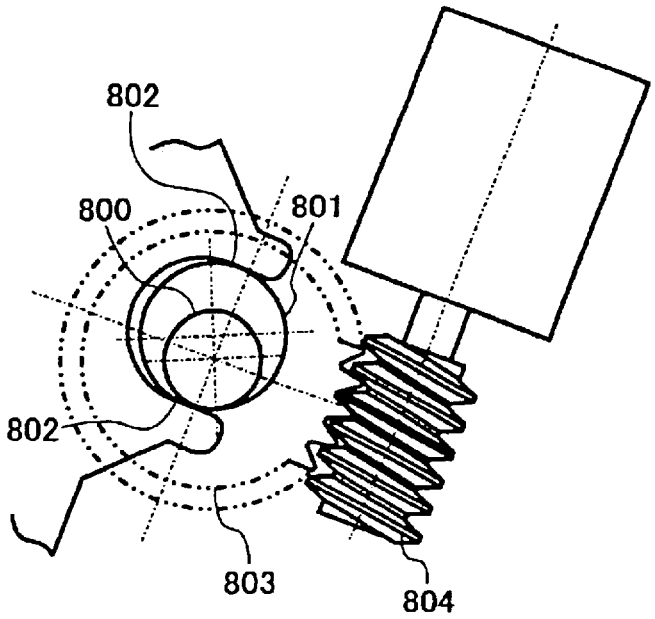
FIG. 66 shows another specific mechanism for driving the cam shaft.

FIG. 66 shows another specific mechanism for driving the cam shaft 800. As shown, a worm wheel 803 is coaxially mounted on the cam shaft 800 and driven by a worm shaft 804. Even when a force, tending to rotate the worm wheel 803 due to an extraneous force, acts when the worm wheel 803 is in a halt, the worm shaft 804 prevents the worm wheel 803 from rotating. This drive mechanism achieves the same advantages as the drive mechanism shown in FIG. 65.

When use is made of the stepping motor 900 for driving the cam shaft 800, as shown in FIG. 65, the number of steps of the stepping motor 684 is controllable to establish any desired amount of rotation. Therefore, the amount of rotation of the cam shaft 800 necessary for the developing unit 26 to move from the preselected position where one of the developing rollers 101 and 201 operate to the preselected position where the other developing roller operates can be easily, accurately determined in terms of the number of steps.

If the stepping motor 900 looses synchronism, it is impossible to control the number of steps. To solve this problem, a sensor or sensing means for sensing a reference angular position during the angular movement of the developing unit 26 may be used, in which case the number of steps necessary from the time when the reference position is sensed to the time when the developing unit 26 reaches the preselected position will be stored. With this configuration, it is possible to immediately resume, even when the stepping motor 684 looses synchronism, the angular rotation of the developing unit 26.

In the drive mechanism shown in FIG. 65, by suitably selecting the number of steps of the stepping motor 684 and therefore the amount of rotation of the cam shaft 682, it is possible to control the distance between the developing roller 101 or 201 and the drum 21, i.e., the gap for development, as will be described hereinafter. While high image quality is not achievable unless the gap for development is highly accurate, the optimum gap varies in accordance with temperature, humidity and other environmental conditions and toner content, charge potential, exposure potential and other process conditions for image formation, as known in the art. It is therefore possible to noticeably enhance image quality by maintaining the optimum gap at all times in accordance with the above various conditions.

An arrangement may therefore be made such that the optimum gap is determined on the basis of the outputs of sensing means responsive to the environmental and process conditions, and then the number of steps for implementing the optimum gap is determined. When the stepping motor 900 is driven by the number of steps thus determined so as to move the developing unit 26, the optimum gap can be maintained in accordance with the various conditions.

Further, the optimum process conditions for image formation depend on the kind of a desired image (mode), e.g., a color image, a black-and-white image, a photo image or a text image. It is a common practice with the apparatus 1 to automatically establish, when the operator selects a desired image mode, the optimum process conditions matching with the image mode for thereby realizing high image quality. The optimum gap for development also depends on the image mode and may therefore be controlled in accordance with the image mode for thereby noticeably enhancing image quality.

In light of the above, setting means for allowing the operator to select a desired image mode or image forming mode may be provided on the apparatus 1.

When the eccentricity of an eccentric cam or similar mechanical accuracy is used to determine the accuracy of the rotation stop position that, in turn, determines the gap for development, the accuracy is susceptible to dimensional variation ascribable to the varying environmental conditions or aging. Further, when the rotation angle θ of the developing unit is controlled in terms of the number of steps of the stepping motor 900, any step-out of the stepping motor 900 makes the number of steps uncontrollable.

To solve the above problems, the illustrative embodiment includes distance sensing means responsive to the distance of the shaft of the developing roller and the shaft of the drum. When the developing unit 26 angularly moved, the rotation stop position of the developing unit is determined in accordance with the output of the distance sensing means. This not only makes the rotation stop position, which determines the gap, accurate, but also absorbs dimensional accuracy other than the positioning accuracy of the distance sensing means to thereby reduce the production cost of the parts and excludes the influence of the step-out of the stepping motor 900.

Figure 67:
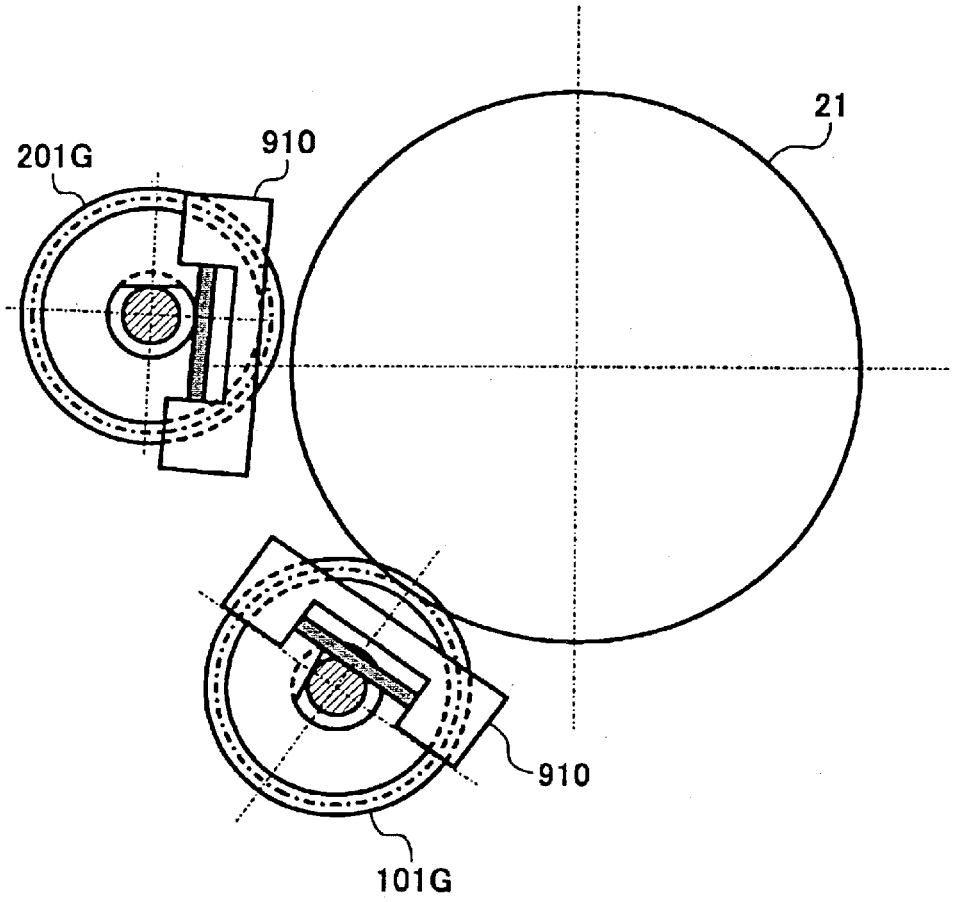
FIG. 67 shows a specific configuration for determining the rotation stop position of the developing unit.

More specifically, as shown in FIG. 67, photosensors or distance sensing means 910 are mounted on the image forming unit 20, not shown, so as to sense the axis positions of the developing rollers 101 and 201 when the developing unit 26 is angularly moved. The output of each photosensor 910 varies with some linearity in accordance with the shift of a position to be sensed. Therefore, by varying the target output value of the photosensor 690 corresponding to the stop of movement of the developing unit, it is possible to vary the rotation stop position of the developing unit, i.e., the gap for development.

Figure 68:
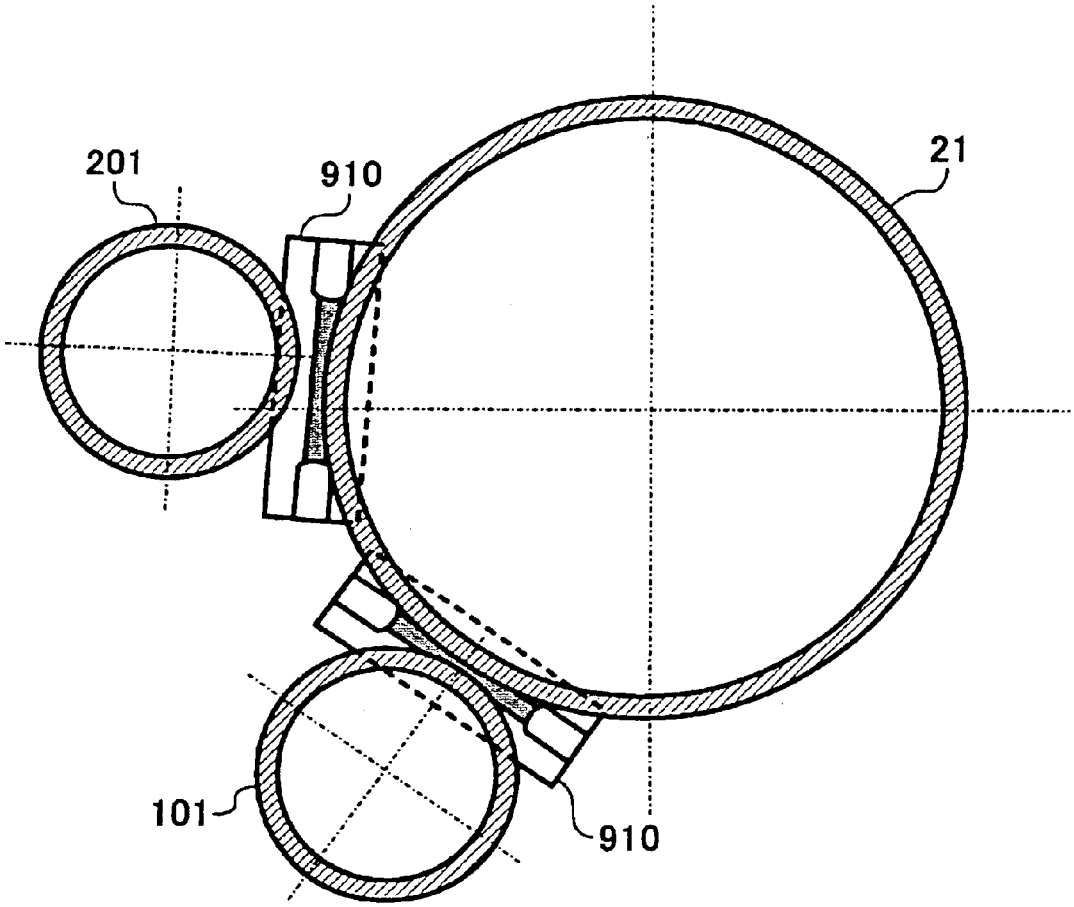
FIG. 68 shows another specific configuration for determining the rotation stop position of the developing unit.

FIG. 68 shows another specific arrangement of photosensors 910. As shown, the photosensors 910 are positioned in the vicinity of the ends of the developing rollers 101 and 201, respectively, in part of the gaps for development where the developer is absent, directly sensing the distance between the surfaces of the developing rollers 101 and 201 and the surface of the drum 21.

To vary the gap for development in accordance with the environmental conditions and process conditions, as stated earlier, it is necessary to vary the rotatable range of the developing unit. However, in the thirteenth and fourteenth embodiments, the mechanism for switching the developing devices 23 and 24 as to drive takes part in the setting of the rotatable range of the developing unit. The range in which the gap can be set is dependent on the rotatable range of the developing unit that can maintain the driven gear and drive gear 500G in mesh, so that the gap cannot be varied over a broad range. It is, however, possible to sufficiently satisfy the variable range of the optimum gap in accordance with the variation of the various conditions.

The thirteenth and fourteenth embodiments each determine the rotation angle θ required of the developing unit 26 while maintaining the gap for development constant. To make the gap variable in accordance with the environmental conditions and process conditions, it is, of course, necessary that the necessary rotation angle be increased by an angle corresponding to the variable range of the gap.

Gears used as the driven member of the developing roller and drive member are only illustrative. For example, when the drive member and driven member are implemented as roller members each having high friction surface, the drive/non-drive condition can be determined by the contact/non-contact of the drive and driven members. It follows that the switching of the developing function should only be taken into account in determining the rotation angle θ of the developing unit, enhancing the free layout of the developing devices and therefore the size reduction of the apparatus 1. Further, in the fourteenth embodiment, it is not necessary to continuously rotate the drive gear 500G during the movement of the developing unit or to make the rotation speed of the driven gear sufficiently lower than during development. This simplifies the construction and operation.

When use is made of the roller members each having a high friction surface, as stated above, a contact force strong enough to guarantee a strong frictional force necessary for drive transfer must be constantly maintained between the roller members. This can be done without any additional configuration only if the drive force of the developing unit rotating mechanism is maintained even after the rotation of the developing unit.

Now, the image forming apparatus taught in Japanese Patent Application No. 2001-371438 mentioned earlier, like the thirteenth and fourteenth embodiments, includes two photoconductive drums and two developing devices assigned to each of the photoconductive drums, which in combination constitute two image forming units. Each image forming unit is configured to form images of in two different colors. A single drive mechanism is included in each image forming unit for switching the two developing devices as to development/non-development. Also, the drive mechanism releases a developing roller included in the developing device in the non-developing condition from the photoconductive drum.

As stated above, the thirteenth and fourteenth embodiments and the apparatus taught in the above document each are capable of making the developing device other than the developing device performing development inoperative with a single drive mechanism. Further, the above embodiments and apparatus each are capable of selectively transferring the drive force of a drive source to either one of the developing devices.

Japanese Patent Laid-Open Publication Nos. 5-142918, 6-324571 and 2000-172043 each disclose a system in which a plurality of developing means forms toner images of different colors on a photoconductive drum one above the other for thereby implementing a multicolor image. When toner images of the second and successive colors are formed on the drum, the above system maintains developers on developing sleeves spaced from the drum for thereby preventing the above toner images from disturbing a toner image present on the drum. Further, the above documents teach a developing method that effects a toner image present on the drum little. More specifically, the developing method uses a bias for development whose AC voltage has a unique waveform and a magnet roller having a unique pole arrangement. However, the system that repeatedly executes charging, exposure and development over a toner image present on the drum cannot fully protect the toner image existing on the drum from deterioration, so that image quality achievable with such a system is limited.

On the other hand, Japanese Patent Laid-Open Publication Nos. 5-216337, 5-333701 and 11-338257, for example, each propose a particular image forming apparatus of the type transferring toner images sequentially formed on a photoconductive drum by a plurality of developing means to an intermediate image transfer body one above the other. This type of image forming apparatus forms a single toner image on the drum each time and is therefore free from the above-described problem, implementing high image quality.

The intermediate image transfer type of apparatus using a single photoconductive drum must release the developing means other than the currently operating developing means from the drum so as not to disturb a latent image and a toner image present on the drum. The surest way to satisfy this condition is retracting the developing means other than the currently operating developing means from a developing position. Alternatively, a magnet brush formed on a developing roller or developer carrier may be brought to an inoperative position.

More specifically, Laid-Open Publication No. 5-216337 proposes some different methods for preventing the developing means other than the currently operating developing means from disturbing a latent image and a toner image present on the drum. One method consists in rotating the developing roller in a direction opposite to a direction for development to thereby remove the developer from the surface of the developing roller. Another method consists in disposing a magnetic shield plate in the developing roller and moving the shield plate when development is not under way, thereby reducing the amount of the developer on the developing roller. A further method consists in allowing a magnet roller disposed in the developing roller to rotate about its own axis, so that the position on the developing roller where the developer forms a magnet brush is shifted to a position where the magnet brush does not contact the drum.

Laid-Open Publication No. 11-338257 proposes to locate a sleeve and a magnet rotatable about the axis of the sleeve at a position upstream of the developing position of the developing roller in the direction of rotation of the developing roller. The magnet is rotated to selectively interrupt the feed of the developer to the developing position.

Laid-Open Publication No. 5-333701 pertains to the method that prevents the developer from contacting the drum by removing the developer on the developing roller, and contemplates to obviate troubles ascribable to a small amount of developer left on the developing roller after removal. More specifically, after the removal of the developer on he developing roller, a magnet disposed in the developing roller is rotated to remove a small amount of developer left on the developing roller.

As stated above, as for an intermediate image transfer type of color image forming apparatus using a single photoconductive element, various methods have heretofore been proposed for preventing developing devices other than a developing device currently in operation from disturbing a latent image and a toner image present on the drum. However, the systems described previously cannot form a plurality of toner images of different colors on the drum unless the intermediate image transfer body is turned a number of times corresponding to the number of colors, obstructing an increase in operation speed.

On the other hand, the system configured to form toner images of different colors on the drum one above the other is not practicable without resorting to four developing means arranged around the drum and unless the circumferential length of the drum is greater than the length of the maximum sheet size applicable to the system. By contrast, the thirteenth and fourteenth embodiments of the present invention, using an image forming unit including two developing means that adjoin a single drum, free the circumferential length of the drum from the above limitation and therefore noticeably reduces the size and diameter of the drum.

The thirteenth and fourteenth embodiments of the present invention, using an image forming unit including two developing means that adjoin a single drum, form only a single toner image on the drum at all times like the system using a single drum, enhancing image quality. As for a four- or full-color image, the system using a single drum needs four developing means around the drum and must turn the intermediate image transfer body four consecutive times. By contrast, the intermediate image transfer type of image forming apparatus having two developing means around a single drum can form a full-color image by turning the intermediate image transfer body only two times, promoting the size and diameter reduction of the drum and high-speed operation.

It is therefore not necessary to move the image forming unit. This, coupled with the drum having a small diameter, obviates a sophisticated, bulky and costly construction. Further, the developing means other than one currently operating is immediately released from the drum so as to surely obviate color mixture for thereby enhancing image quality. Moreover, drive transfer from a single drive source to the developing means can be switched, freeing a drive transmitting mechanism from a sophisticated, bulky configuration.

In the thirteenth and fourteenth embodiments, the developer on the developing roller included in the inoperative developing device is spaced from the drum. Therefore, even when the drum must be continuously driven due to, e.g., the configuration of a drive source or the drive condition of a member contacting the drum, the moving surface of the drum is prevented from being rubbed by toner. This protects a photoconductive layer on the surface of the drum from wear and deterioration. Further, because members inside the inoperative developing device are not driven at all, the developer is free from unnecessary agitation. It follows that the life of the drum and that of the developer are extended while running cost and environmental load are reduced.

Various modifications will become possible for those skilled in the art after receiving the teachings of the present disclosure without departing from the scope thereof.

What is claimed is:

1. An image forming apparatus comprising:

an image carrier configured to carry a latent image thereon;

two developing devices facing said image carrier and each configured to develop a particular latent image formed on said image carrier with a respective developer carrier, said two developing devices being constructed into a single developing unit; and rotating means for causing said developing unit to angularly move about a preselected axis;

wherein said rotating means selectively moves said developing unit to one of a position where one of said two developing devices is located at a developing position close to said image carrier while the other developing device is located at a non-developing position spaced from said image carrier, a position where said the one developing device is located at a non-developing position spaced from said image carrier while the other developing device is located at a developing position close to said image carrier, and a position where said two developing devices both are located at the non-developing positions.

2. The apparatus as claimed in claim 1, wherein the axis of said developing unit extends through or around a center of gravity of said developing unit.

3. The apparatus as claimed in claim 1, further comprising drive means for applying a drive force necessary for development only to structural elements of the developing device located at the developing position;

wherein the developing device to which the drive force is to be applied is switched at the same time as an angular movement of said developing unit such that said drive means drives the structural elements of the developing device located at the developing position, but does not drive structural elements of the developing device located at the non-developing position, a driven member of the developing device to which the drive force is applied and a drive member of said driving means comprise a driven gear and a drive gear, respectively, axes of driven gears, each belonging to a respective developing device, and an axis of the drive gear are parallel to the axis of said developing unit, and an angle of rotation θg of the developing devices about the axis of said developing unit satisfies a following condition:

when S1<s2

$$\theta g \geqq \cos^{-1}[\{s1^2+l^2-(a+2\cdot m)^2\}/(2\cdot s1\cdot l)]-\cos^{-1}\{(s1^2+l^2-a^2)/(2\cdot s1\cdot l)\}$$

where l denotes a distance between the axis of said developing unit and the axis of the drive gear, s1 denotes a distance between the axis of one of the driven gears and said axis of said developing unit, s2 denotes a distance between the axis of the other driven gear and said axis of said developing unit, a denotes a distance between the axis of the driven gear of the developing device applied with the drive force and said axis of said drive gear, and m denotes a module of a gear member.

4. The apparatus as claimed in claim 3, wherein said drive means is controlled such that when said rotating means is moving said developing unit, said drive gear continuously rotates.

5. The apparatus as claimed in claim 4, wherein the axis of said developing unit extends through or around a center of gravity of said developing unit.

6. The apparatus as claimed in claim 1, wherein said image carrier comprises a cylindrical member rotatable about an axis of said image carrier, said developer carriers of said developing devices comprise roller members rotatable about axes of said developing devices, the axis of said developer carriers and the axis of said image carrier are parallel to the axis of said developing unit, and an angle of rotation θr of said developing unit caused by said rotating means satisfies a following condition:

$$\theta r \geq [\cos^{-1}\{(r1^2+L^2-Aoff^2)/(2\cdot r1\cdot L)\}-\cos^{-1}\{(r1^2+L^2-Aon^2)/(2\cdot r1\cdot L)\}]+[\cos^{-1}\{(r2^2+L^2-Aoff^2)/(2\cdot r2\cdot L)\}-\cos^{-1}\{(r2^2+L^2-Aon^2\}/(2\cdot r2\cdot L)\}]$$

where L denotes a distance between the axis of said developing unit, r1 denotes a distance between an axis of one of said developer carriers and said axis of said developing unit, r2 denotes an axis of the other developer carrier and said axis of said developing unit, Aon denotes a distance between an axis of said image carrier and an axis of the image carrier necessary when the developing device is located in the developing position, and Aoff denotes a distance between said axis of said image carrier and said axis of said developer carrier necessary when said developing device is located at the non-developing position.

7. The apparatus as claimed in claim 6, further comprising drive means for applying a drive force necessary for development only to structural elements of the developing device located at the developing position;

wherein the developing device to which the drive force is to be applied is switched at the same time as an angular movement of said developing unit such that said drive means drives the structural elements of the developing device located at the developing position, but does not drive structural elements of the developing device located at the non-developing position, a driven member of the developing device to which the drive force is applied and a drive member of said driving means comprise a driven gear and a drive gear, respectively, axes of driven gears, each belonging to a respective developing device, and an axis of the drive gear are parallel to the axis of said developing unit, and an angle of rotation θg of the developing devices about the axis of said developing unit satisfies a following condition:

when S1<s2

$$\theta g \geqq \cos^{-1}[\{s1^2+l^2-(a+2\cdot m)^2\}/(2\cdot s1\cdot l)]-\cos^{-1}\{(s1^2+l^2-a^2)/(2\cdot s1\cdot l)\}$$

where l denotes a distance between the axis of said developing unit and the axis of the drive gear, s1 denotes a distance between the axis of one of the driven gears and said axis of said developing unit, s2 denotes a distance between the axis of the other driven gear and said axis of said developing unit, a denotes a distance between the axis of the driven gear of the developing device applied with the drive force and said axis of said drive gear, and m denotes a module of a gear member.

8. The apparatus as claimed in claim 7, wherein said drive means is controlled such that when said rotating means is moving said developing unit, said drive gear continuously rotates.

9. The apparatus as claimed in claim 8, wherein the axis of said developing unit extends through or around a center of gravity of said developing unit.

10. An image forming apparatus comprising:

an image carrier; and at least one image forming unit comprising two developing means positioned side by side around said image carrier while facing said image carrier each for developing a particular latent image formed on said image carrier with a developer of a particular color;

wherein said image forming unit sequentially develops latent images sequentially formed on said image carrier in two colors by switching said two developing means to thereby produce corresponding toner images, said toner images being sequentially transferred to an intermediate image transfer body one above the other and then transferred to a recording medium, said two developing means are constructed into a single developing unit and rotatable about respective axes parallel to an axis of said image carrier, said image forming unit supports said developing unit such that said developing unit is angularly movable about an axis substantially parallel to the axis of said image carrier and comprises switching means for angularly moving said developing unit by a preselected angle relative to said image forming unit to thereby condition a gap between one of said two developing means and said image carrier for development, said switching means comprises drive means for driving said developing unit in a direction of angular movement and limiting means for limiting an angular movement of said developing unit, and said limiting means is positioned around opposite ends of said developing unit in a direction of the axis of said developing unit.

11. The apparatus as claimed in claim 10, wherein the axis of said developing unit extends through a position around a center of gravity of said developing unit.

12. The apparatus as claimed in claim 11, wherein said limiting means comprises a roller member freely rotatable about the axis of said developing means and contacting said image carrier at an outer periphery of said roller member.

13. The apparatus as claimed in claim 11, wherein said limiting means comprises a roller member freely rotatable about the axis of said image carrier and contacting said developing means at an outer periphery of said roller member.

14. The apparatus as claimed in claim 11, wherein said limiting means comprises an adjusting mechanism configured to adjust a position where the angular movement of said developing unit should be limited.

15. The apparatus as claimed in claim 11, wherein said switching means comprises eccentric cams adjoining opposite ends of said developing unit in a direction of the axis and rotatable about respective axes parallel to said axis of said developing unit, and cam contact surfaces formed integrally with said developing unit in opposite end portions of said developing unit, and said eccentric cams bias, when rotated, said cam contact surfaces to thereby move said developing unit in the direction of angular movement, the angular movement of said developing unit being limited when said eccentric cams stop rotating.

16. The apparatus as claimed in claim 15, wherein said cam contact surfaces comprise roller members freely rotatable about the axes of respective developing means and contacting said eccentric cams at outer peripheries thereof.

17. The apparatus as claimed in claim 16, wherein said eccentric cams each are formed with a guide groove in which one of said roller members is received.

18. The apparatus as claimed in claim 16, wherein said eccentric cams each comprise a cam surface contacting roller members freely rotatably mounted on the one developing means or the other developing means.

19. The apparatus as claimed in claim 15, wherein said eccentric cams are supported to be freely rotatable about the axis of said image carrier.

20. The apparatus as claimed in claim 15, further comprising an adjusting mechanism for adjusting, at a rotation stop position where one of said eccentric cams positioned at one end side contacts one of said cam contact surfaces positioned at said one end side to thereby limit the angular movement of said developing unit, a contact condition of the other eccentric cam positioned at the other end side with the other cam contact surface positioned at said other end side.

21. The apparatus as claimed in claim 15, further comprising an adjusting mechanism for adjusting, at a rotation stop position where one of said eccentric cams positioned at one end side contacts one of said cam contact surfaces positioned at said one end side to thereby limit the angular movement of said developing unit, a contact condition of the other cam contact surface positioned at the other end side with the other eccentric cam positioned at said other end side.

22. The apparatus as claimed in claim 15, wherein said cam contact surfaces each comprise two cam contact surfaces nipping a cam surface of one of said eccentric cams.

23. The apparatus as claimed in claim 15, further comprising an adjusting mechanism for adjusting an amount and a phase of eccentricity of one of said eccentric cams relative to the axis of the one eccentric cam.

24. The apparatus as claimed in claim 15, further comprising an eccentricity adjusting mechanism for adjusting an amount of eccentricity of one of said eccentric cams relative to the axis of the one eccentric cam, and a phase adjusting mechanism for adjusting a phase of eccentricity of the other eccentric cam relative to the axis of said other eccentric cam.

25. The apparatus as claimed in claim 15, wherein said switching means comprises a stepping motor for causing said eccentric cams to rotate, and when said developing means are switched, a number of steps of the stepping motor is set to thereby limit the angular movement of said developing unit.

26. The apparatus as claimed in claim 25, further comprising sensing means for sensing, when said developing means are switched, an angular position of said developing unit that constitutes a reference for an operation of said developing means, wherein the number of steps of the stepping motor is set in accordance with said angular position sensed by said sensing means.

27. The apparatus as claimed in claim 25, further comprising process sensing means for sensing process conditions for image formation including a toner content of a developer, a charge potential and an exposure potential, wherein the number of steps of the stepping motor is set in accordance with an output of said sensing means.

28. The apparatus as claimed in claim 25, further comprising sensing means for sensing environmental conditions including temperature and humidity, wherein the number of steps of the stepping motor is set in accordance with an output of said sensing means.

29. The apparatus as claimed in claim 25, further comprising mode setting means for setting an image forming mode, which may be any one of a color mode, a black-and-white mode and a photo mode, wherein the number of steps of the stepping motor is set in accordance with said image forming mode set.

30. The apparatus as claimed in claim 10, wherein said limiting means comprises a roller member supported to be freely rotatable about the axis of individual developing means and contacting said image carrier at an outer periphery thereof.

31. The apparatus as claimed in claim 10, wherein said limiting means comprises a roller member supported to be freely rotatable about the axis of said image carrier and contacting individual developing means at an outer periphery thereof.

32. The apparatus as claimed in claim 10, wherein said limiting means comprises an adjusting mechanism for adjusting a position where an angular movement of said developing unit should be limited.

33. The apparatus as claimed in claim 10, wherein said switching means comprises eccentric cams adjoining opposite ends of said developing unit in a direction of the axis and rotatable about respective axes parallel to said axis of said developing unit, and cam contact surfaces formed integrally with said developing unit in opposite end portions of said developing unit, and said eccentric cams bias, when rotated, said cam contact surfaces to thereby move said developing unit in the direction of angular movement, the angular movement of said developing unit being limited when said eccentric cams stop rotating.

34. The apparatus as claimed in claim 33, wherein said cam contact surfaces comprise roller members freely rotatable about the axes of respective developing means and contacting said eccentric cams at outer peripheries thereof.

35. The apparatus as claimed in claim 34, wherein said eccentric cams each are formed with a guide groove in which one of said roller members is received.

36. The apparatus as claimed in claim 34, wherein said eccentric cams each comprise a cam surface contacting roller members freely rotatably mounted on the one developing means or the other developing means.

37. The apparatus as claimed in claim 33, wherein said eccentric cams are supported to be freely rotatable about the axis of said image carrier.

38. The apparatus as claimed in claim 33, further comprising an adjusting mechanism for adjusting, at a rotation stop position where one of said eccentric cams positioned at one end side contacts one of said cam contact surfaces positioned at said one end side to thereby limit the angular movement of said developing unit, a contact condition of the other eccentric cam positioned at the other end side with the other cam contact surface positioned at said other end side.

39. The apparatus as claimed in claim 33, further comprising an adjusting mechanism for adjusting, at a rotation stop position where one of said eccentric cams positioned at one end side contacts one of said cam contact surfaces positioned at said one end side to thereby limit the angular movement of said developing unit, a contact condition of the other cam contact surface positioned at the other end side with the other eccentric cam positioned at said other end side.

40. The apparatus as claimed in claim 33, wherein said cam contact surfaces each comprise two cam contact surfaces nipping a cam surface of one of said eccentric cams.

41. The apparatus as claimed in claim 33, further comprising an adjusting mechanism for adjusting an amount and a phase of eccentricity of one of said eccentric cams relative to the axis of the one eccentric cam.

42. The apparatus as claimed in claim 33, further comprising an eccentricity adjusting mechanism for adjusting an amount of eccentricity of one of said eccentric cams relative to the axis of the one eccentric cam, and a phase adjusting mechanism for adjusting a phase of eccentricity of the other eccentric cam relative to the axis of said other eccentric cam.

43. The apparatus as claimed in claim 33, wherein said switching means comprises a stepping motor for causing said eccentric cams to rotate, and when said developing means are switched, a number of steps of the stepping motor is set to thereby limit the angular movement of said developing unit.

44. The apparatus as claimed in claim 43, further comprising sensing means for sensing, when said developing means are switched, an angular position of said developing unit that constitutes a reference for an operation of said developing means, wherein the number of steps of the stepping motor is set in accordance with said angular position sensed by said sensing means.

45. The apparatus as claimed in claim 43, further comprising process sensing means for sensing process conditions for image formation including a toner content of a developer, a charge potential and an exposure potential, wherein the number of steps of the stepping motor is set in accordance with an output of said sensing means.

46. The apparatus as claimed in claim 43, further comprising sensing means for sensing environmental conditions including temperature and humidity, wherein the number of steps of the stepping motor is set in accordance with an output of said sensing means.

47. The apparatus as claimed in claim 43, further comprising mode setting means for setting an image forming mode, which may be any one of a color mode, a black-and-white mode and a photo mode, wherein the number of steps of the stepping motor is set in accordance with said image forming mode set.

48. The apparatus as claimed in claim 10, further comprising distance sensing means for sensing distances between the axes of said developing means and the axis of said image carrier, wherein an angular position of said developing unit is determined in accordance with outputs of said distance sensing means.

49. The apparatus as claimed in claim 48, wherein said distance sensing means senses a distance between a surface of each developing means and a surface of said image carrier.

50. The apparatus as claimed in claim 48, wherein said distance sensing means comprises two sensing means responsive to distances between the axes of said developing means and the axis of said image carrier and positioned in the vicinity of opposite ends of said developing unit in an axial direction.

51. The apparatus as claimed in claim 50, further comprising process sensing means for sensing process conditions for image formation including a toner content of a developer, a charge potential and an exposure potential, wherein a target value of an output signal of said distance sensing means is determined in accordance with said process conditions sensed by said process sensing means.

52. The apparatus as claimed in claim 50, further comprising environmental condition sensing means for sensing environmental conditions including temperature and humidity, wherein a target value of an output signal of said distance sensing means is determined in accordance with said environmental conditions sensed by said environmental condition sensing means.

53. The apparatus as claimed in claim 50, further comprising for setting an image forming mode, which may be any one of a color mode, a black-and-white mode and a photo mode, wherein a target value of an output signal of said distance sensing means is determined in accordance with the image forming mode set by said mode setting means.

54. The apparatus as claimed in claim 48, further comprising process sensing means for sensing process conditions for image formation including a toner content of a developer, a charge potential and an exposure potential, wherein a target value of an output signal of said distance sensing means is determined in accordance with said process conditions sensed by said process sensing means.

55. The apparatus as claimed in claim 48, further comprising environmental condition sensing means for sensing environmental conditions including temperature and humidity, wherein a target value of an output signal of said distance sensing means is determined in accordance with said environmental conditions sensed by said environmental condition sensing means.

56. The apparatus as claimed in claim 48, further comprising for setting an image forming mode, which may be any one of a color mode, a black-and-white mode and a photo mode, wherein a target value of an output signal of said distance sensing means is determined in accordance with the image forming mode set by said mode setting means.

57. The apparatus as claimed in claim 10, wherein said drive means is positioned in the vicinity of opposite ends of said developing unit in an axial direction and determines a position wherein an angular movement of said developing unit should be limited.

58. The apparatus as claimed in claim 57, wherein said distance sensing means is positioned in the vicinity of the opposite ends of said developing unit, the position where the angular movement of said developing unit should be limited by the drive means positioned at one end side is controlled in accordance with an output of the distance sensing means positioned at said one end side, and the position where the angular movement of said developing unit should be limited by the drive means positioned at the other end side is controlled in accordance with an output of the distance sensing means positioned at said other end side.

59. The apparatus as claimed in claim 58, wherein said distance sensing means each sense a distance between a surface of said developing means and a surface of said image carrier.

60. The apparatus as claimed in claim 59, wherein said eccentric cams are supported to be freely rotatable about the axis of said image carrier.

61. The apparatus as claimed in claim 59, further comprising process sensing means for sensing process conditions for image formation including a toner content of a developer, a charge potential and an exposure potential, wherein a target value of an output signal of said distance sensing means is determined in accordance with said process conditions sensed by said process sensing means.

62. The apparatus as claimed in claim 59, further comprising environmental condition sensing means for sensing environmental conditions including temperature and humidity, wherein a target value of an output signal of said distance sensing means is determined in accordance with said environmental conditions sensed by said environmental condition sensing means.

63. The apparatus as claimed in claim 59, further comprising for setting an image forming mode, which may be any one of a color mode, a black-and-white mode and a photo mode, wherein a target value of an output signal of said distance sensing means is determined in accordance with the image forming mode set by said mode setting means.

64. The apparatus as claimed in claim 58, further comprising process sensing means for sensing process conditions for image formation including a toner content of a developer, a charge potential and an exposure potential, wherein a target value of an output signal of said distance sensing means is determined in accordance with said process conditions sensed by said process sensing means.

65. The apparatus as claimed in claim 58, further comprising environmental condition sensing means for sensing environmental conditions including temperature and humidity, wherein a target value of an output signal of said distance sensing means is determined in accordance with said environmental conditions sensed by said environmental condition sensing means.

66. The apparatus as claimed in claim 58, further comprising for setting an image forming mode, which may be any one of a color mode, a black-and-white mode and a photo mode, wherein a target value of an output signal of said distance sensing means is determined in accordance with the image forming mode set by said mode setting means.

* * * * *